US010414024B2

(12) United States Patent
Sato et al.

(10) Patent No.: US 10,414,024 B2
(45) Date of Patent: Sep. 17, 2019

(54) TOOL HOLDER, POLISHING TOOL, POLISHING TOOL UNIT, AND METHOD OF ADJUSTING PROTRUDING AMOUNT OF GRINDING MEMBER

(71) Applicants: XEBEC TECHNOLOGY CO., LTD., Tokyo (JP); TAIMEI CHEMICALS CO., LTD., Nagano (JP)

(72) Inventors: Youichi Sato, Tokyo (JP); Suguru Matsushita, Nagano (JP)

(73) Assignees: XEBEC TECHNOLOGY CO., LTD., Tokyo (JP); TAIMEI CHEMICALS CO., LTD., Nagana (JP)

( * ) Notice: Subject to any disclaimer, the term of this patent is extended or adjusted under 35 U.S.C. 154(b) by 227 days.

(21) Appl. No.: 15/304,501

(22) PCT Filed: May 13, 2015

(86) PCT No.: PCT/JP2015/063775
§ 371 (c)(1),
(2) Date: Oct. 14, 2016

(87) PCT Pub. No.: WO2015/178273
PCT Pub. Date: Nov. 26, 2015

(65) Prior Publication Data

US 2017/0036323 A1 Feb. 9, 2017

(30) Foreign Application Priority Data

May 22, 2014 (JP) ..... 2014-106402

(51) Int. Cl.
*B24D 13/14* (2006.01)
*B24B 33/08* (2006.01)
*B24B 29/00* (2006.01)

(52) U.S. Cl.
CPC ..... *B24D 13/14* (2013.01); *B24B 29/00* (2013.01); *B24B 33/085* (2013.01)

(58) Field of Classification Search
CPC ..... B24B 29/00; B24B 33/081; B24B 33/083; B24B 33/085; B24D 13/14
See application file for complete search history.

(56) References Cited

U.S. PATENT DOCUMENTS 6,679,766 B2 * 1/2004 Schulz ..... B24B 33/02 451/177
2003/0207657 A1 * 11/2003 Domanski ..... B24B 33/081 451/482

(Continued)

FOREIGN PATENT DOCUMENTS

CN 101274414 A 10/2008
DE 10058677 A1 6/2002

(Continued)

OTHER PUBLICATIONS

World Intellectual Property Organization, International Search Report for PCT International Patent Application No. PCT/JP2015/063775, dated Jul. 7, 2015.

(Continued)

*Primary Examiner* — Timothy V Eley

(57) ABSTRACT

A polishing tool unit (1) includes a brush-shaped grinding stone (4) and a tool holder (2). The tool holder (2) includes a shank (2*a*), a sleeve (6), a gear screw (30), and a nut (36). The nut (36) is screwed onto a bolt portion (34) of the gear screw (30). The brush-shaped grinding stone (4) is connected to the front side of the nut (36) and held by the tool holder (2). The gear screw (30) is rotatable relative to the shank (2*a*) and the sleeve (6) about the axis (L). While rotation of the nut (36) about the axis (L) is regulated, the gear screw (30) is rotated, whereby the nut (36) is moved (Continued)

and the protruding amount of linear grinding members (3) is adjusted.

11 Claims, 46 Drawing Sheets

(56) References Cited

U.S. PATENT DOCUMENTS

| | | | | |
|---|---|---|---|---|
| 2016/0016293 | A1* | 1/2016 | Matsushita | A46D 1/00 451/532 |
| 2017/0036323 | A1* | 2/2017 | Sato | B24B 29/00 |
| 2017/0043444 | A1* | 2/2017 | Okada | B24B 29/00 |

FOREIGN PATENT DOCUMENTS

| | | | |
|---|---|---|---|
| EP | 1916058 | A1 | 4/2008 |
| EP | 2522461 | A1 | 11/2012 |
| JP | H04-322966 | A | 11/1992 |
| JP | H09-239668 | A | 9/1997 |
| JP | H09-267271 | A | 10/1997 |
| JP | H11-114760 | A | 4/1999 |
| JP | 2003-136413 | A | 5/2003 |
| JP | 2005-111640 | A | 4/2005 |
| JP | 2009-050967 | A | 3/2009 |
| JP | 2015-112702 | A | 6/2015 |
| KR | 10-0799047 | B1 | 1/2008 |

OTHER PUBLICATIONS

World Intellectual Property Organization, Written Opinion for PCT International Patent Application PCT/JP2015/063775, dated Jul. 7, 2015.

The State Intellectual Property Office of People's Republic of China,Search Report for Chinese Patent Application No. 2015800258868, dated Mar. 13, 2018.

* cited by examiner

TOOL HOLDER, POLISHING TOOL, POLISHING TOOL UNIT, AND METHOD OF ADJUSTING PROTRUDING AMOUNT OF GRINDING MEMBER

FIELD

The present invention relates to a polishing tool including a grinding member, and a polishing tool unit having a tool holder that holds the polishing tool.

BACKGROUND

For deburring and polishing of moldings, pressed products, and machined products of metals, a polishing tool in which the base ends of linear grinding members are bundled with a grinding member holder so as to form a brush-shape is employed. Patent Literature 1 describes a polishing tool unit (polisher brush) in which a polishing tool is held by a tool holder including a shank serving as an attachment part to a processing machine. The tool holder includes a sleeve coaxial with the shank. The polishing tool is held by the tool holder in a state that a grinding member holder is inserted into the sleeve, and the free ends of linear grinding members protrude from the tip opening of the sleeve. The grinding member holder is movable inside the sleeve in the axial direction, and adjustment of the protruding amount of the linear grinding members from the sleeve is made by moving the grinding member holder in the axial direction.

Here, using a fixing screw, the grinding member holder is fixed to a desired position in the sleeve in the axial direction. That is, an opening is formed in the circumferential wall of the sleeve over a predetermined range in the axial direction, and a threaded hole is formed in the grinding member holder so as to penetrate in a direction perpendicular to the axial direction. A fixing screw is tightened from the opening side so that the tip part of the fixing screw comes into contact with the inner circumferential surface of the circumferential wall part, whereby the grinding member holder is pressed against the inner circumferential surface of the circumferential wall, and fixed.

CITATION LIST

Patent Literature

Patent Literature 1: Japanese Unexamined Patent Application Publication No. 2009-50967 (JP 2009-50967 A)

SUMMARY

Technical Problem

Grinding members are worn out during processing operation. Therefore, it is necessary to adjust the protruding amount of grinding members in accordance with the degree of wear. Here, in the polishing tool unit described in Patent Literature 1, for the purpose of adjusting the protruding amount of grinding members, it is necessary to loosen a fixing screw and move a grinding member holder in the axial direction, and then, tighten the fixing screw again and fix the grinding member holder to a sleeve, and thus, such adjustment work takes time and effort.

In view of these problems, an object of the present invention is to provide a tool holder that allows the protruding amount of grinding members from a sleeve to be easily adjusted. Furthermore, an object of the present invention is to provide a polishing tool unit including such tool holder and a polishing tool. Furthermore, an object of the present invention is to provide a polishing tool suitable for being held by such tool holder. Furthermore, an object of the present invention is to provide a method of adjusting the protruding amount of grinding members, the method being capable of easily adjusting the protruding amount of grinding members from a sleeve.

Solution to Problem

To solve the problems, the present invention provides a tool holder including: a shank; a sleeve positioned forward of the shank in an axial direction of the shank; a shaft positioned forward of the shank and extending coaxially with the shank; a bolt portion provided in the shaft inside the sleeve; a nut screwed onto the bolt portion; and a nut moving mechanism configured to move the nut along the bolt portion in the axial direction, in which a polishing tool including a grinding member is movably held together with the nut in a state that at least part of the grinding member protrudes from a front end opening of the sleeve.

According to the present invention, the grinding member protruding amount of the grinding member from the sleeve in the polishing tool can be adjusted by moving the nut along the bolt part. Accordingly, compared with a case in which, when the protruding amount of the grinding member is adjusted, a fixing screw is loosened or tightened, the adjustment work can be more easily carried out. Furthermore, the movement amount of the nut in the axial direction is precisely regulated by the angle of relative rotation of the shaft and the nut. Accordingly, the protruding amount of the grinding member in the polishing tool can be adjusted with high accuracy.

In the present invention, the shaft may be rotatable relative to the shank and the sleeve about the axis, the shank and the sleeve may be relatively unrotatably connected to each other, and the nut moving mechanism may include a nut rotation regulating mechanism configured to regulate the rotation of the nut relative to the sleeve. With this configuration, the rotation of the shaft relative to the shank brings about the rotation of the shaft relative to the nut. Accordingly, when the shaft is rotated in a state that the shank is fixed to a machine tool or the like, the nut is moved in the axial direction, whereby the protruding amount of the grinding member can be adjusted.

In this case, the shaft may be movable between a first position and a second position spaced backward from the first position in the axial direction, and the nut moving mechanism may include: a biasing member that provides biasing force to bias the shaft toward the first position when the shaft moves from the first position toward the second position; and a motion converting mechanism configured to convert a linear reciprocating motion of the shaft from the first position via the second position back to the first position into a rotational motion of the shaft to rotate about the axis at a certain angle in a single direction. With this configuration, when a pushing operation of pushing the shaft backward is performed, the shaft is rotated, whereby the protruding amount of the grinding member can be adjusted. Furthermore, with this configuration, when the force of pushing the polishing tool into the sleeve from a process-target workpiece side acts during processing operation, the polishing tool is made to move backward in the axial direction, whereby breakage of the polishing tool and wear of the grinding member can be reduced.

Furthermore, in this case, the shank may include a coolant inlet hole that penetrates the shank. The nut moving mechanism may include: a moving member relatively unrotatably supported by the shaft in a state of being movable between a first position and a second position spaced backward from the first position in the axial direction; a biasing member that biases the moving member to the second position; and a motion converting mechanism configured to convert a linear reciprocating motion of the moving member from the second position via the first position back to the second position into a rotational motion of the moving member to rotate about the axis at a certain angle in a single direction. When a coolant is fed into the coolant inlet hole, fluid pressure of the coolant may allow the moving member to move from the second position to the first position against the biasing force of the biasing member. With this configuration, when a coolant is fed into the shank from a machine tool, the shaft is rotated, whereby the protruding amount of the grinding member can be adjusted.

Furthermore, in this case, the nut moving mechanism may include an operating mechanism configured to rotate the shaft relative to the shank. With this configuration, the shaft is rotated by the operation of an operating member, whereby the protruding amount of the grinding member can be adjusted.

In the present invention, the shank may be formed integrally with the shaft, the sleeve may be rotatable relative to the shank and the shaft about the axis, and the nut moving mechanism may include a nut rotation regulating mechanism configured to regulate the rotation of the nut relative to the sleeve. With this configuration, the rotation of the sleeve relative to the shank brings about the rotation of the shaft relative to the nut. Accordingly, when the sleeve is rotated in a state that the shank is fixed to a machine tool or the like, the nut is moved in the axial direction, whereby the protruding amount of the grinding member can be adjusted.

In this case, the nut moving mechanism preferably includes an operating member configured to rotate the sleeve relative to the shank. With this configuration, the sleeve is rotated by operating the operating member, whereby the protruding amount of the grinding member can be adjusted.

In the present invention, for the purpose of making a polishing tool movable integrally with a nut, the nut may include a connecting part that attachably and detachably connects to the polishing tool.

In the present invention, for the purpose of making a polishing tool movable integrally with a nut, the nut may be provided integrally with the polishing tool.

Next, a polishing tool unit of the present invention includes the tool holder and a polishing tool that includes grinding member and is held by the tool holder.

With the polishing tool unit of the present invention, the grinding member protruding amount of the grinding member of the polishing tool that protrude from the sleeve of the tool holder is easily adjusted.

Furthermore, a polishing tool of the present invention includes a grinding member and an annular grinding member holder that holds the grinding member. A female thread is formed in an annular inner circumferential surface of the grinding member holder.

According to the present invention, when the polishing tool is held by the tool holder, the grinding member holder can be made to function as a nut of the tool holder.

Next, a method of adjusting a protruding amount of a grinding member according to the present invention employs a tool holder including a shank, a sleeve positioned forward of the shank in an axial direction of the shank, a shaft positioned forward of the shank and extending coaxially with the shank, a bolt portion provided in the shaft inside the sleeve, and a nut screwed onto the bolt portion. The method includes: holding a polishing tool including the grinding member by the tool holder, with the polishing tool movable integrally with the nut; and moving the nut along the bolt portion in the axial direction to adjust the grinding member protruding amount of the grinding member from the sleeve.

According to the present invention, the grinding member protruding amount of the grinding member from the sleeve in the polishing tool is adjusted by moving the nut along the bolt part. Accordingly, compared with a case in which, when the protruding amount of the grinding member is adjusted, a fixing screw is loosened or tightened, the adjustment work can be more easily carried out. Furthermore, the movement amount of the nut in the axial direction is precisely regulated by the angle of relative rotation of the shaft and the nut. Accordingly, the protruding amount of the grinding member in the polishing tool can be adjusted with high accuracy.

DESCRIPTION OF EMBODIMENTS

Hereinafter, polishing tool units to which the present invention is applied are described with reference to the drawings.

Embodiment 1

Figure 1:
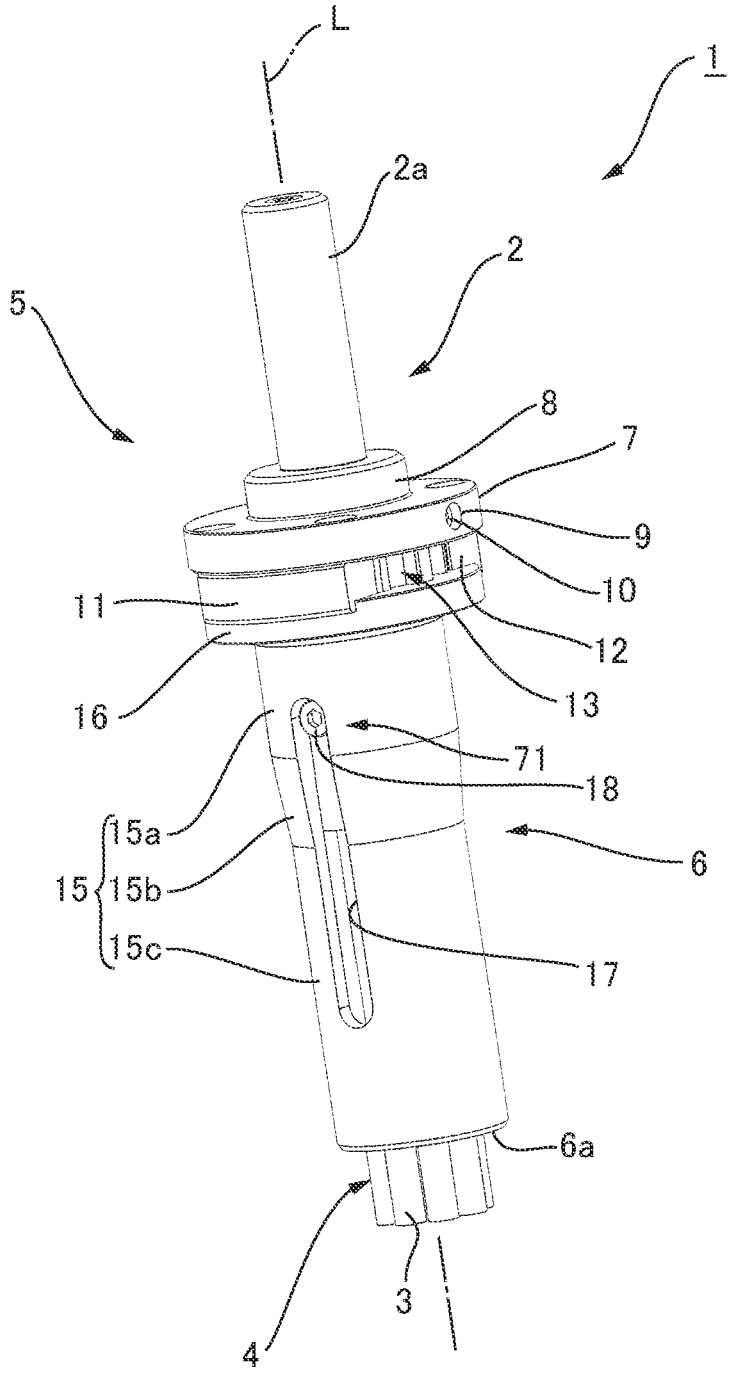
FIG. 1 is a perspective view of a polishing tool unit of Embodiment 1 to which the present invention is applied.

FIG. 1 is a perspective view of a polishing tool unit of Embodiment 1 to which the present invention is applied. The polishing tool unit of the present embodiment is attached for use to a machine tool such as a machining center. As illustrated in FIG. 1, a polishing tool unit 1 includes: a tool holder 2 including a shank 2*a* serving as a part attached to a machine tool; and a brush-shaped grinding stone (a polishing tool) 4 including linear grinding members (grinding members) 3 protruding from the front end of the tool holder 2, the front end being on the opposite side of the tool holder 2 from the shank 2*a*. Hereinafter, a side on which the linear grinding members 3 protrude from the tool holder 2 in the direction of the axis L of the polishing tool unit 1 is regarded as the front, and the shank 2*a* side is regarded as the rear, and the polishing tool unit 1 is thus described.

(Tool Holder)

The tool holder 2 includes a shank head 5 and a sleeve 6 coaxially in the axis L direction in order from the shank 2*a* side. The shank head 5 includes the shank 2*a*, a disk part 7, and a connecting disk part 8 that connects between the disk part 7 and the shank 2*a*. The outer diameter of the connecting disk part 8 is larger than the outer diameter of the shank 2*a*, and smaller than the outer diameter of the disk part 7. The disk part 7 is provided with two through holes 9 extending in the radial direction. The two through holes 9 are formed in 180-degree rotational symmetry about the axis L. Into each of the through holes 9, a biasing screw 10 is screwed. In the outer circumferential edge of the front end of the disk part 7, two arc-shaped walls 11 extending in the front and circumference direction are provided. The two arc-shaped walls 11 are formed in 180-degree rotational symmetry about the axis L. From a gap part 12 between the two arc-shaped walls 11, a gear screw operating gear 13 that is disposed on the inner circumferential side of the arc-shaped walls 11 is partially exposed.

The sleeve 6 includes a tube part 15 extending in the axis L direction, and an annular flange 16 spreading from the rear end of the tube part 15 toward the outer circumferential side. The flange 16 is formed coaxially with the tube part 15. The front ends of the arc-shaped walls 11 of the shank head 5 is fitted into the rear end portion of the outer circumferential edge of the flange 16. The outer circumferential surface of the tube part 15 includes: a large-diameter outer circumferential surface portion 15*a* being adjacent to the flange 16 and having a constant outer diameter; a tapered outer circumferential surface portion 15*b* being continuous to the front end of the large-diameter outer circumferential surface portion 15*a* and having an outer diameter becoming smaller toward the front; and a small-diameter outer circumferential surface portion 15*c* being continuous to the front end of the tapered outer circumferential surface portion 15*b* and extending with keeping a constant outer diameter. The tube part 15 is provided with two groove-shaped guide holes 17 extending from the large-diameter outer circumferential surface portion 15*a* via the tapered outer circumferential surface portion 15*b* to the small-diameter outer circumferential surface portion 15*c*. The two guide holes 17 each extend in the axis L direction and are formed in 180-degree rotational symmetry about the axis L. A connecting screw 18 is positioned inside the guide hole 17.

Figure 2A:
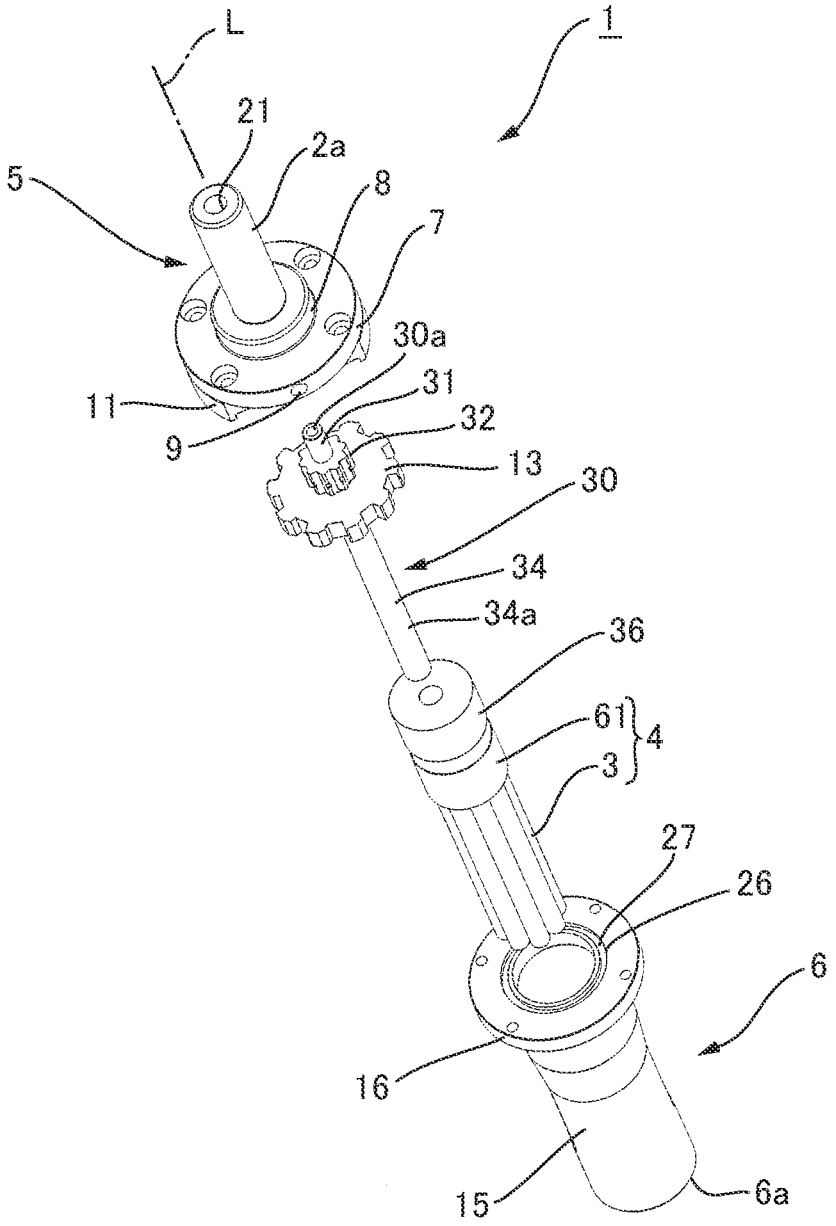
FIG. 2 is an exploded perspective view of the polishing tool unit illustrated in FIG. 1.
Figure 2B:
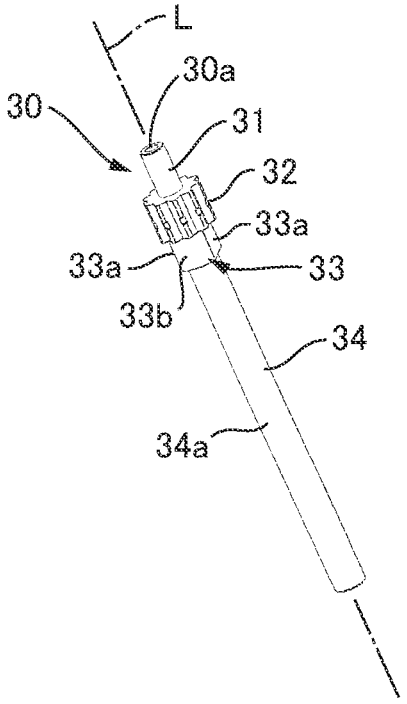
Figure 3:
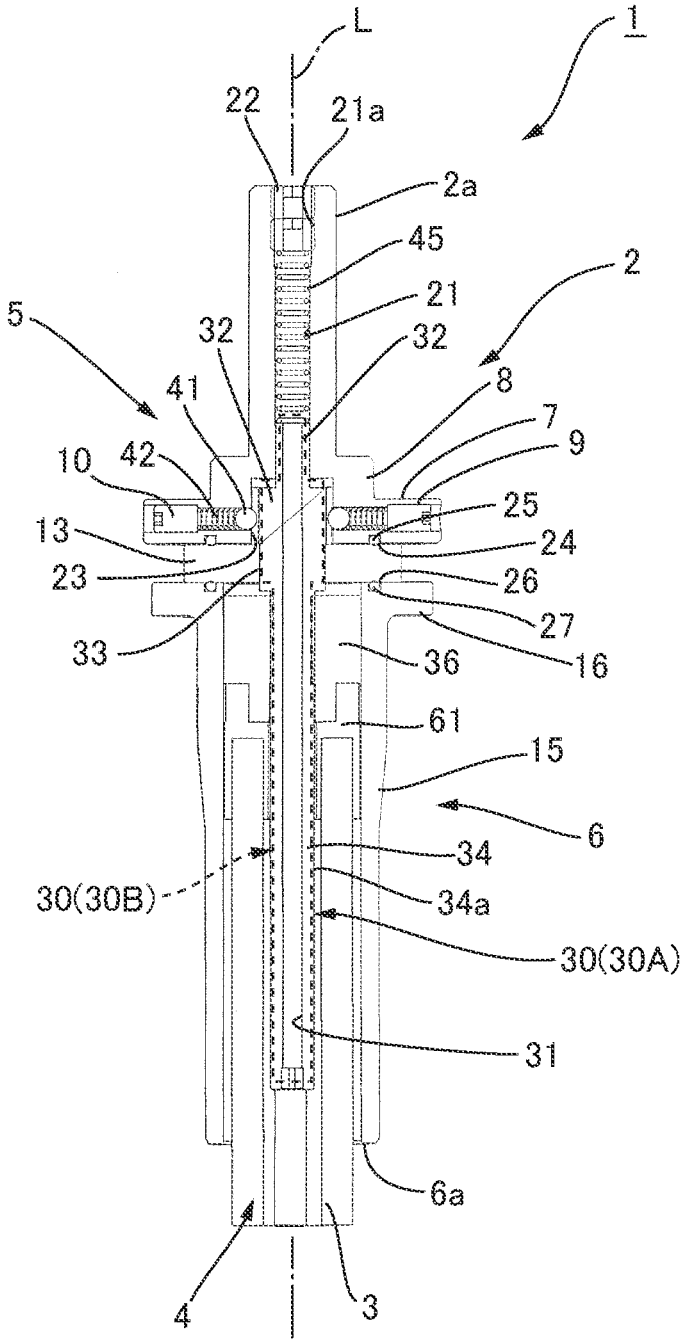
FIG. 3 is a first longitudinal sectional view of the polishing tool unit illustrated in FIG. 1.
Figure 4:
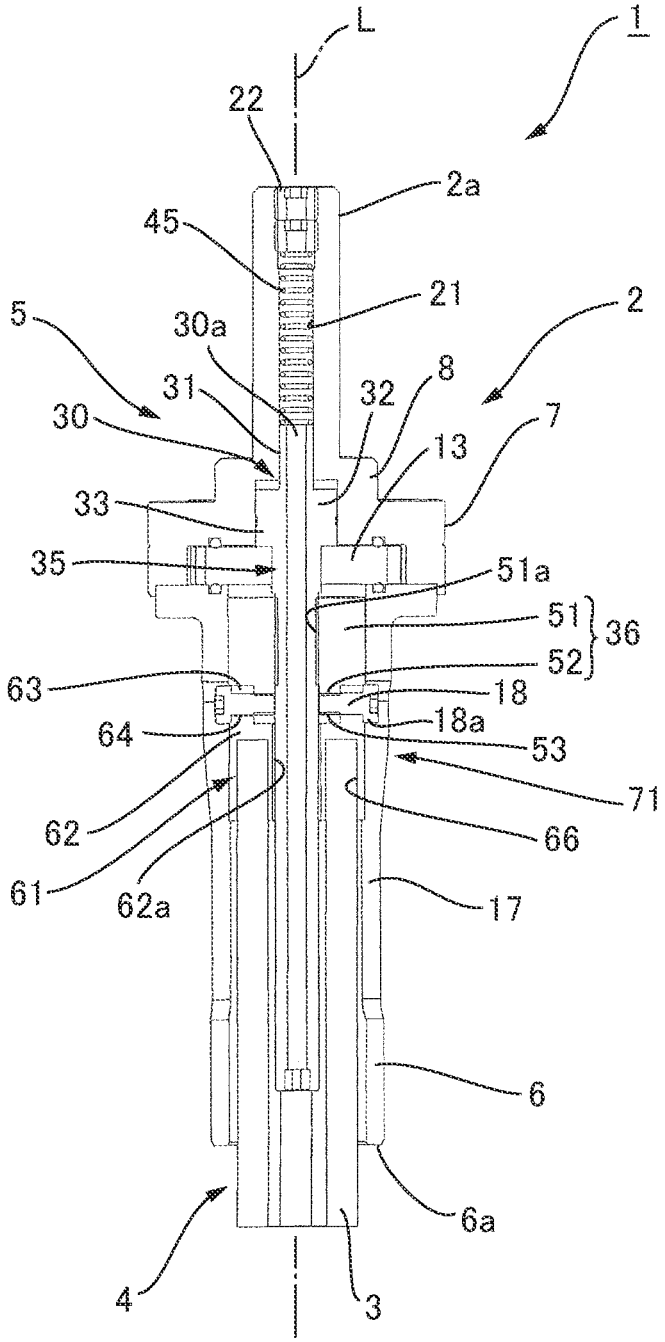
FIG. 4 is a second longitudinal sectional view of the polishing tool unit illustrated in FIG. 1.

FIG. 2(*a*) is an exploded perspective view of the polishing tool unit 1 illustrated in FIG. 1, and FIG. 2(*b*) is a perspective view of a gear screw. FIG. 3 is a first longitudinal sectional view of the polishing tool unit 1 illustrated in FIG. 1, the view being cut through a position not passing through the guide holes 17. FIG. 4 is a second longitudinal sectional view of the polishing tool unit 1 illustrated in FIG. 1, the view being cut through a position passing through the guide holes 17. As illustrated in FIG. 3, the shank head 5 is provided with a head center hole 21 that penetrates the shank 2*a*, the connecting disk part 8, and the disk part 7 in the axis L direction. A threaded part 21*a* is formed in the inner circumferential surface of the rear end portion of the head center hole 21, that is, in the vicinity of the rear end opening of the head center hole 21. An annular screw 22 is screwed into the threaded part 21*a* from the rear. A circular recess part 23 recessed backward is formed at the center of the front end surface of the disk part 7. The bottom (the rear end surface) of the circular recess part 23 is positioned in the connecting disk part 8. The front end opening of the head center hole 21 is formed at the center of the bottom of the circular recess part 23.

The two through holes 9 provided in the disk part 7 each communicate with the circular recess part 23. That is, the inner opening of each of the through holes 9 is formed in the annular wall surface of the circular recess part 23. In the front end surface of the disk part 7, a head-side annular groove 24 that coaxially surrounds the circular recess part 23 is formed. A first O-ring 25 is inserted into the head-side annular groove 24.

The inner diameter of the sleeve 6 is constant. The rear end surface of the flange 16 is provided with a sleeve-side annular groove 26 that coaxially surrounds the center hole of the sleeve 6. The sleeve-side annular groove 26 and the head-side annular groove 24 are formed so as to overlap each other when viewed from the axis L direction. A second O-ring 27 is inserted into the sleeve-side annular groove 26.

As illustrated in FIG. 2, a gear screw (a shaft) 30 is disposed on the inner circumferential side of the shank head 5 and the sleeve 6 so as to be coaxial with the shank 2*a* and the sleeve 6. The gear screw 30 includes a screw center hole 30*a* penetrating in the axis L direction. As illustrated in FIG. 2(*b*), the gear screw 30 further includes, from the rear toward the front: a small-diameter portion 31; a gear screw holding gear 32; a large-diameter portion 33 having a diameter larger than that of the small-diameter portion 31; and a bolt portion 34 having a diameter smaller than that of the large-diameter portion 33. The bolt portion 34 has a diameter larger than that of the small-diameter portion 31, and, in the outer circumferential surface of the bolt portion 34, a male thread 34*a* is formed. The gear screw 30 is such that the small-diameter portion 31 and most of the large-diameter portion 33 are positioned inside the shank head 5, and the bolt portion 34 is positioned inside the sleeve 6. A nut 36 is screwed onto the bolt portion.

The gear screw 30 includes a pair of parallel surfaces 33*a* extending in parallel with the axis L on both sides of the axis L, and a pair of arc-shaped surfaces 33*b* arranged between the pair of the parallel surfaces 33*a* and being continuous to the parallel surfaces 33*a* in the circumferential direction, in the outer circumferential surface of the large-diameter portion 33. As illustrated in FIG. 2(*a*) and FIG. 4, the gear screw operating gear 13 is coaxially attached to the large-diameter portion 33.

The gear screw operating gear 13 includes a fitting hole which has an elliptical plane shape and into which the large-diameter portion 33 is fitted when viewed from the axis L direction. The elliptical plane shape means a shape having two parallel sides and arc-shaped surfaces connecting the two sides. As illustrated in FIG. 4, the gear screw operating gear 13 is attached to the gear screw 30 in a state that the large-diameter portion 33 is inserted into the fitting hole. Accordingly, the gear screw operating gear 13 is rotatable integrally with the gear screw 30 about the axis L. Furthermore, the gear screw operating gear 13 is movable relative to the gear screw 30 in the axis L direction. Here, the large-diameter portion 33 of the gear screw 30 and the gear screw operating gear 13 constitute a gear screw operating mechanism (an operating mechanism) 35 configured to rotate the gear screw 30 by external operation. The gear screw operating gear 13 is an operating member for rotating the gear screw 30 by external operation.

As illustrated in FIG. 3, the outer circumferential side of the gear screw operating gear 13 is positioned between the disk part 7 of the shank head 5 and the flange 16 of the sleeve 6. The outer circumferential side of the rear end surface of the gear screw operating gear 13 is in contact with the disk part 7 of the shank head 5 via the first O-ring 25. Furthermore, the outer circumferential side of the front end surface of the gear screw operating gear 13 is in contact with the flange 16 of the sleeve 6 via the second O-ring 27.

The gear screw holding gear 32 of the gear screw 30 is inserted into the circular recess part 23. Here, as illustrated in FIG. 3, a metal ball 41 and a coil spring 42 are disposed inside each of the through holes 9 provided in the disk part 7, in order from the inner circumferential side toward the outer circumferential side. Furthermore, a threaded part is provided in the inner circumferential surface on the outer circumferential side of each of the through holes 9, and the biasing screw 10 is screwed into this threaded part from the outer circumferential side. The ball 41 is pressed against the gear screw holding gear 32 by the biasing force (restoring force) of the coil spring 42 compressed by the screwed biasing screw 10. With this configuration, the gear screw 30 is in a state of not accidentally rotating about the axis L.

The small-diameter portion 31 of the gear screw 30 is inserted into the shank 2*a*. A coil spring 45 is disposed between the annular screw 22 held in the head center hole 21 and the rear end surface of the small-diameter portion 31 of the gear screw 30.

The coil spring 45 supports the gear screw 30 at a first position 30A, illustrated in FIG. 3, in the axis L direction. The first position 30A is a position in which a gap is formed between the bottom of the circular recess part 23 and the rear end surface of the gear screw holding gear 32. Here, the gear screw 30 is movable between the first position 30A and a second position 30B spaced backward from the first position 30A in the axis L direction. The second position 30B, indicated by a dotted line in FIG. 3, is a position in which the rear end surface of the gear screw holding gear 32 comes into contact with the bottom of the circular recess part 23. When the gear screw 30 moves backward from the first position 30A, the coil spring 45 is compressed to provide biasing force that biases the gear screw 30 forward in the axis L direction (a direction toward the first position 30A).

The front end of the gear screw 30, that is, the front end of the bolt portion 34 is positioned backward of a front end opening 6*a* of the sleeve 6. The front end side of the nut 36 screwed onto the bolt portion 34 is connected to the brush-shaped grinding stone 4.

As illustrated in FIG. 4, the nut 36 includes, from the rear toward the front: a large-diameter tubular portion 51; and a small-diameter tubular portion 52 having a diameter smaller than that of the large-diameter tubular portion 51. The outer diameter of the large diameter tubular portion 51 corresponds to the inner diameter of the sleeve 6, and, in a state of being movable inside the sleeve 6 in the axis L direction, the nut 36 is inserted into the sleeve 6. In the inner circumferential surface of the large-diameter tubular portion 51, a female thread 51*a* screwed onto the bolt portion 34 is formed. In the small-diameter tubular portion 52 of the nut 36, two nut-side threaded holes 53 perpendicular to the axis L and penetrating in the radial direction are formed. The two nut-side threaded holes 53 are formed in 180-degree rotational symmetry about the axis L.

(Brush-Shaped Grinding Stone)

As illustrated in FIG. 2, the brush-shaped grinding stone 4 includes: the linear grinding members 3; and an annular grinding member holder 61 that holds the rear end portions of the linear grinding members 3 in a bundle. The grinding member holder 61 is coaxially connected to the nut 36, whereby the brush-shaped grinding stone 4 is held by the tool holder 2. As illustrated in FIG. 3, the brush-shaped grinding stone 4 is held by the tool holder 2 in a state that the grinding member holder 61 is positioned inside the sleeve 6, the front end portions of the linear grinding members 3 protrude from the front end opening 6*a* of the sleeve 6, and the brush-shaped grinding stone 4 is movable coaxially with the nut 36 in the axis L direction.

The grinding member holder 61 has the same outer diameter as that of the large-diameter tubular portion 51 of the nut 36. As illustrated in FIG. 4, the grinding member holder 61 includes: an annular holder body part 62 including a spindle hole 62*a* that the bolt portion 34 of the gear screw 30 can penetrate; and a nut connecting part (a connecting part) 63 formed of an annular wall extending backward from the outer circumferential edge of the holder body part 62. The height of the nut connecting part 63 in the axis L direction corresponds to the height of the small-diameter tubular portion 52 of the nut 36, and the inner diameter of the nut connecting part 63 corresponds to the outer diameter of the small-diameter tubular portion 52. Accordingly, the small-diameter tubular portion 52 of the nut 36 is fitted into a recess part formed on the inner circumferential side of the nut connecting part 63. Furthermore, the nut connecting part 63 is provided with two holder-side through holes 64 perpendicular to the axis L and penetrating in the radial direction. The two holder-side through holes 64 are formed in 180-degree rotational symmetry about the axis L.

The linear grinding members 3 are obtained by impregnating aggregate yarn of inorganic filaments, such as aluminum filaments, with a binder resin, and curing the resultant. Here, in the front face of the holder body part 62, a plurality of linear grinding member holding holes 66 is formed to be spaced from each other in the circumference of the spindle hole 62*a*. The plurality of the linear grinding member holding holes 66 are annularly arranged at equiangular intervals so as to surround the spindle hole 62*a*. Bundles of a plurality of the linear grinding members 3 each are formed, and the rear end of the bundle is inserted into the linear grinding member holding hole 66, and fixed to the grinding member holder 61 with an adhesive.

At the time of making the brush-shaped grinding stone 4 held by the tool holder 2, first, the nut 36 is screwed onto the bolt portion 34 of the gear screw 30 and disposed inside the sleeve 6. Next, the brush-shaped grinding stone 4 is inserted into the sleeve 6 from the grinding member holder 61 side, and the small-diameter tubular portion 52 of the nut 36 is fitted into the recess part formed on the inner circumferential side of the nut connecting part 63. Thereafter, the connecting screw 18 is made to penetrate each of the guide holes 17 from the outer circumferential side of the sleeve 6, and furthermore, made to penetrate the holder-side through hole 64 and screwed into the nut-side threaded hole 53. With this configuration, the grinding member holder 61 is connected to the nut 36 inside the sleeve 6.

Here, in a state that the connecting screw 18 penetrates the guide hole 17 and the holder-side through hole 64 and is screwed into a nut-side threaded hole 53, a head part 18*a* of the connecting screw 18 (an end portion on the outer circumferential side of the connecting screw 18) is positioned inside the guide hole 17. Accordingly, if the nut 36 is about to rotate about the axis L, the head part 18*a* of each of the connecting screws 18 comes into contact with the inner circumferential wall of the guide hole 17 from the circumferential direction, thereby preventing the rotation. That is, the two guide holes 17 and the two connecting screws 18 that each connect the nut 36 to the grinding member holder 61 constitute a nut rotation regulating mechanism 71 configured to regulate the rotation of the nut 36 about the axis L. The nut rotation regulating mechanism 71 allows the movement of the nut 36 in the axis L direction.

(Adjustment Operation of the Protruding Amount of Grinding Members)

Figure 5:
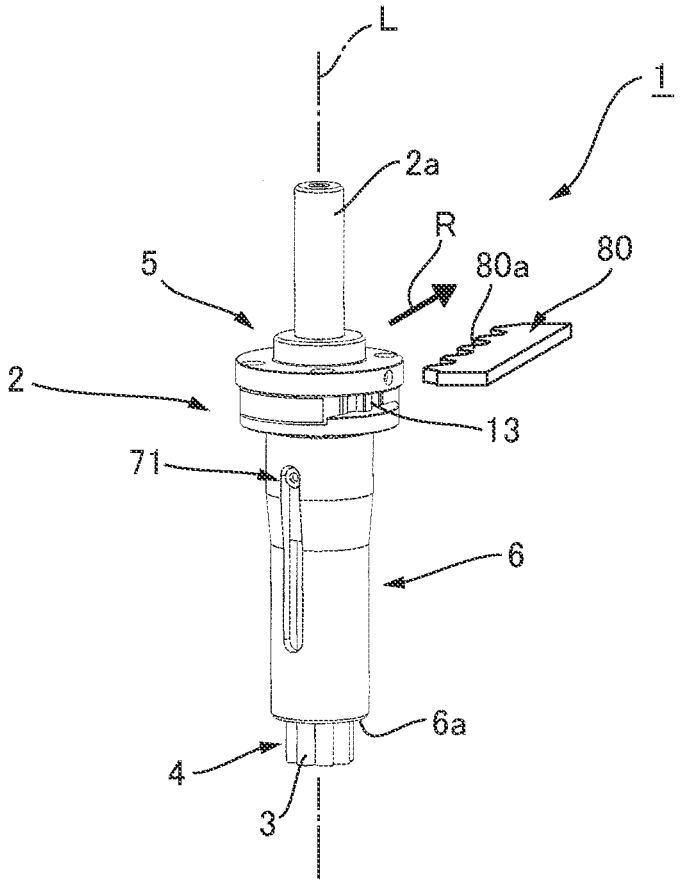
FIG. 5 is an illustration of an adjustment operation of adjusting the protruding amount of grinding members in the polishing tool unit illustrated in FIG. 1.

FIG. 5 is an illustration of an adjustment operation of adjusting the protruding amount of the grinding members of the brush-shaped grinding stone 4 from the tool holder 2. In the polishing tool unit 1, the shank 2*a* is connected to a head of a machining center via, for example, a tool holder (not illustrated). Polishing, such as deburring or surface finishing, for a workpiece is performed by rotational-driving the polishing tool unit 1 connected to the head about the axis L. The position of the polishing tool unit 1 connected to the head is controlled by a control program configured to perform the drive-control of the machining center.

Here, when the wear amount of the linear grinding members 3 reaches a predetermined wear amount, the machining center is driven by the control program to move the polishing tool unit 1 to a position for adjusting the protruding amount of the grinding members, in which the rack gear 80 is disposed. The rack gear 80 includes a gear tooth part 80*a* capable of being engaged with the gear screw operating gear 13.

Next, an extension direction R of the gear tooth part 80*a* of the rack gear 80 and the axis L of the polishing tool unit 1 are made to intersect at right angles, and a gear tooth part of the gear screw operating gear 13 is made to be engaged with the gear tooth part 80*a* of the rack gear 80. Thereafter, the polishing tool unit 1 is moved in the extension direction R of the gear tooth part 80*a*. With this, the gear screw operating gear 13 is rotated only by a predetermined rotation amount. Note that, instead of moving the polishing tool unit 1 in the extension direction R, the rack gear 80 may be moved in the extension direction R to rotate the gear screw operating gear 13 only by a predetermined rotation amount. Furthermore, the gear screw operating gear 13 may be rotated only by a predetermined rotation amount by moving both the polishing tool unit 1 and the rack gear 80 and thereby causing a relative movement between the polishing tool unit 1 and the rack gear 80 in the extension direction R.

When the gear screw operating gear 13 rotates, the gear screw 30 rotates integrally with the gear screw operating gear 13. Here, rotation of the nut 36 about the axis L is regulated by the nut rotation regulating mechanism 71. Accordingly, the nut 36 moves in the axis L direction with rotation of the gear screw 30, whereby the brush-shaped grinding stone 4 is moved in the axis L direction. Thus, the linear grinding members 3 can protrude from the front end opening 6*a* of the sleeve 6 only by a movement amount corresponding to the rotation amount of the gear screw operating gear 13.

Note that, when the direction of the relative movement between the polishing tool unit 1 and the rack gear 80 is made into the opposite direction, the linear grinding members 3 can be returned inside the front end opening 6*a* of the sleeve 6 only by a movement amount corresponding to the rotation amount of the gear screw operating gear 13.

Advantageous Effects

According to the present embodiment, the grinding member protruding amount of the linear grinding members 3 in the polishing tool unit 1 can be adjusted by rotating the gear screw operating gear 13 exposed outside from between the shank 2*a* and the sleeve 6. Thus, the protruding amount of the grinding members can be easily adjusted. Furthermore, the brush-shaped grinding stone 4 is connected to the nut 36, and the movement amount of the nut 36 in the axis L direction is precisely regulated by the angle of rotation of the gear screw 30. Accordingly, the protruding amount of the grinding members can be adjusted with high accuracy.

In the present embodiment, the gear screw 30 is movable between the first position 30A and the second position 30B, and supported at the first position 30A in the front by the coil spring 45. Accordingly, when the force of pushing the brush-shaped grinding stone 4 into the sleeve 6 from the process-target workpiece side works during processing operation, the brush-shaped grinding stone 4 is moved backward in the axis L direction, whereby breakage of the brush-shaped grinding stone 4 and wear of the grinding members can be reduced. That is, when the force of pushing the brush-shaped grinding stone 4 toward the tool holder 2 side works during processing operation, the force is conveyed to the gear screw 30 via the nut 36. Accordingly, the gear screw 30 moves backward in the axis L direction against the biasing force of the coil spring 45, whereby the force from the workpiece side is released.

Furthermore, in the present embodiment, the grinding member holder 61 includes the spindle hole 62*a* that is penetrated by the gear screw 30, with the grinding member holder 61 connected to the nut 36. Therefore, the grinding member holder 61 does not lean inside the sleeve 6 even if the dimensional tolerance between the outer diameter of the grinding member holder 61 and the inner diameter of the sleeve 6 is not strictly determined. Consequently, variance in the protruding amount of the grinding members does not occur. Furthermore, the gear screw 30 is inserted into the spindle hole 62*a* of the grinding member holder 61, and hence, even if the dimensional tolerance between the outer diameter of the grinding member holder 61 and the inner diameter of the sleeve 6 is not strictly determined, the center axis of the grinding member holder 61 can be easily made to coincide with the center axis of the sleeve 6. Hence, during processing by rotating the polishing tool unit 1, the occurrence of the swing of run-out of the brush-shaped grinding stone 4 can be reduced.

In the present embodiment, the grinding member holder 61 is disposed inside the sleeve 6, and a plurality of the linear grinding members 3 held by the grinding member holder 61 surrounds, about the axis L, the gear screw 30 penetrating the spindle hole 62*a* and extending. Accordingly, during processing by rotation of the polishing tool unit 1, even when the linear grinding members 3 are about to escape to the outer circumferential side, the linear grinding members 3 abut on the inner surface of the circumferential wall of the sleeve 6, so that the escape can be prevented, meanwhile, even when the linear grinding members 3 is about to escape to the inner circumferential side, the linear grinding members 3 abut on the outer circumferential surface of the gear screw 30, so that the escape can be prevented. This leads to no difference in ease of escape between the linear grinding members 3 positioned on the outer circumferential side and the linear grinding members 3 positioned on the inner circumferential side. As a result, no difference in rigidity is made between the linear grinding members 3 positioned on the outer circumferential side and the linear grinding members 3 positioned on the inner circumferential side, and consequently, a situation can be avoided in which the linear grinding members 3 positioned on the inner circumferential side is less worn than the linear grinding members 3 positioned on the outer circumferential side, and thus, the linear grinding members 3 are uniformly worn.

Furthermore, in the present embodiment, rotation of the nut 36 can be regulated by making use of the connecting screw 18 that connects the grinding member holder 61 to the nut 36. Thus, the number of parts can be reduced. In the present embodiment, the end portion of the connecting screw 18 is positioned inside the guide hole 17 extending in the axis L direction, and accordingly, the screw is allowed to move in the axis L direction, and thus, movement of the nut 36 in the axis L direction is not hindered by interference of the screw and the sleeve 6.

In the present invention, the head center hole 21 of the shank head 5 and the screw center hole 30*a* of the gear screw 30 are coaxially disposed and communicate with each other. Accordingly, machining oil and air can be supplied via the head center hole 21 and the screw center hole 30*a* to perform cooling, lubrication, and washing of a processed part.

Embodiment 2

Figure 6:
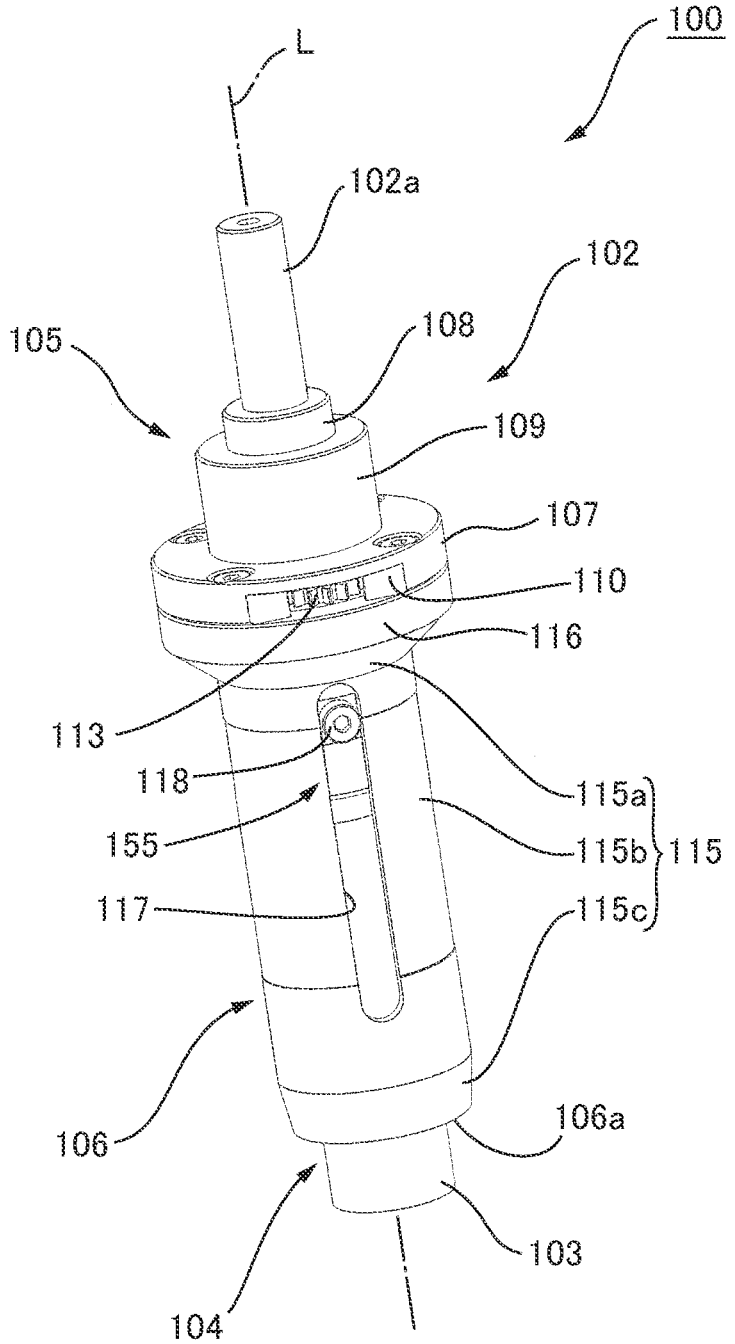
FIG. 6 is a perspective view of a polishing tool unit of Embodiment 2 to which the present invention is applied.

FIG. 6 is a perspective view of a polishing tool unit 100 of Embodiment 2 to which the present invention is applied. As illustrated in FIG. 6, the polishing tool unit 100 of the present embodiment includes: a tool holder 102 including a shank 102*a* serving as a part attached to a machine tool; and a brush-shaped grinding stone (a polishing tool) 104 including linear grinding members 103 protruding from the front end of the tool holder 102, the front end being on the opposite side of the tool holder 102 from the shank 102*a*.

(Tool Holder)

The tool holder 102 includes a shank head 105 and a sleeve 106 coaxially in the axis L direction in order from the shank 102*a* side. The shank head 105 includes the shank 102*a*, a disk part 107, and a first connecting disk part 108 and a second connecting disk part 109 that have a circular shape and connect between the disk part 107 and the shank 102*a*. The first connecting disk part 108 is provided between the second connecting disk part 109 and the shank 102*a*. The outer diameter of the first connecting disk part 108 is larger than the outer diameter of the shank 102*a*, and smaller than the outer diameter of the second connecting disk part 109. The length of the first connecting disk part 108 in the axis L direction is smaller than the length of the second connecting disk part 109. The outer diameter of the second connecting disk part 109 is smaller than the outer diameter of the disk part 107.

The disk part 107 is provided with two cut-out parts 110 cut from the outer circumferential side. The two cut-out parts 110 are provided in 180-degree rotational symmetry about the axis L. A second gear 113 that is housed in the shank head 105 is partially exposed outside from each of the cut-out parts 110.

The sleeve 106 includes a tube part 115 extending in the axis L direction, and an annular flange 116 spreading from the rear end of the tube part 115 toward the outer circumferential side. The flange 116 is formed coaxially with the tube part 115. The rear end surface of the flange 116 is in contact with the front end surface of the disk part 107 of the shank head 105. The outer diameter of the flange 116 is the same as the outer diameter of the disk part 107. The outer circumferential surface of the tube part 115 includes: a rear-side tapered outer circumferential surface portion 115*a* being continuous to the front side of the flange 116 and having an outer diameter becoming smaller toward the front; a constant-diameter outer circumferential surface portion 115*b* being continuous to the front end of the rear-side tapered outer circumferential surface portion 115*a* and extending forward with a constant outer diameter; and a front-side tapered outer circumferential surface portion 115*c* being continuous to the front end of the constant-diameter outer circumferential surface portion 115*b* and having an outer diameter becoming smaller toward the front. The tube part 115 is provided with two groove-shaped guide holes 117 in the constant-diameter outer circumferential surface portion 115*b*. The two guide holes 117 each extend in the axis L direction and are formed in 180-degree rotational symmetry about the axis L. A connecting screw 118 is positioned inside the guide hole 117.

Figure 7A:
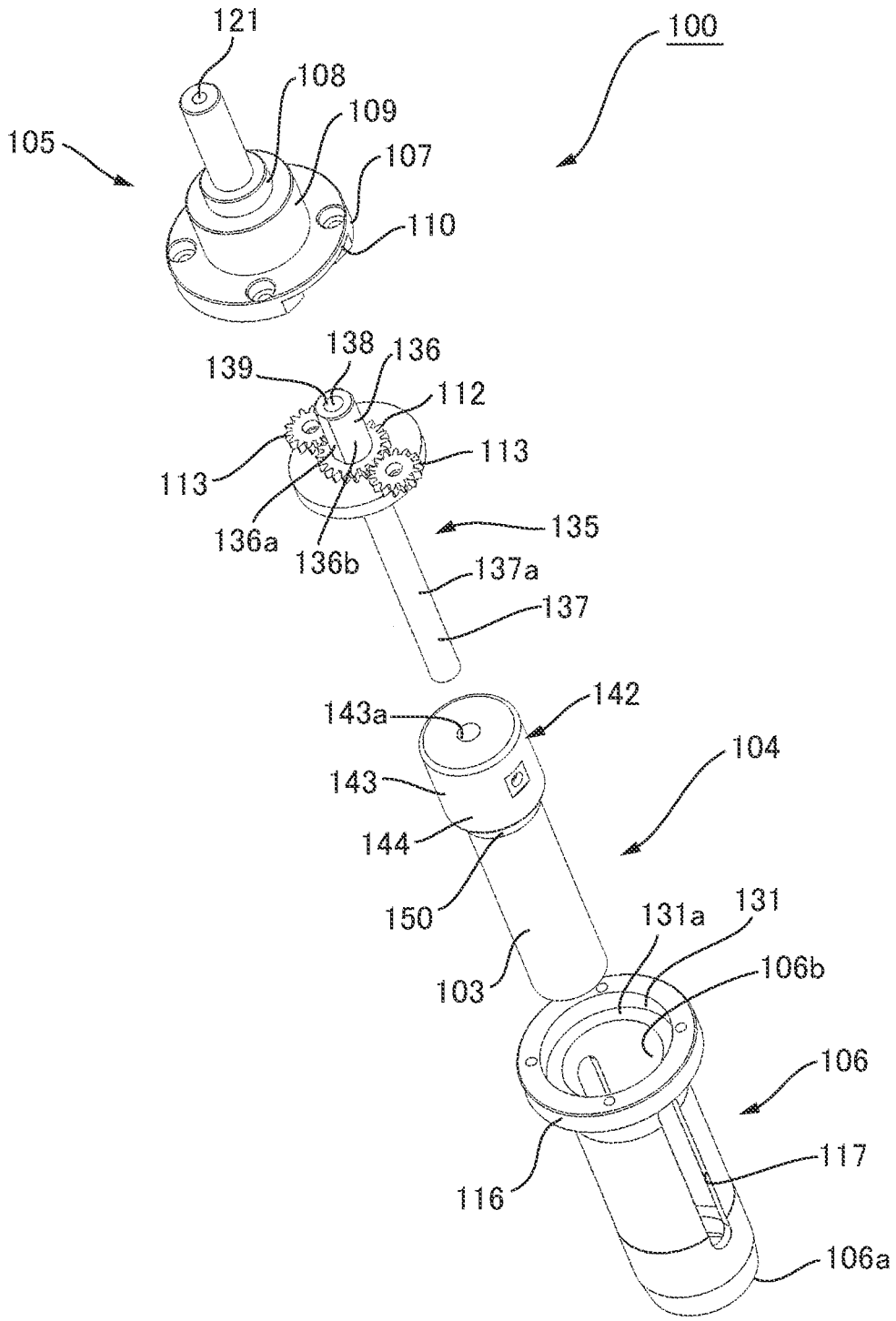
FIG. 7 is an exploded perspective view of the polishing tool unit illustrated in FIG. 6.
Figure 7B:
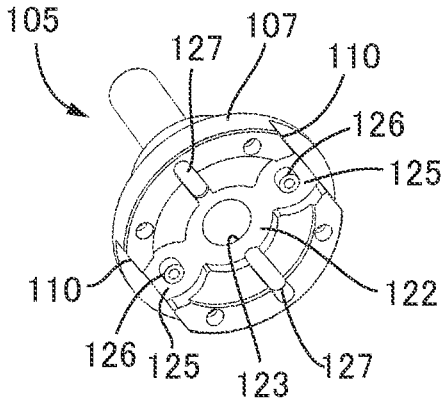
Figure 8:
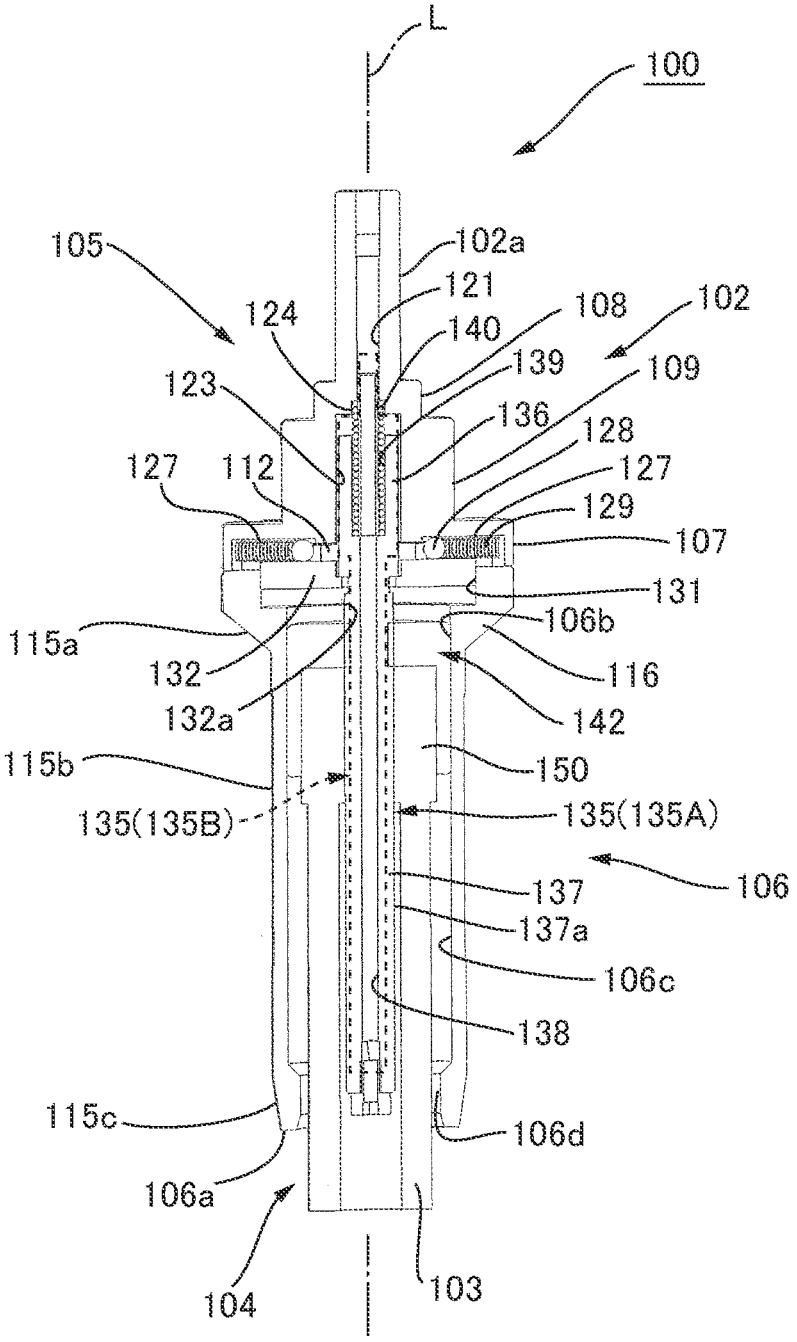
FIG. 8 is a first longitudinal sectional view of the polishing tool unit illustrated in FIG. 6.
Figure 9:
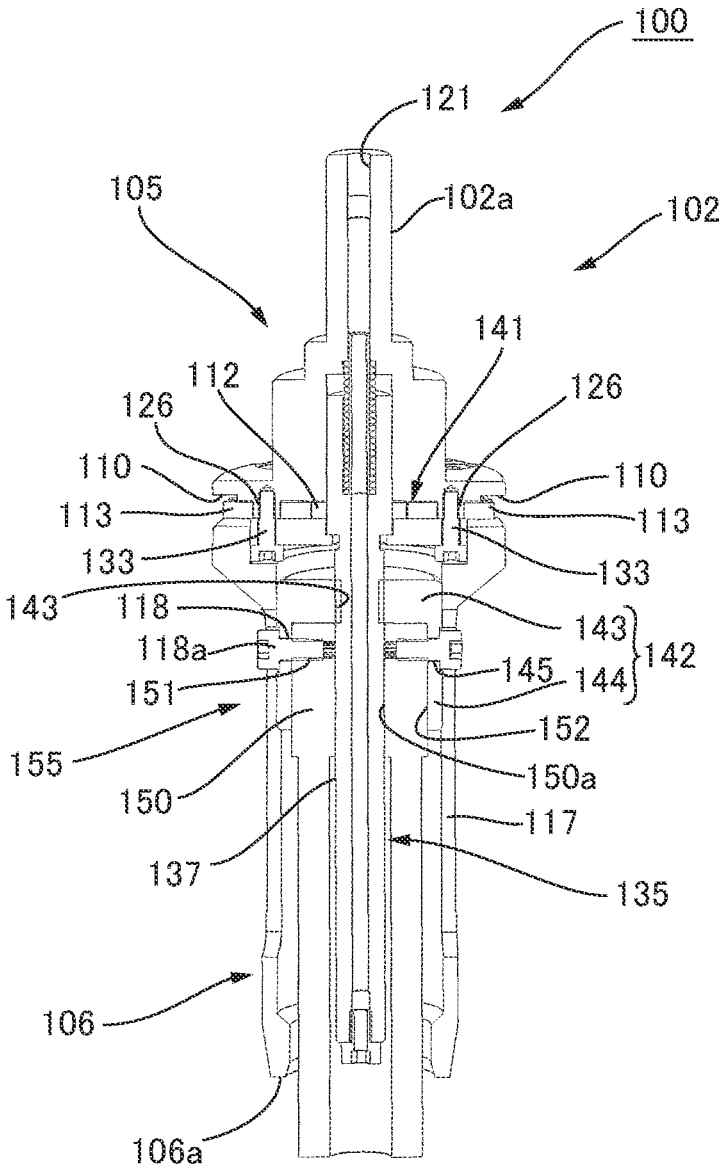
FIG. 9 is a second longitudinal sectional view of the polishing tool unit illustrated in FIG. 6.

FIG. 7(*a*) is an exploded perspective view of the polishing tool unit 100 illustrated in FIG. 6, and FIG. 7(*b*) is a perspective view of the shank head 105 viewed from the rear in the axis L direction. FIG. 8 is a first longitudinal sectional view of the polishing tool unit 100 illustrated in FIG. 6, the view being cut through a position not passing through the guide holes 117. FIG. 9 is a second longitudinal sectional view of the polishing tool unit 100 illustrated in FIG. 6, the view being cut through a position passing through the guide holes 117. As illustrated in FIG. 8, the shank head 105 is provided with a head center hole 121 that penetrates the shank 102*a*, the first connecting disk part 108, the second connecting disk part 109, and the disk part 107 in the axis L direction. As illustrated in FIG. 7(*b*), a first circular recess part 122 that is coaxial with the disk part 107 and recessed backward is formed in the center portion of the front end surface of the disk part 107. As illustrated in FIG. 8, a large-diameter recess part 123, and a small-diameter recess part 124 having an inner diameter smaller than that of the large-diameter recess part 123 are formed coaxially with the disk part 107 in the center portion of the first circular recess part 122. The bottom of the large-diameter recess part 123 is positioned between the first connecting disk part 108 and the second connecting disk part 109, meanwhile the bottom of the small-diameter recess part 124 is positioned in the first connecting disk part 108. The front end opening of the head center hole 121 is formed at the center of the bottom of the small-diameter recess part 124.

In the front end surface of the disk part 107, a pair of second circular recess parts 125 is formed on both sides of the first circular recess part 122, as illustrated in FIG. 7(*b*). The pair of the second circular recess parts 125 is formed in 180-degree rotational symmetry about the axis L. The pair of the second circular recess parts 125 each includes a spindle 126 protruding forward, in the center portion. The disk part 107 includes the cut-out portions 110 cut from the outer circumferential side of the front end portion of the disk part 107 and communicating with the pair of the second circular recess parts 125. The two cut-out portions 110 are formed in 180-degree rotational symmetry about the axis L. Between the pair of the second circular recess parts 125, a pair of groove parts 127 is formed on both sides of the first circular recess part 122. The pair of the second circular recess parts 125 is provided so as to be spaced from the pair of the groove parts 127 at an angle of 90 degrees about the axis L. The inner circumferential ends of the pair of the groove parts 127 communicate with the first circular recess part 122.

As illustrated in FIG. 7 and FIG. 9, a first gear 112 is housed in the first circular recess part 122. The second gear 113 having a diameter smaller than that of the first gear 112 is housed in each of the pair of the second circular recess parts 125. Each of the second gears 113 is rotatably supported by a corresponding one of the spindles 126. Each of the second gears 113 is engaged with the first gear 112. Each of the second gears 113 is partially exposed outside from a corresponding one of the two cut-out parts 110 of the disk part 107.

In each of the pair of the groove parts 127 provided on both sides of the first circular recess part 122, a metal ball 128 and a coil spring 129 are disposed in order from the inner circumferential side toward the outer circumferential side as illustrated in FIG. 8. The ball 128 is pressed against the first gear 112 by the biasing force of the coil spring 129.

As illustrated in FIG. 8, the sleeve 106 includes a sleeve-side circular recess part 131 in the rear end surface of the flange 116, the sleeve-side circular recess part 131 being coaxial with a center hole 106*b* of the sleeve 106 and recessed forward. The inner diameter of the sleeve-side circular recess part 131 is larger than the inner diameter of the center hole 106*b*. Accordingly, as illustrated in FIG. 7, the bottom of the sleeve-side circular recess part 131 is an annular surface 131*a* facing backward. As illustrated in FIG. 8, an annular plate 132 including a spindle hole 132*a* is inserted into the sleeve-side circular recess part 131. As illustrated in FIG. 9, the annular plate 132 is fixed to the shank head 105 with two headed screws 133. The two headed screws 133 penetrate the annular plate 132 from the front to the rear, and are screwed into a threaded hole coaxially provided in the spindle 126 of the second circular recess part 125. The first gear 112 and the pair of the second gears 113 are positioned between the shank head 105 and the annular plate 132.

Here, as illustrated in FIG. 8, the sleeve 106 includes the tapered outer circumferential rear-side surface 115*a*, and a constant-diameter inner circumferential surface 106*c* with a constant inner diameter in a region in which the rear-side tapered outer circumferential surface portion 115*a* is formed. The sleeve 106 further includes a small-diameter inner circumferential surface portion 106*d* having an inner diameter smaller than that of the constant-diameter inner circumferential surface portion 106*c* in a region in which the front-side tapered outer circumferential surface portion 115*c* is formed.

As illustrated in FIG. 8 and FIG. 9, a gear screw (a shaft) 135 is disposed coaxially with the shank head 105 and the sleeve 106 on the inner circumferential side of the shank head 105 and the sleeve 106. The gear screw 135 includes, from the rear toward the front: a large-diameter portion 136; and a bolt portion 137 having a diameter smaller than that of the large-diameter portion 136. The bolt portion 137 includes a male thread 137*a* in the outer circumferential surface. In the gear screw 135, most of the large-diameter portion 136 is positioned inside the shank head 105, meanwhile, the bolt portion 137 is positioned inside the sleeve 106. The gear screw 135 includes a screw center hole 138 that penetrates in the axis L direction. A nut 142 is screwed onto the bolt portion 137.

As illustrated in FIG. 7, the gear screw 135 includes, in the outer circumferential surface of the large-diameter portion 136: a pair of parallel surfaces 136*a* extending in parallel with the axis L on both sides of the axis L; and a pair of arc-shaped surfaces 136*b* arranged between the pair of the parallel surfaces 136*a* and being continuous to the parallel surfaces 136*a* in the circumferential direction. The first gear 112 is coaxially attached to the large-diameter portion 136.

The first gear 112 includes a fitting hole which has an elliptical plane shape and into which the large-diameter portion 136 is fitted when the fitting hole is viewed from the axis L direction, and the first gear 112 is attached to the gear screw 135 in a state that the large-diameter portion 136 is inserted in this fitting hole. Accordingly, the first gear 112 is rotatable integrally with the gear screw 135. Furthermore, the first gear 112 is movable relative to the gear screw 135 in the axis L direction. Here, as illustrated in FIG. 9, the first gear 112 attached to the large-diameter portion 136 and each of the second gears 113 engaged with the first gear 112 constitute a gear screw operating mechanism (an operating mechanism) 141 configured to rotate the gear screw 135 by external operation. Each of the second gears 113 is an operating member for rotating the gear screw 135. Furthermore, as illustrated in FIG. 8, the ball 128 housed in the groove part 127 in the front end surface of the shank head 105 is pressed against the first gear 112 by the biasing force of the coil spring 129. With this configuration, the gear screw 135 is in a state of not accidentally rotating about the axis L.

The gear screw 135 includes a recess part 139 recessed forward in the rear end surface of the large-diameter portion 136. The coil spring 140 is disposed inside the recess part 139. The front end portion of the coil spring 140 comes into contact with the bottom (the front end surface) of the recess part 139, meanwhile, the rear end portion of the coil spring 140 comes into contact with the bottom (the rear end surface) of the small-diameter recess part 124 of the shank head 105.

The coil spring 140 supports the gear screw 135 at a first position 135A in the axis L direction illustrated in FIG. 8. The first position 135A is a position in which a gap is formed between the bottom of the large-diameter recess part 123 of the shank head 105 and the rear end surface (the large-diameter portion 136) of the gear screw 135. Here, the gear screw 135 is movable between the first position 135A and a second position 135B spaced backward from the first position 135A in the axis L direction. The second position 135B is a position in which the rear end surface of the large-diameter portion 136 comes into contact with the bottom of the large-diameter recess part 123. When the gear screw 135 moves backward from the first position 135A, the coil spring 140 is compressed to provide biasing force that biases the gear screw 135 forward in the axis L direction (a direction toward the first position 135A).

The front end of the gear screw 135, that is, the front end of the bolt portion 137 is positioned backward of a front end opening 106*a* of the sleeve 106. The front end side of the nut 142 screwed onto the bolt portion 137 is connected to the brush-shaped grinding stone 104.

As illustrated in FIG. 9, the nut 142 includes, from the rear toward the front in the axis L direction, an annular nut body part 143 and a holder connecting part (a connecting part) 144. The holder connecting part 144 is formed of an annular wall protruding forward from the outer circumferential edge of the front end of the nut body part 143. The outer diameters of the nut body part 143 and the holder connecting part 144 each correspond to the inner diameter of the constant-diameter inner circumferential surface 106*c* of the sleeve 106, and, in a state of being movable inside the sleeve 106 in the axis L direction, the nut 142 is fitted into the sleeve 106. In the inner circumferential surface of the nut body part 143, a female thread 143*a* screwed onto the bolt portion 137 is formed. In the holder connecting part 144, two nut-side through holes 145 perpendicular to the axis L and penetrating in the radial direction are formed. The two nut-side through holes 145 are formed in 180-degree rotational symmetry about the axis L.

(Brush-Shaped Grinding Stone)

The brush-shaped grinding stone 104 includes: linear grinding members 103; and an annular grinding member holder 150 that holds the rear end portions of the linear grinding members 103 in a bundle. The grinding member holder 150 is coaxially connected to the nut 142, whereby the brush-shaped grinding stone 104 is held by the tool holder 102. As illustrated in FIG. 8, the brush-shaped grinding stone 104 is held by the tool holder 102 in a state that the grinding member holder 150 is positioned inside the sleeve 106, the front end portions of the linear grinding members 103 protrude from the front end opening 106*a* of the sleeve 106, and the brush-shaped grinding stone 104 is movable integrally with the nut 142 in the axis L direction.

As illustrated in FIG. 9, the grinding member holder 150 has an annular shape and includes a spindle hole 150*a*. Furthermore, the grinding member holder 150 has an outer diameter allowing the grinding member holder 150 to be fitted to the holder connecting part 144 of the nut 142. The outer diameter of the grinding member holder 150 is smaller than the inner diameter of the small-diameter inner circumferential surface portion 106*d* of the sleeve 106. Furthermore, the grinding member holder 150 is provided with two holder-side through holes 151 perpendicular to the axis L and penetrating in the radial direction. The two holder-side through holes 151 are formed in 180-degree rotational symmetry about the axis L.

The linear grinding members 103 are obtained by impregnating aggregate yarn of inorganic filaments, such as aluminum filaments, with a binder resin, and curing the resultant. Here, in the front face of the grinding member holder 150, a linear grinding member holding hole 152 having an annular shape is formed in the circumference of the spindle hole 150*a*. The linear grinding members 103 are annularly arranged and bundled, and the rear ends of the bundled linear grinding members 103 are inserted into the linear grinding member holding hole 152, and fixed to the grinding member holder 150 with an adhesive.

At the time of making the brush-shaped grinding stone 104 held by the tool holder 102, first, the nut 142 is screwed onto the bolt portion 137 of the gear screw 135 and disposed inside the sleeve 106. Next, the brush-shaped grinding stone 104 is inserted into the sleeve 106 from the grinding member holder 150 side, and the grinding member holder 150 is inserted into the holder connecting part 144. Thereafter, the connecting screw 118 is screwed into the holder-side threaded hole 151 via each of the guide holes 117 of the sleeve 106 and each of the nut-side through holes 145, whereby the grinding member holder 150 and the nut 142 are connected inside the sleeve 106.

Here, in a state that each of the connecting screws 118 is screwed into a corresponding one of the holder-side threaded holes 151 via a corresponding one of the guide holes 117 and a corresponding one of the nut-side through holes 145, a head section 118*a* of the connecting screw 118 (the outer circumferential-side end portion of the connecting screw 118) is positioned inside the guide hole 117. Accordingly, if the nut 142 is about to rotate about the axis L, the head section 118*a* of each of the connecting screws 118 comes into contact with the inner circumferential wall of a corresponding one of the guide holes 117 from the circumferential direction, thereby preventing the rotation. That is, the two guide holes 117 and the two connecting screws 118 that connect the nut 142 to the grinding member holder 150 constitute a nut rotation regulating mechanism 155 configured to regulate rotation of the nut 142 about the axis L. The nut rotation regulating mechanism 155 allows movement of the nut 142 in the axis L direction.

(Adjustment Operation of the Protruding Amount of Grinding Members)

In the polishing tool unit 100, the shank 102*a* is connected to a head of a machining center via, for example, a tool holder (not illustrated). When the wear amount of the linear grinding members 103 reaches a predetermined wear amount, the machining center is driven by a control program to move the polishing tool unit 100 to a position for adjusting the protruding amount of the grinding members, in which the rack gear 80 is disposed. Then, as is the case illustrated in FIG. 5, the gear tooth part of the second gear 113 is engaged with the gear tooth part 80*a* of the rack gear 80, and the polishing tool unit 100 is made to move relative to the rack gear 80 in the extension direction R of the gear tooth part 80*a*. With this, the second gear 113 is rotated by a predetermined rotation amount.

When the second gear 113 rotates, the first gear 112 rotates, whereby the gear screw 135 rotates. Here, rotation of the nut 142 about the axis L is regulated by the nut rotation regulating mechanism 155. Accordingly, the nut 142 moves in the axis L direction with rotation of the gear screw 135, whereby the brush-shaped grinding stone 104 is moved in the axis L direction. Thus, the linear grinding member 103 can be made to protrude from the front end opening 106*a* of the sleeve 106 by a movement amount corresponding to the rotation amount of the first gear 112. Note that, when the direction of the relative movement between the polishing tool unit 100 and the rack gear 80 is made into the opposite direction, the linear grinding member 103 can be returned inside the front end opening 106*a* of the sleeve 106 by a movement amount corresponding to the rotation amount of the first gear 112.

Also in the present embodiment, the same advantageous effects as in the polishing tool unit 1 of Embodiment 1 can be achieved.

Furthermore, in the present embodiment, the first gear 112 disposed coaxially with the gear screw 135 is engaged with the second gear 113, whereby the inertia of the first gear 112 that is about to rotate integrally with the gear screw 135 can be reduced. Here, when the inertia acting on the first gear 112 is made smaller, it can be prevented that, at the time of the start and stop of rotation of the polishing tool unit 100, the first gear 112 and the gear screw 135 rotate due to the inertia acting on the first gear 112, whereby the nut 142 moves, and the protruding amount of the grinding members is changed.

Furthermore, in the present embodiment, the grinding member holder 150 can be connected to the nut 142 by just forming the holder-side threaded hole 151 in the grinding member holder 150 of the brush-shaped grinding stone 104. This allows the brush-shaped grinding stone 104 to be simpler, and accordingly, the cost of manufacture of the brush-shaped grinding stone 104 serving as consumable goods can be reduced.

Modification of Embodiment 2

Figure 10:
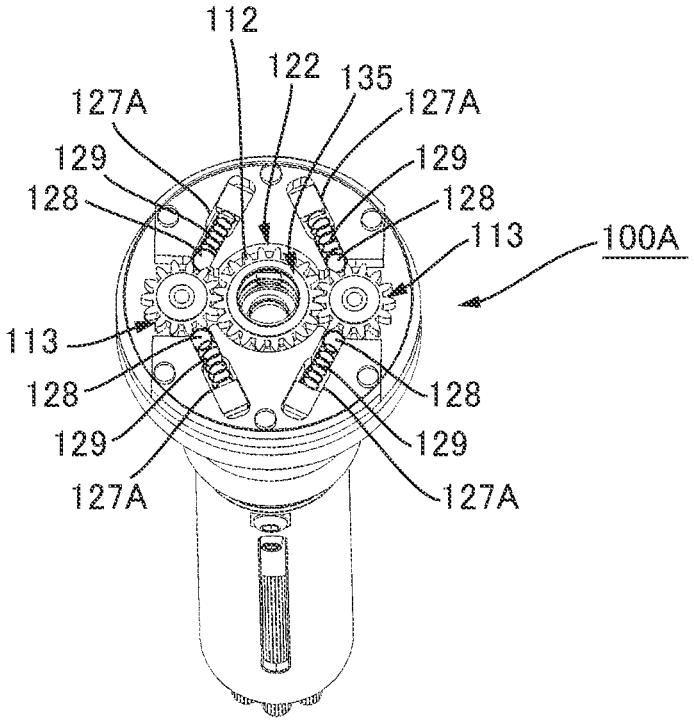
FIG. 10 is an illustration of a polishing tool unit of a modification of Embodiment 2.

In the above-described embodiment, for the purpose of preventing the accidental rotation of the gear screw 135, a mechanism configured to reduce rotation of the first gear 112 is incorporated. That is, a pair of the groove parts 127 is provided on both sides of the first circular recess part 122 of the disk part 107; the ball 128 and the coil spring 129 are disposed in each of the groove parts 127; and the ball 128 is pressed against the first gear 112 by the biasing force of the coil spring 129 to reduce rotation of the first gear 112. In place of such mechanism, a mechanism configured to reduce rotation of the second gear 113 engaged with the first gear 112 is incorporated, whereby accidental rotation of the gear screw 135 can be reduced. FIG. 10 is an illustration of a polishing tool unit of a modification of Embodiment 2 in which the mechanism configured to reduce rotation of the second gear 113 is incorporated. FIG. 10 is a cross sectional view obtained by cutting the polishing tool unit in a direction perpendicular to the axis L at a point at which the first gear 112 and the second gear 113 are positioned. Note that a polishing tool unit 100A of present embodiment has the same configuration, except the mechanism configured to reduce rotation of the second gear 113, as that of the polishing tool unit 100 of Embodiment 2.

As illustrated in FIG. 10, in the polishing tool unit 100A of the present embodiment, a pair of groove parts 127A is provided on both sides of the second circular recess part 125 in which the second gear 113 is disposed. The ball 128 and the coil spring 129 are disposed at each of the groove parts 127A. The coil spring 129 is compressed inside the groove part 127A, and the ball 128 is pressed against the second gear 113 by the biasing force of the coil spring 129. This reduces rotation of the second gear 113, thereby reducing rotation of the first gear 112, and thus, accidental rotation of the gear screw 135 about the axis L is prevented.

Note that the polishing tool unit 100 of Embodiment 2 and the polishing tool unit 100A of the modification of Embodiment 2 each include two gears as the second gear 113, but, the number of the second gears 113 may be one.

Embodiment 3

Figure 11:
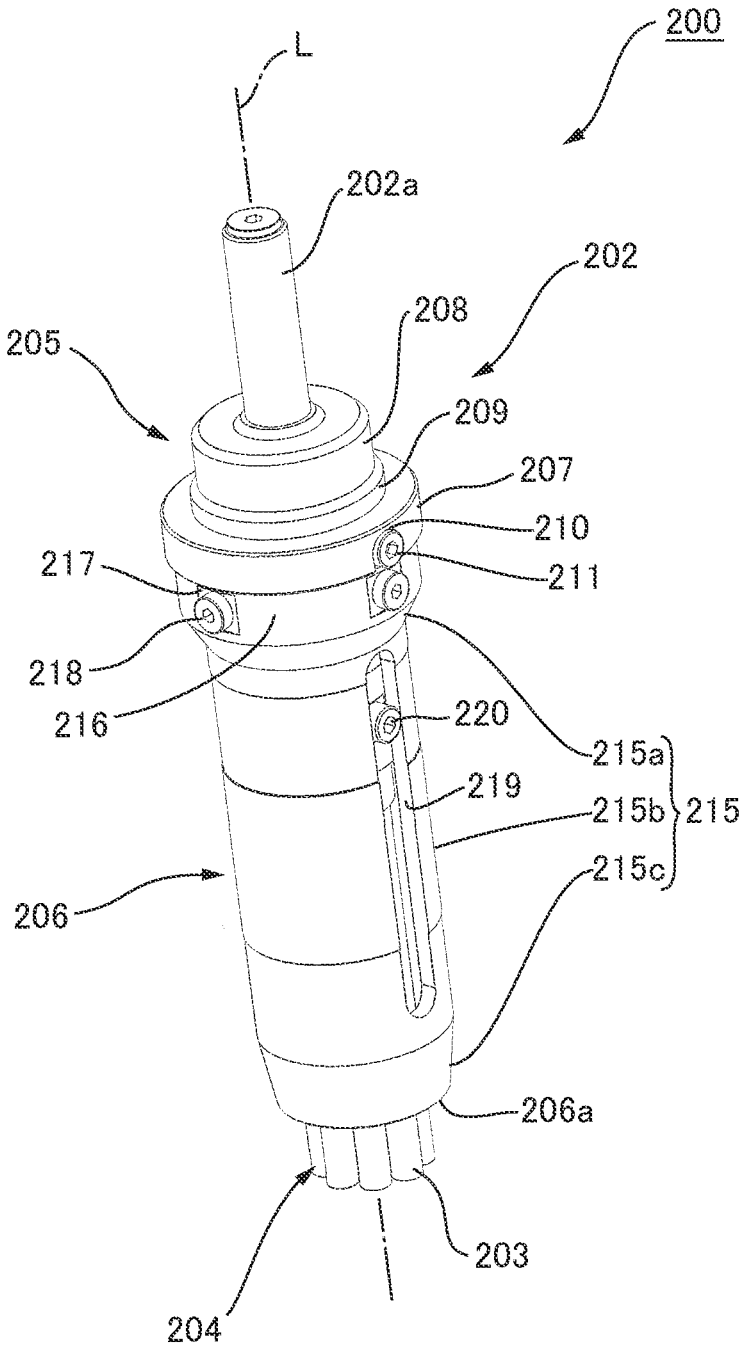
FIG. 11 is a perspective view of a polishing tool unit of Embodiment 3 to which the present invention is applied.

FIG. 11 is a perspective view of a polishing tool unit 200 of Embodiment 3 to which the present invention is applied. As illustrated in FIG. 11, the polishing tool unit 200 of the present embodiment includes: a tool holder 202 including a shank 202*a* serving as a part attached to a machine tool; and a brush-shaped grinding stone (a polishing tool) 204 including linear grinding members 203 protruding from the front end of the tool holder 202, the front end being on the opposite side of the tool holder 202 from the shank 202*a*.

(Tool Holder)

The tool holder 202 includes a shank head 205 and a sleeve 206 coaxially in the axis L direction in order from the shank 202*a* side. The shank head 205 includes the shank 202*a*, a disk part 207, and a first connecting disk part 208 and a second connecting disk part 209 that connect between the disk part 207 and the shank 202*a*. The first connecting disk part 208 is provided between the second connecting disk part 209 and the shank 202*a*. The outer diameter of the first connecting disk part 208 is larger than the outer diameter of the shank 202*a*, and smaller than the outer diameter of the second connecting disk part 209. The length of the first connecting disk part 208 in the axis L direction is larger than the length of the second connecting disk part 209. The outer diameter of the second connecting disk part 209 is smaller than the outer diameter of the disk part 207.

The disk part 207 is provided with two threaded holes 210 extending in the radial direction. The two threaded holes 210 are formed in 180-degree rotational symmetry about the axis L. A cam pin 211 including a threaded part is screwed into each of the threaded holes 210.

The sleeve 206 includes a tube part 215 extending in the axis L direction, and an annular flange 216 spreading from the rear end of the tube part 215 toward the outer circumferential side. The flange 216 is formed coaxially with the tube part 215. The rear end surface of the flange 216 is in contact with the front end surface of the disk part 207 of the shank head 205. The outer diameter of the flange 216 is slightly smaller than the outer diameter of the disk part 207. The flange 216 is provided with four sleeve-side threaded holes 217 extending in the radial direction. The four sleeve-side threaded holes 217 are formed in 90-degree rotational symmetry about the axis L. A shank head fixing screw 218 is screwed into each of the sleeve-side threaded holes 217.

The outer circumferential surface of the tube part 215 includes: a rear-side tapered outer circumferential surface portion 215*a* being continuous to the front end of the flange 216 and having an outer diameter becoming smaller toward the front; a constant-diameter outer circumferential surface portion 215*b* being continuous to the front end of the rear-side tapered outer circumferential surface portion 215*a* and extending forward with a constant outer diameter; and a front-side tapered outer circumferential surface portion 215*c* being continuous to the front end of the constant-diameter outer circumferential surface portion 215*b* and having an outer diameter becoming smaller toward the front. The tube part 215 is provided with two groove-shaped guide holes 219 from the rear-side tapered outer circumferential surface portion 215*a* to the constant-diameter outer circumferential surface portion 215*b*. The two guide holes 219 extend in the axis L direction and are formed in 180-degree rotational symmetry about the axis L. A connecting screw 220 is positioned inside the guide hole 219.

Figure 12:
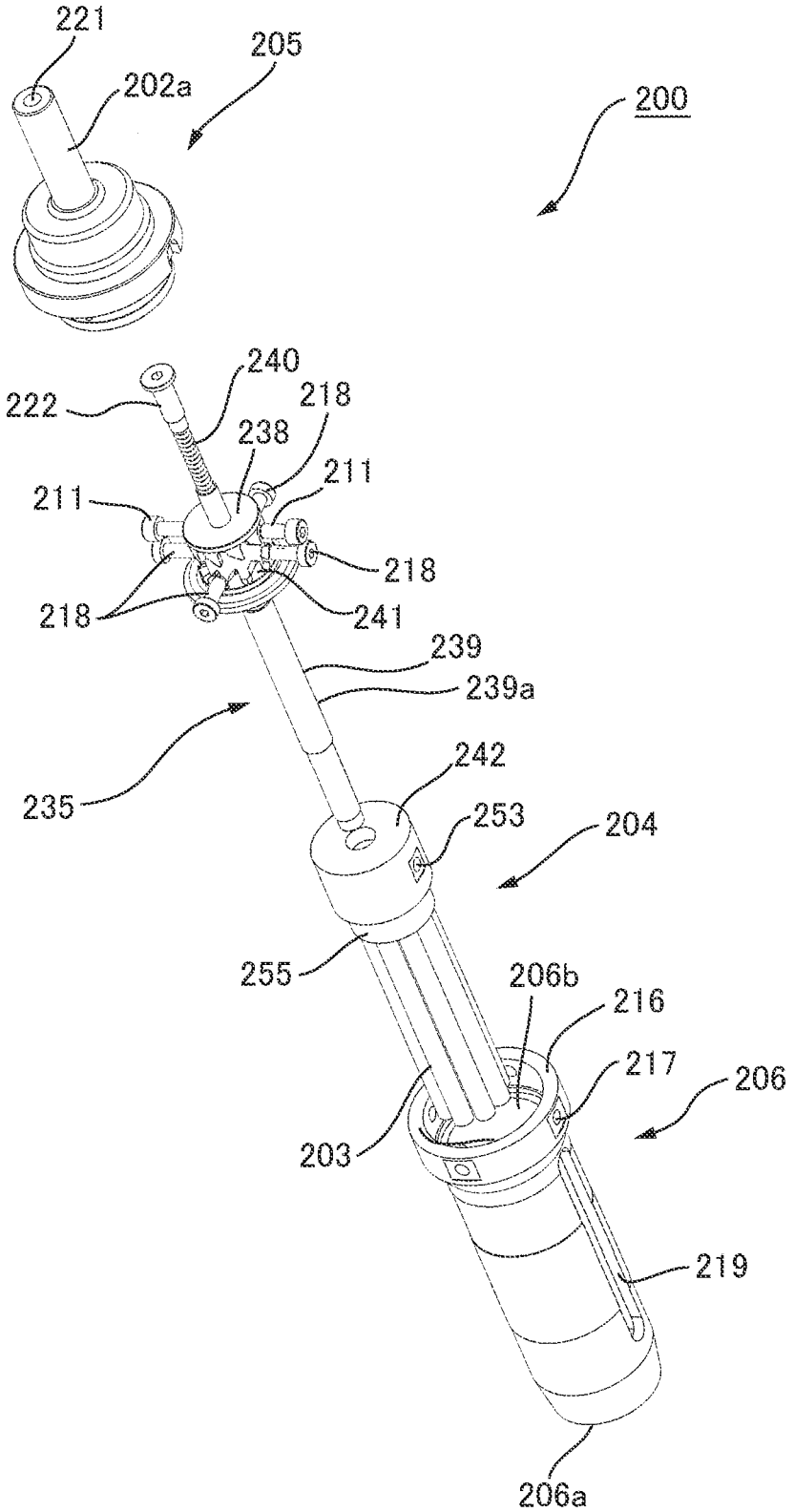
FIG. 12 is an exploded perspective view of the polishing tool unit illustrated in FIG. 11.
Figure 13:
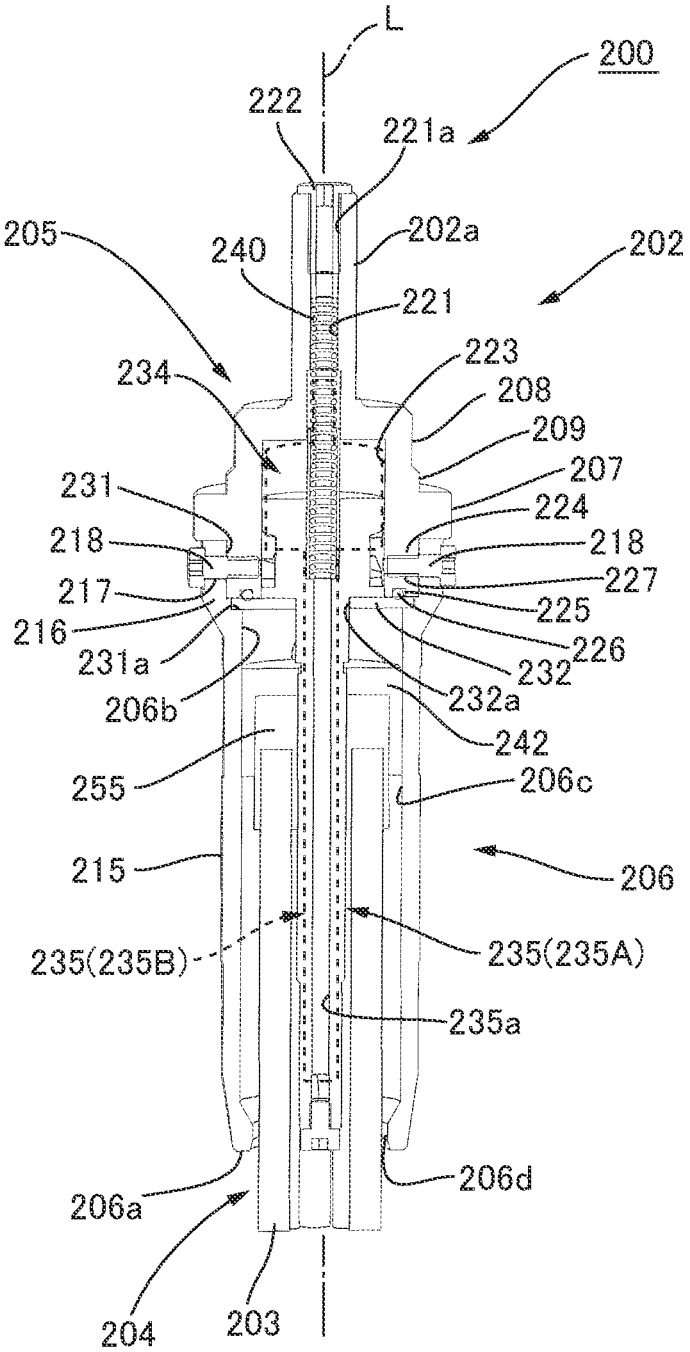
FIG. 13 is a first longitudinal sectional view of the polishing tool unit illustrated in FIG. 11.
Figure 14:
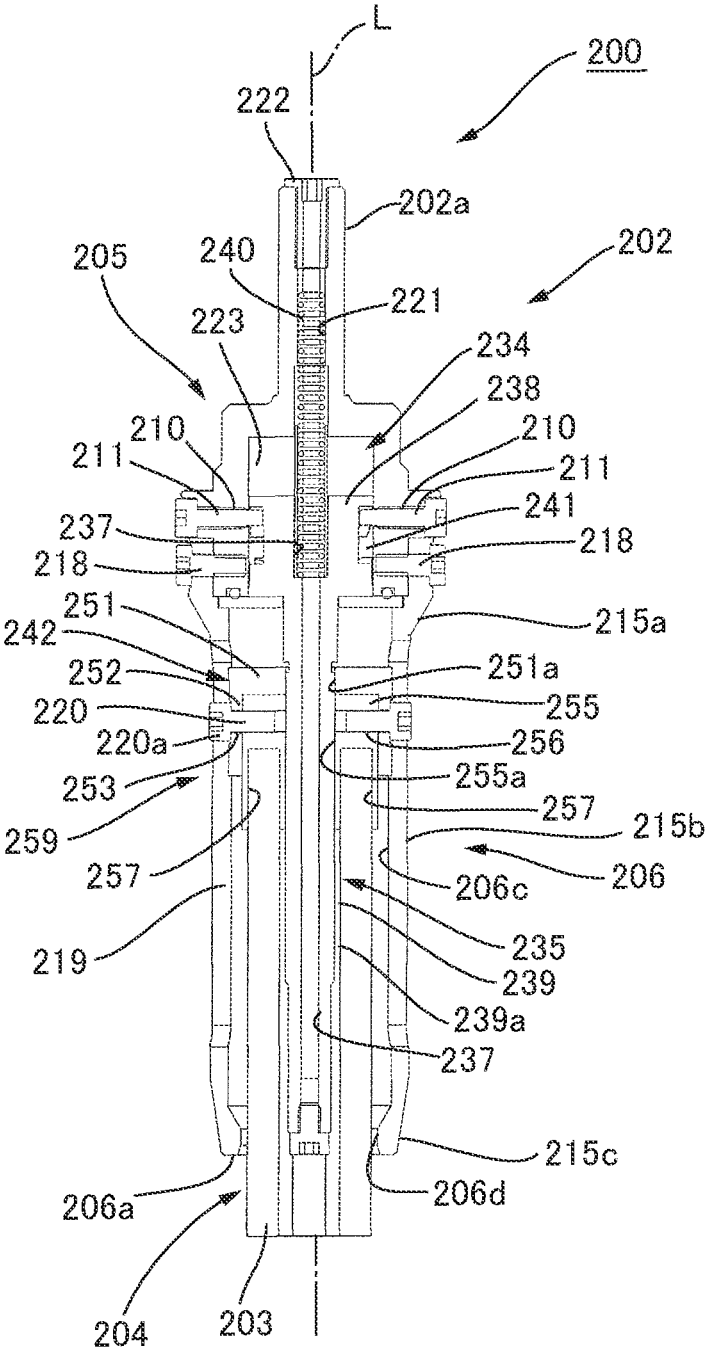
FIG. 14 is a second longitudinal sectional view of the polishing tool unit illustrated in FIG. 11.

FIG. 12 is an exploded perspective view of the polishing tool unit 200 illustrated in FIG. 11. FIG. 13 is a first longitudinal sectional view of the polishing tool unit 200 illustrated in FIG. 11, the view being cut through a position not passing through the guide holes 219. FIG. 14 is a second longitudinal sectional view of the polishing tool unit 200 illustrated in FIG. 11, the view being cut through a position passing through the guide holes 219. As illustrated in FIG. 13, the shank head 205 is provided with a head center hole 221 that penetrates the shank 202*a*, and the first connecting disk part 208, the second connecting disk part 209, and the disk part 207 in the axis L direction. A threaded part 221*a* is formed in the inner circumferential surface of the rear end portion of the head center hole 221, that is, in the vicinity of a rear end opening of the head center hole 221. An annular screw 222 is screwed into the threaded part 221*a* from the rear. A circular recess part 223 coaxial with the disk part 207 and recessed backward is formed in the center portion of the front end surface of the disk part 207. A front end opening of the head center hole 221 is formed at the center of the bottom of the circular recess part 223. The bottom of the circular recess part 223 is positioned in the first connecting disk part 208.

An annular wall 224 protrudes forward from the front end surface of the disk part 207. In a state of surrounding the circular recess part 223 at the opening edge of the circular recess part 223, the annular wall 224 is formed coaxially with the disk part 207. The inner diameter of the annular wall 224 is the same as the inner diameter of the circular recess part 223, and the annular inner circumferential surface of the circular recess part 223 and the annular inner circumferential surface of the annular wall 224 are continued. The outer diameter of the annular wall 224 is smaller than the outer diameter of the disk part 207.

The annular front end surface of the annular wall 224 is provided with an annular groove 225. An O-ring 226 is inserted into the annular groove 225. Furthermore, the annular wall 224 is provided with four head-side threaded holes 227 extending in the radial direction. The four head-side threaded holes 227 are formed in 90-degree rotational symmetry about the axis L.

The sleeve 206 includes a sleeve-side circular recess part 231 in the rear end surface of the flange 216, the sleeve-side circular recess part 231 being coaxial with a center hole 206*b* of the sleeve 206 and recessed forward. The inner diameter of the sleeve-side circular recess part 231 is larger than the inner diameter of the center hole 206*b*. Accordingly, the bottom of the sleeve-side circular recess part 231 is an annular surface 231*a* facing backward. An annular plate 232 including a spindle hole 232*a* is inserted into the sleeve-side circular recess part 231 from the rear.

The annular wall 224 of the shank head 205 is inserted into the sleeve-side circular recess part 231. Here, the inner diameter of the sleeve-side circular recess part 231 corresponds to the outer diameter of the annular wall 224, and the annular wall 224 is fitted into the sleeve-side circular recess part 231. The shank head fixing screw 218 is screwed into each of the four head-side threaded holes 227 of the annular wall 224 via a corresponding one of the sleeve-side threaded holes 217 of the sleeve 206. With this configuration, the shank head 205 is connected to the sleeve 206.

In a state that the shank head 205 is connected to the sleeve 206, the rear surface of the annular plate 232 comes into contact with the circular front end surface of the annular wall 224 of the shank head 205 via the O-ring 226. With this configuration, a cam housing 234 is divided by the annular wall 224 and the circular recess part 223 of the shank head 205, and the annular plate 232. As illustrated in FIG. 14, the tip part of the cam pin 211 that is screwed into the threaded hole 210 of the disk part 207 of the shank head 205 protrudes in the cam housing 234.

As illustrated in FIG. 14, the sleeve 206 includes a constant-diameter inner circumferential surface portion 206*c* with a constant inner diameter in a region in which a rear-side tapered outer circumferential surface portion 215*a* and a constant-diameter outer circumferential surface portion 215*b* are formed. The sleeve 206 further includes a small-diameter inner circumferential surface portion 206*d* having an inner diameter smaller than that of the constant-diameter inner circumferential surface portion 206*c* in a region in which a front-side tapered outer circumferential surface portion 215*c* is formed.

As illustrated in FIG. 12, a cam screw (a shaft) 235 is disposed coaxially with the shank head 205 and the sleeve 206 on the inner circumferential side of the shank head 205 and the sleeve 206. As illustrated in FIG. 13, the cam screw 235 includes a screw center hole 235*a* penetrating in the axis L direction. The cam screw 235 further includes, from the rear toward the front, a cam portion 238, and a bolt portion 239 having a diameter smaller than that of the cam portion 238.

The cam portion 238 includes a cam 241 in the outer circumferential surface, the cam 241 being such that the tip part of the cam pin 211 screwed into the threaded hole 210 of the disk part 207 of the shank head 205 slides. The bolt portion 239 includes a male thread 239*a* in the outer circumferential surface. As illustrated in FIG. 14, the cam screw 235 is such that the cam portion 238 is disposed in the cam housing 234, and the bolt portion 239 is positioned inside the sleeve 206. A nut 242 is screwed onto the bolt portion 239.

As illustrated in FIG. 14, the cam screw 235 includes a recess part 237 recessed forward in the rear end surface of the cam portion 238. A coil spring 240 is disposed inside the recess part 237. The front end portion of the coil spring 240 is in contact with the bottom (the rear end surface) of the recess part 237, meanwhile the rear end portion of the coil spring 240 is in contact with the front end surface of the annular screw 222 screwed into the center hole of the shank 202*a*.

The coil spring 240 biases the cam screw 235 to a first position 235A, illustrated in FIG. 13, in the axis L direction. The first position 235A is a position in which the cam portion 238 comes into contact with the annular plate 232, and a position in which a gap is formed between the bottom (the rear end surface) of the circular recess part 223 of the shank head 205 and the rear end surface of the cam screw 235 (the rear end surface of the cam portion 238). Here, the cam screw 235 is movable between the first position 235A and a second position 235B spaced backward from the first position 235A in the axis L direction. The second position 235B is a position in which the rear end surface of the cam portion 238 comes into contact with the bottom of the circular recess part 223. When the cam screw 235 moves backward from the first position 235A, the coil spring 240 is compressed to provide biasing force that biases the cam screw 235 forward in the axis L direction (a direction toward the first position 235A).

Figure 15:
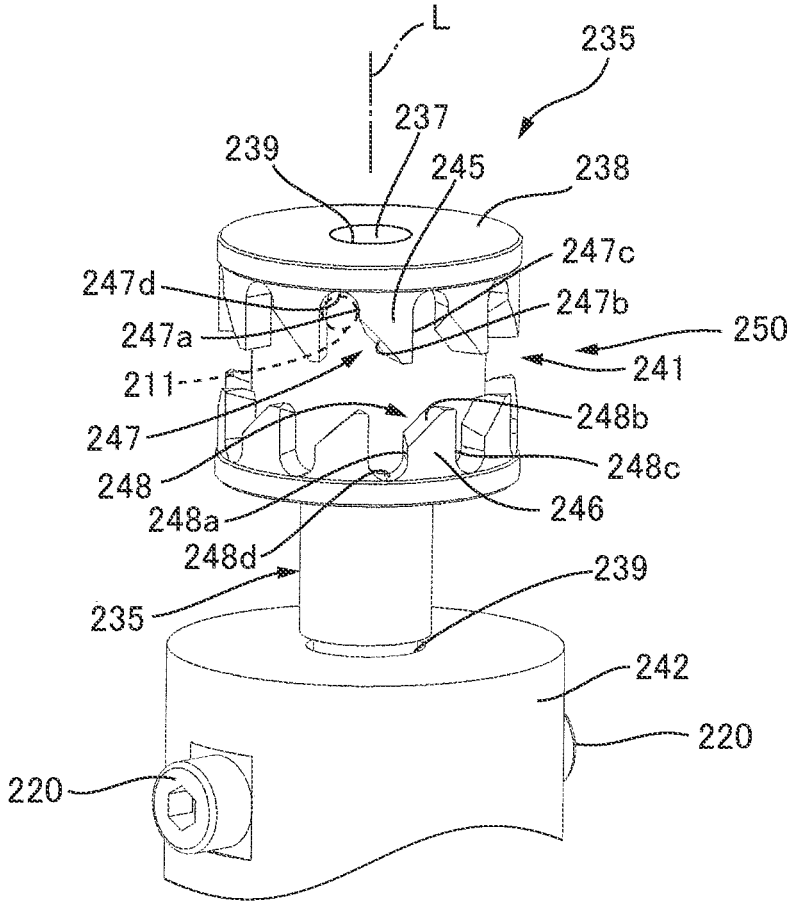
FIG. 15 is a partial perspective view of a cam portion and surroundings thereof of the polishing tool unit illustrated in FIG. 11.

Next, with reference to FIG. 15, the cam 241 formed in the outer circumferential surface of the cam portion 238 is described in detail. FIG. 15 is an enlarged partial view of the cam portion 238 and surroundings thereof of the cam screw 235. The outer circumferential surface of the cam portion 238 includes: a plurality of rear-side protruding parts 245 protruding from the rear-side of the cam portion 238 toward the outer circumferential side; and a plurality of front-side protruding parts 246 protruding from the front-side of the cam portion 238 toward the outer circumferential side. The rear-side protruding part 245 and the front-side protruding part 246 are provided so as to be spaced from each other in the axis L direction. The distance between the rear-side protruding part 245 and the front-side protruding part 246 in the axis L direction is a distance allowing the tip part of the cam pin 211 to be inserted thereinto. The plurality of the rear-side protruding parts 245 is provided at equiangular intervals in the circumferential direction. The distance between a rear-side protruding part 245 and another rear-side protruding part 245 adjacent to each other is a distance allowing the tip part of the cam pin 211 to be inserted thereinto. The plurality of the front-side protruding parts 246 is also provided at equiangular intervals in the circumferential direction. The distance between a front-side protruding part 246 and another front-side protruding part 246 adjacent to each other is a distance allowing the tip part of the cam pin 211 to be inserted thereinto.

The side surface of each of the rear-side protruding parts 245, the side surface facing forward in the circumferential direction, is a rear-side cam surface 247 in which the cam pin 211 slides. The rear-side cam surface 247 includes: a rear-side first cam surface portion 247*a* extending in the axis L direction; a rear-side inclined cam surface portion 247*b* inclined from the tip of the rear-side first cam surface portion 247*a* toward the front in a single circumferential direction; and a rear-side second cam surface portion 247*c* extending backward from an end of the rear-side inclined cam surface portion 247*b* in the axis L direction, the end being on the opposite side to the rear-side first cam surface portion 247*a*. The rear-side inclined cam surface portion 247*b* is inclined backward toward the outer circumferential side. A rear-side arc-shaped surface 247*d* opened forward is formed between a rear-side protruding part 245 and another rear-side protruding part 245 adjacent to each other in the circumferential direction.

Meanwhile, the side surface of each of the front-side protruding parts 246, the side surface protruding from the outer circumferential surface toward the outer circumferential side, is a front-side cam surface 248 in which the cam pin 211 slides. The front-side cam surface 248 includes: a front-side first cam surface portion 248*a* extending in the axis L direction; a front-side inclined cam surface portion 248*b* inclined from the tip of the front-side first cam surface portion 248*a* toward the front in a single circumferential direction; and a front-side second cam surface portion 248*c* extending forward from an end of the front-side inclined cam surface portion 248*b* in the axis L direction, the end being on the opposite side to the front-side first cam surface portion 248*a*. The front-side inclined cam surface portion 248*b* is inclined forward toward the outer circumferential side. A front-side arc-shaped surface 248*d* opened forward is formed between a front-side protruding part 246 and another front-side protruding part 246 adjacent to each other in the circumferential direction.

Here, the formation position of the rear-side protruding part 245 is displaced from the formation position of the front-side protruding part 246 in the circumferential direction. With this configuration, the rear-side inclined cam surface portion 247*b* of the rear-side cam surface 247 is opposed to the front-side arc-shaped surface 248*d* between two of the front-side protruding parts 246. Furthermore, the front-side inclined cam surface portion 248*b* of the front-side cam surface 248 is opposed to the rear-side arc-shaped surface 247*d* between two of the rear-side protruding parts 245.

In a state that the cam portion 238 is disposed inside the cam housing 234, a motion converting mechanism 250 is configured such that, by the cam portion 238 and the cam pin 211, a linear reciprocating motion of the cam screw 235 in the axis L direction is converted into a rotational motion of the cam screw 235 at a certain angle about the axis L in a single direction. Note that the cam screw 235 is usually biased to the first position 235A by the coil spring 240. Accordingly, the cam pin 211 is usually in contact with the rear-side arc-shaped surface 247*d* between the rear-side protruding parts 245.

As illustrated in FIG. 14, the front end of the cam screw 235, that is, the front end of the bolt portion 239 is positioned backward of the front end opening 206*a* of the sleeve 206. The front end side of the nut 242 screwed onto the bolt portion 239 is connected to the brush-shaped grinding stone 204.

The nut 242 includes, from the rear toward the front in the axis L direction, an annular nut body part 251, and a holder connecting part (a connecting part) 252. The holder connecting part 252 is formed of an annular wall protruding forward from the outer circumferential edge of the front end of the nut body part 251. The outer diameters of the nut body part 251 and the holder connecting part 252 each correspond to the inner diameter of the constant-diameter inner circumferential surface 206*c* of the sleeve 206. In a state of being movable inside the sleeve 206 in the axis L direction, the nut 242 is inserted into the sleeve 206. In the inner circumferential surface of the nut body part 251, a female thread 251*a* screwed onto the bolt portion 239 is formed. In the holder connecting part 252, two nut-side through holes 253 perpendicular to the axis L and penetrating in the radial direction are formed. The two nut-side through holes 253 are formed in 180-degree rotational symmetry about the axis L.

(Brush-Shaped Grinding Stone)

The brush-shaped grinding stone 204 includes: linear grinding members 203; and an annular grinding member holder 255 that holds the rear end portions of the linear grinding members 203 in a bundle. The grinding member holder 255 is coaxially connected to the nut 242, whereby the brush-shaped grinding stone 204 is held by the tool holder 202. As illustrated in FIG. 13, the brush-shaped grinding stone 204 is held by the tool holder 202 in a state that the grinding member holder 255 is positioned inside the sleeve 206, the front end portions of the linear grinding members 203 protrude from the front end opening 206*a* of the sleeve 206, and the brush-shaped grinding stone 204 is movable integrally with the nut 242 in the axis L direction.

As illustrated in FIG. 14, the grinding member holder 255 has an annular shape and includes a spindle hole 255*a*. Furthermore, the grinding member holder 255 has an outer diameter allowing the grinding member holder 255 to be fitted to the holder connecting part 252 of the nut 242. The outer diameter of the grinding member holder 255 is smaller than the inner diameter of the small-diameter inner circumferential surface portion 206*d* of the sleeve 206. Furthermore, the grinding member holder 255 is provided with two holder-side through holes 256 perpendicular to the axis L and penetrating in the radial direction. The two holder-side through holes 256 are formed in 180-degree rotational symmetry about the axis L.

The linear grinding members 203 are obtained by impregnating aggregate yarn of inorganic filaments, such as aluminum filaments, with a binder resin, and curing the resultant. Here, in the front face of the grinding member holder 255, a plurality of linear grinding member holding holes 257 is formed so as to be spaced from each other in the circumference of the spindle hole 255*a*. The plurality of the linear grinding member holding holes 257 are annularly arranged so as to surround the spindle hole 255*a*. Bundles of a plurality of the linear grinding members 203 each are formed, and the rear end of the bundle is inserted into the holding hole, and fixed to the grinding member holder 255 with an adhesive.

At the time of making the brush-shaped grinding stone 204 held by the tool holder 202, first, the nut 242 is screwed onto the bolt portion 239 of the cam screw 235 and disposed inside the sleeve 206. Next, the brush-shaped grinding stone 204 is inserted into the sleeve 206 from the grinding member holder 255 side, and the grinding member holder 255 is fitted into the annular wall of the holder connecting part 252. Thereafter, the connecting screw 220 is screwed into the holder-side threaded hole 256 via each of the guide holes 219 and the nut-side through holes 253 of the sleeve 206, whereby the grinding member holder 255 and the nut 242 are connected inside the sleeve 206.

Here, in a state that the connecting screw 220 is screwed into the holder-side threaded hole 256 via the guide hole 219 and the nut-side through hole 253, the head part 220*a* of each of the connecting screws 220 (an end portion on the outer circumferential side of the connecting screw 220) is positioned inside the guide hole 219. Accordingly, if the nut 242 is about to rotate about the axis L, the head section 220*a* of each of the connecting screws 220 comes into contact with the inner circumferential wall of a corresponding one of the guide holes 219 from the circumferential direction, thereby preventing the rotation. That is, the two guide holes 219 and the two connecting screws 220 that each connect the nut 242 to the grinding member holder 255 constitute a nut rotation regulating mechanism 259 configured to regulate the rotation of the nut 242 about the axis L. The nut rotation regulating mechanism 259 allows movement of the nut 242 in the axis L direction.

(Adjustment Operation of the Protruding Amount of Grinding Members)

Figure 16A:
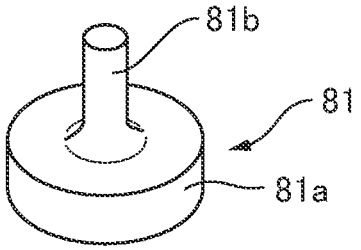
FIG. 16 is an illustration of a protruding amount adjusting member that adjusts the protruding amount of grinding members.
Figure 16B:
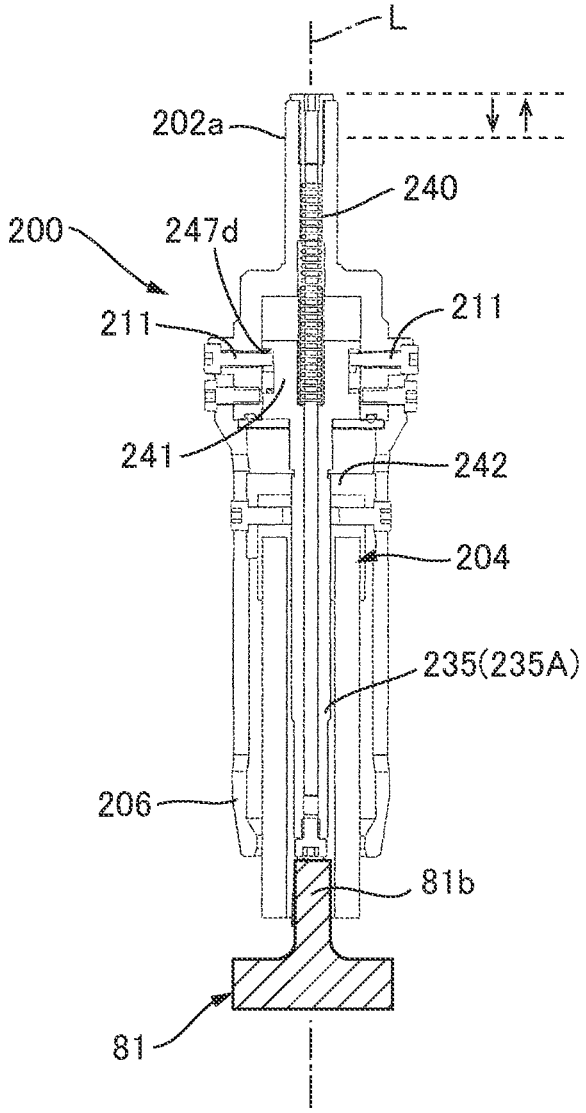
Figure 16C:
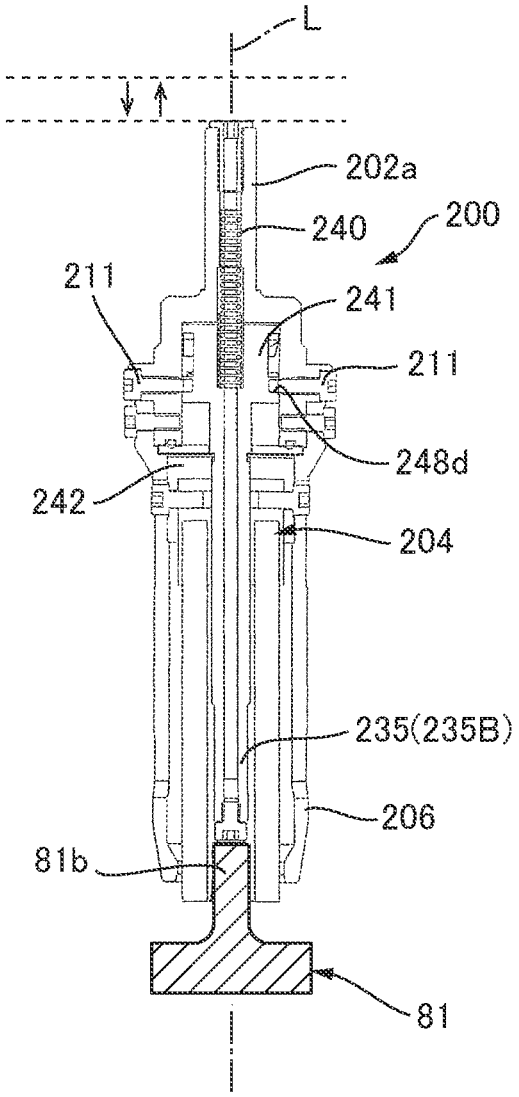
Figure 17A:
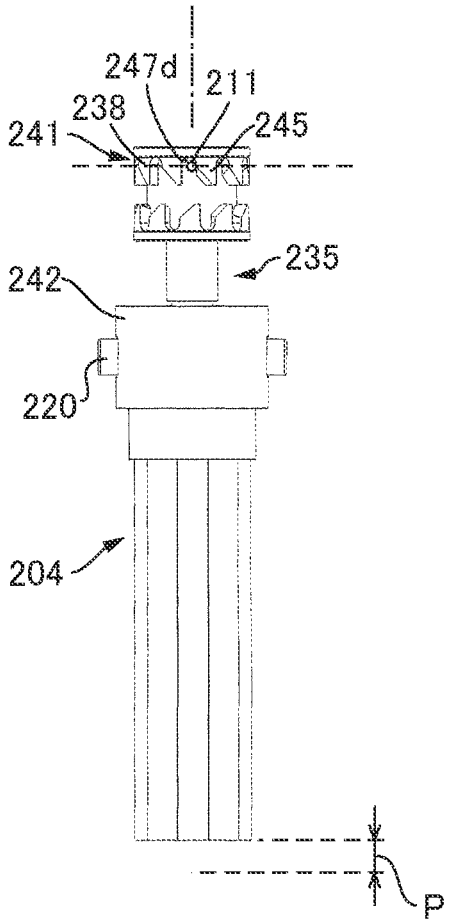
FIG. 17 is an illustration of an adjustment operation of adjusting the protruding amount of grinding members in the polishing tool unit illustrated in FIG. 11.
Figure 17B:
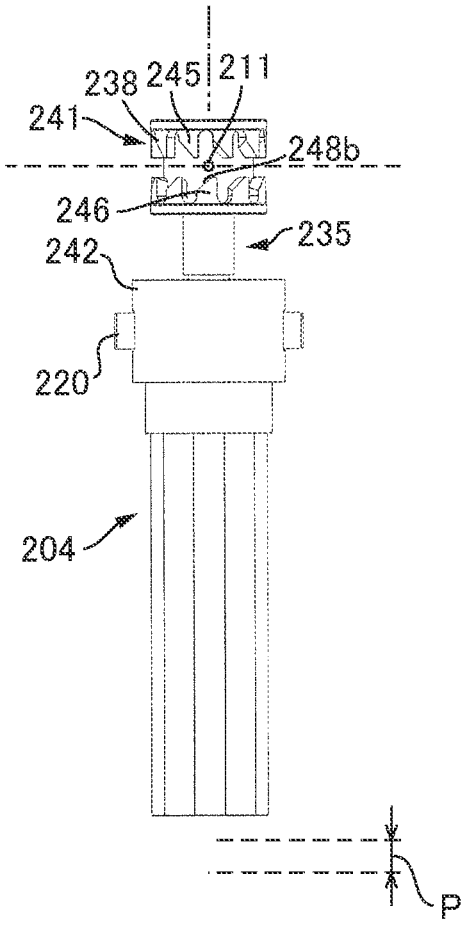
Figure 17C:
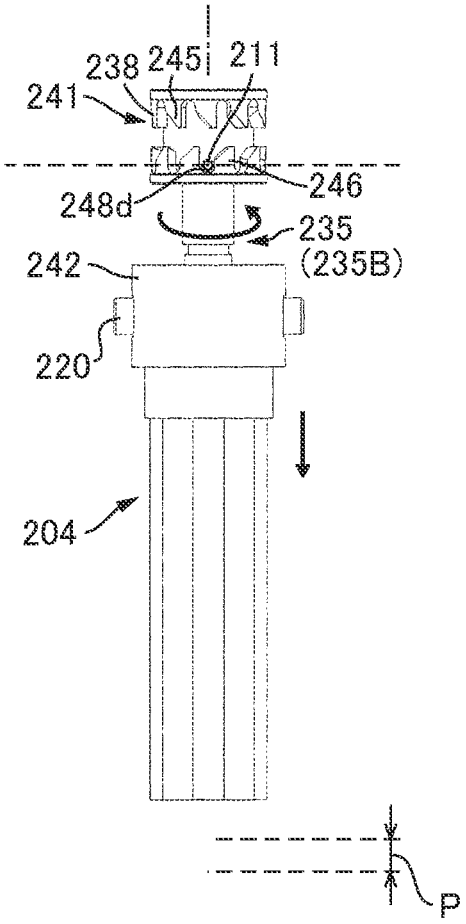
Figure 17D:
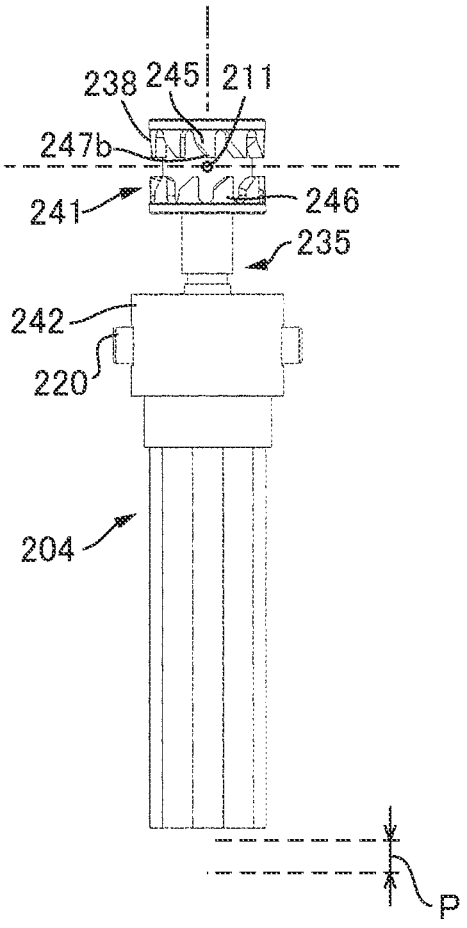
Figure 17E:
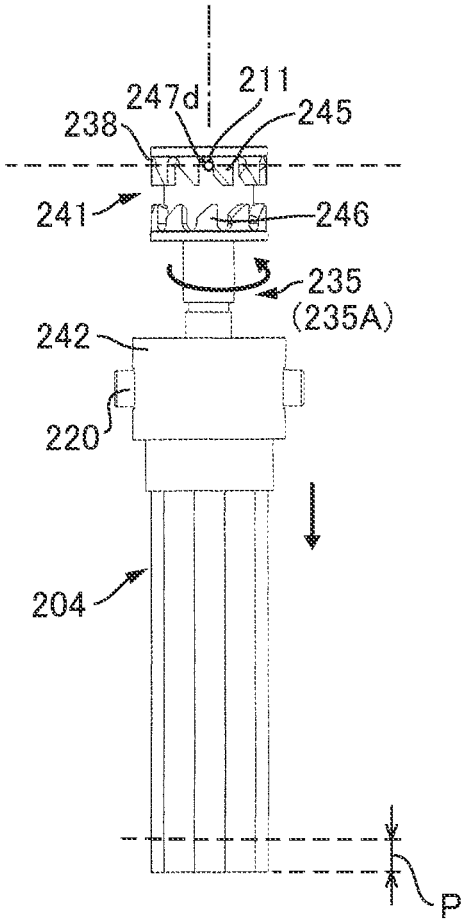

FIG. 16(*a*) is a perspective view of a protruding amount adjusting member for adjusting the protruding amount of the grinding members in the polishing tool unit 200 illustrated in FIG. 11. FIG. 16(*b*) illustrates a state that a boss of the protruding amount adjusting member is inserted into the sleeve 206 of the polishing tool unit 200. FIG. 16(*c*) illustrates a state that the polishing tool unit 200 is further moved from a position illustrated in FIG. 16(*b*), thereby coming closer to the protruding amount adjusting member. FIG. 17 is an illustration of an operation of adjusting the protruding amount of the grinding members of the polishing tool unit 200 illustrated in FIG. 11. FIG. 17 takes up and illustrates the cam screw 235, the cam pin 211, the nut 242, the brush-shaped grinding stone 204, and the connecting screws 220.

In the polishing tool unit 200, the shank 202*a* is connected to a head of a machining center via, for example, a tool holder (not illustrated). When the wear amount of the linear grinding members 203 reaches a predetermined wear amount, the machining center is driven by a control program to move the polishing tool unit 200 to a position for adjusting the protruding amount of the grinding members, in which the protruding amount adjusting member 81 is disposed.

Here, as illustrated in FIG. 16(*a*), the protruding amount adjusting member 81 includes a disk part 81*a*, and a column-shaped boss 81*b* protruding from the center of the disk part 81*a*. The diameter of the boss 81*b* is approximately equal to the diameter of the cam screw 235, and the boss 81*b* is insertable into the sleeve 206. The tip surface of the boss 81*b* is a flat surface perpendicular to the axis of the boss 81*b*.

The polishing tool unit 200 disposed at a position for adjusting the protruding amount of the grinding members is disposed coaxially with the boss 81*b* of the protruding amount adjusting member 81 by the machining center. Next, the polishing tool unit 200 is moved forward by the machining center so as to come closer to the protruding amount adjusting member 81. With this, the boss 81*b* is inserted into the sleeve 206 from the front in the axis L direction, and the tip surface of the boss 81*b* comes into contact with the front end of the cam screw 235, as illustrated in FIG. 16(*b*). At the time when the tip surface of the boss 81*b* comes into contact with the front end of the cam screw 235, the cam screw 235 is biased to the first position 235A by the biasing force of the coil spring 240. Accordingly, as illustrated in FIG. 17(*a*), the cam pin 211 is positioned in the rear-side arc-shaped surface 247*d*.

Thereafter, the polishing tool unit 200 is further pushed forward by the machining center by a predetermined distance. The predetermined distance means the distance between the first position 235A and the second position 235B, and the distance between the rear-side arc-shaped surface 247*d* and the front-side arc-shaped surface 248*d* in the cam portion 238. Here, when the polishing tool unit 200 is pushed forward by the predetermined distance in a state that the front ends of the linear grinding members 203 are in contact with the boss 81*b*, the cam screw 235 moves relative to the shank head 205 and the sleeve 206. That is, as illustrated in FIG. 17(*b*), the cam screw 235 moves from the first position 235A toward the second position 235B in the axis L direction against the biasing force of the coil spring 240. With this, the cam pin 211 moves forward relative to the cam portion 238 of the cam screw 235. Then, the cam pin 211 moves from the rear-side arc-shaped surface 247*d* to the front-side protruding part 246 side, and comes into sliding-contact with the front-side inclined cam surface portion 248*b* of the front-side protruding part 246.

Thereafter, when the cam screw 235 is disposed at the second position 235B as illustrated in FIG. 16(*c*), the cam pin 211 moves from the front-side inclined cam surface portion 248*b* via the front-side first cam surface portion 248*a* to the front-side arc-shaped surface 248*d* as illustrated in FIG. 17(*c*). Here, the cam pin 211 is fixed to the shank head 205 by the head-side threaded hole 227, and the cam screw 235 is rotatable about the axis L. Accordingly, when the cam pin 211 comes into sliding-contact with the front-side inclined cam surface portion 248*b*, the cam screw 235 rotates only by a certain angle in a single direction.

Next, the polishing tool unit 200 is moved by the machining center in a direction so as to become more distant from the protruding amount adjusting member 81. That is, the state of the polishing tool unit 200 illustrated in FIG. 16(*c*) is shifted to the state thereof illustrated in FIG. 16(*b*). Accordingly, the state of contact between the cam screw 235 and the boss 81*b* is canceled.

Here, as the polishing tool unit 200 becomes more distant from the protruding amount adjusting member 81, the cam screw 235 moves from the second position 235B toward the first position 235A in the axis L direction by the biasing force of the coil spring 240. Accordingly, as illustrated in FIG. 17(*d*), the cam pin 211 moves backward relative to the cam portion 238 of the cam screw 235.

With this, the cam pin 211 moves from the front-side arc-shaped surface 248*d* to the rear-side protruding part 245 side, and comes into contact with the rear-side inclined cam surface portion 247*b* of the rear-side protruding part 245. Thereafter, as illustrated in FIG. 17(*e*), the cam pin 211 moves from the rear-side inclined cam surface portion 247*b* via the rear-side first cam surface portion 247*a* to the rear-side arc-shaped surface 247*d*. Here, the cam pin 211 is fixed to the shank head 205 by the head-side threaded hole 227, and the cam screw 235 is rotatable about the axis L. Accordingly, when the cam pin 211 comes into sliding-contact with the rear-side inclined cam surface portion 247*b*, the cam screw 235 rotates only by a certain angle in a single direction.

With these operations, the cam screw 235 rotates only by the distance between the rear-side protruding parts 245 in a single direction. Here, rotation of the nut 242 about the axis L is regulated by the nut rotation regulating mechanism 259. Accordingly, the nut 242 moves in the axis L direction with rotation of the cam screw 235, thereby causing the brush-shaped grinding stone 204 to move forward in the axis L direction. Thus, the linear grinding members 203 can be made to protrude from the front end opening 206*a* of the sleeve 206 only by the movement amount of the nut 242 (grinding member protruding amount P) that corresponds to the rotation amount of the cam screw 235.

According to the present embodiment, a pushing operation of pushing-in the polishing tool unit 200 by pressing the unit 200 against the protruding amount adjusting member 81 allows the protruding amount of the grinding members to be adjusted, and thus, the operation of adjustment can be easily performed.

Also in the present embodiment, the same advantageous effects as in the polishing tool unit 1 of Embodiment 1 can be achieved. That is, also in the present embodiment, the cam screw 235 is movable between the first position 235A and the second position 235B spaced from each other in the axis L direction, and is biased to the first position 235A in the front by the biasing force of the coil spring 240. Accordingly, when the force of pushing the brush-shaped grinding stone 204 from the side of a process-target workpiece into the sleeve 206 works during processing operation, the brush-shaped grinding stone 204 is moved backward in the axis L direction, whereby breakage of the brush-shaped grinding stone 204 and wear of the grinding members can be reduced. That is, when the force of pushing the brush-shaped grinding stone 204 toward the tool holder 202 side works during processing operation, the force is conveyed to the cam screw 235 via the nut 242. Thus, the cam screw 235 moves backward in the axis L direction against the biasing force of the coil spring 240, whereby the force from the workpiece side is released.

Furthermore, in the present embodiment, as is the case with the polishing tool unit 200 of Embodiment 2, only the formation of the holder-side threaded hole 256 in the grinding member holder 255 of the brush-shaped grinding stone 204 allows the grinding member holder 255 to be connected to the nut 242. With this, the brush-shaped grinding stone 204 can be made simpler, and thus, the cost of manufacture of the brush-shaped grinding stone 204 serving as consumable goods can be reduced.

Note that the protruding amount of the grinding members can be adjusted in such a manner that a flat-plate-shaped member is disposed as the protruding amount adjusting member, and the tips of the linear grinding members 203 are made to come into contact with the protruding amount adjusting member in the axis L direction, whereby the cam screw 235 is moved relative to the cam pin 211 to adjust the protruding amount.

Embodiment 4

Figure 18:
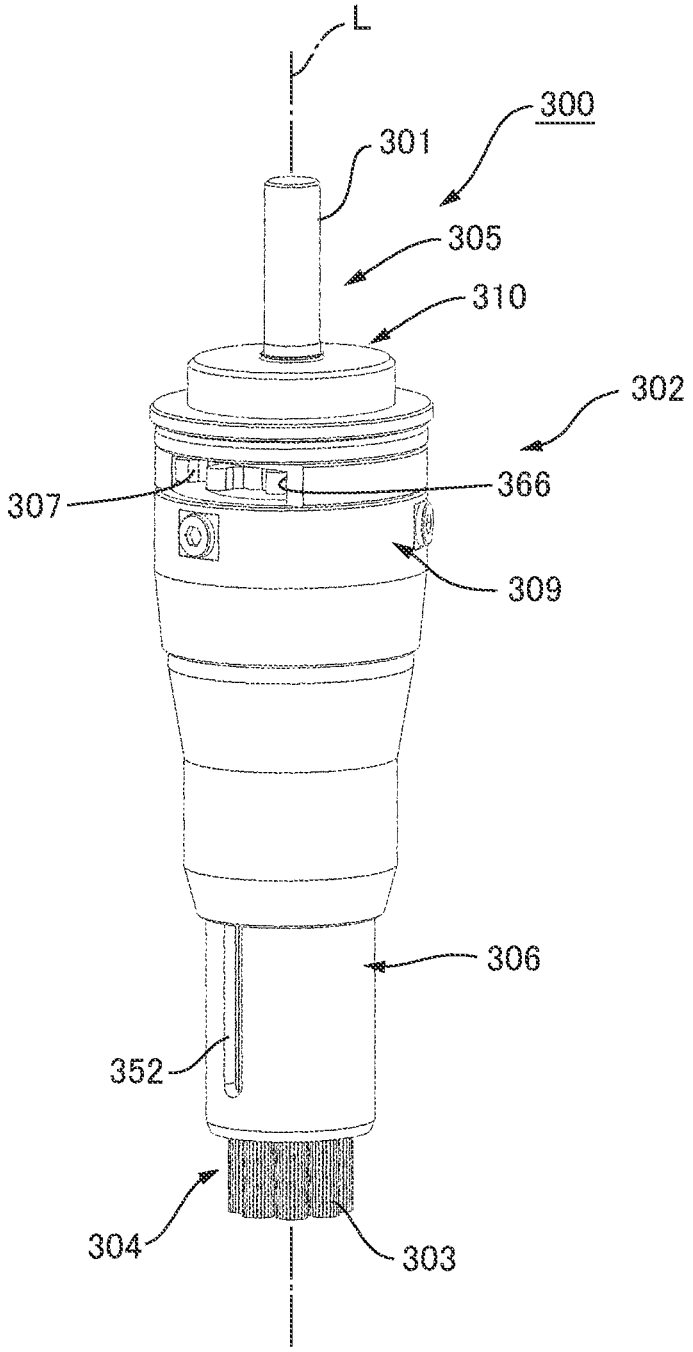
FIG. 18 is a perspective view of a polishing tool unit of Embodiment 4 to which the present invention is applied.

FIG. 18 is a perspective view of a polishing tool unit 300 of Embodiment 4 to which the present invention is applied. As illustrated in FIG. 18, the polishing tool unit 300 of the present embodiment includes: a tool holder 302 including a shank 301 serving as a part attached to a machine tool; and a brush-shaped grinding stone (a polishing tool) 304 including linear grinding members 303 protruding from the front end of the tool holder 302, the front end being on the opposite side of the tool holder 302 from the shank 301.

(Tool Holder)

Figure 19:
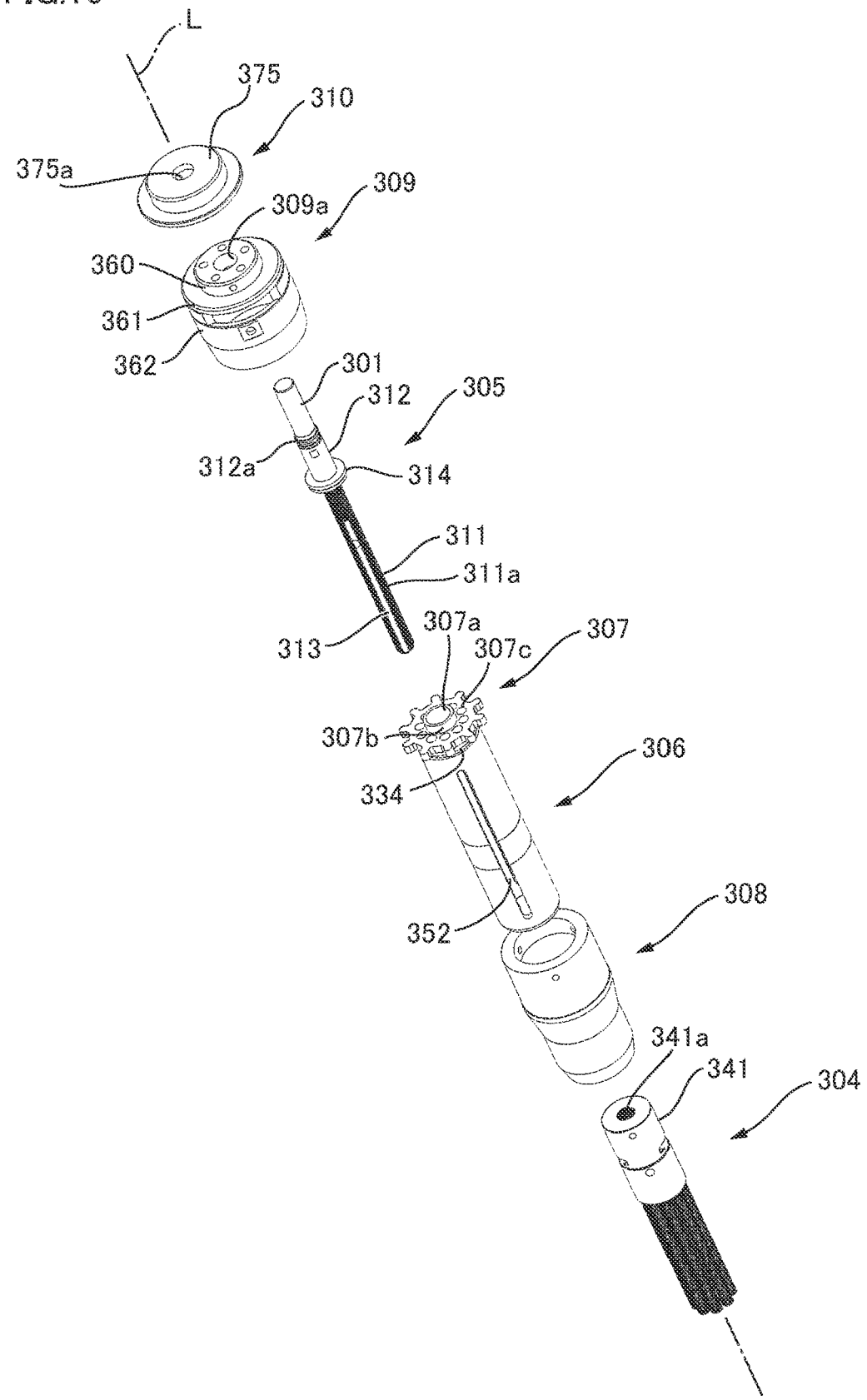
FIG. 19 is an exploded perspective view of the polishing tool unit illustrated in FIG. 18.
Figure 20:
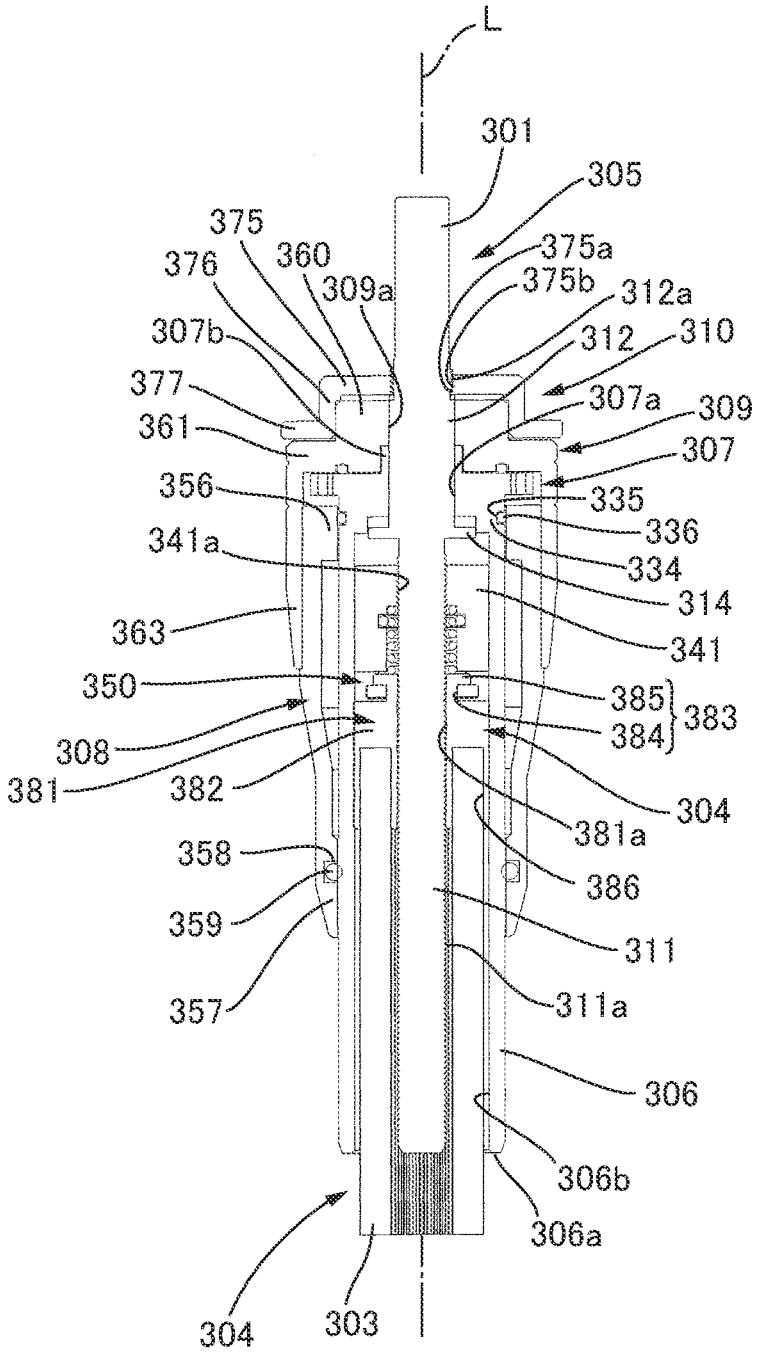
FIG. 20 is a first longitudinal sectional view of the polishing tool unit illustrated in FIG. 18.
Figure 21:
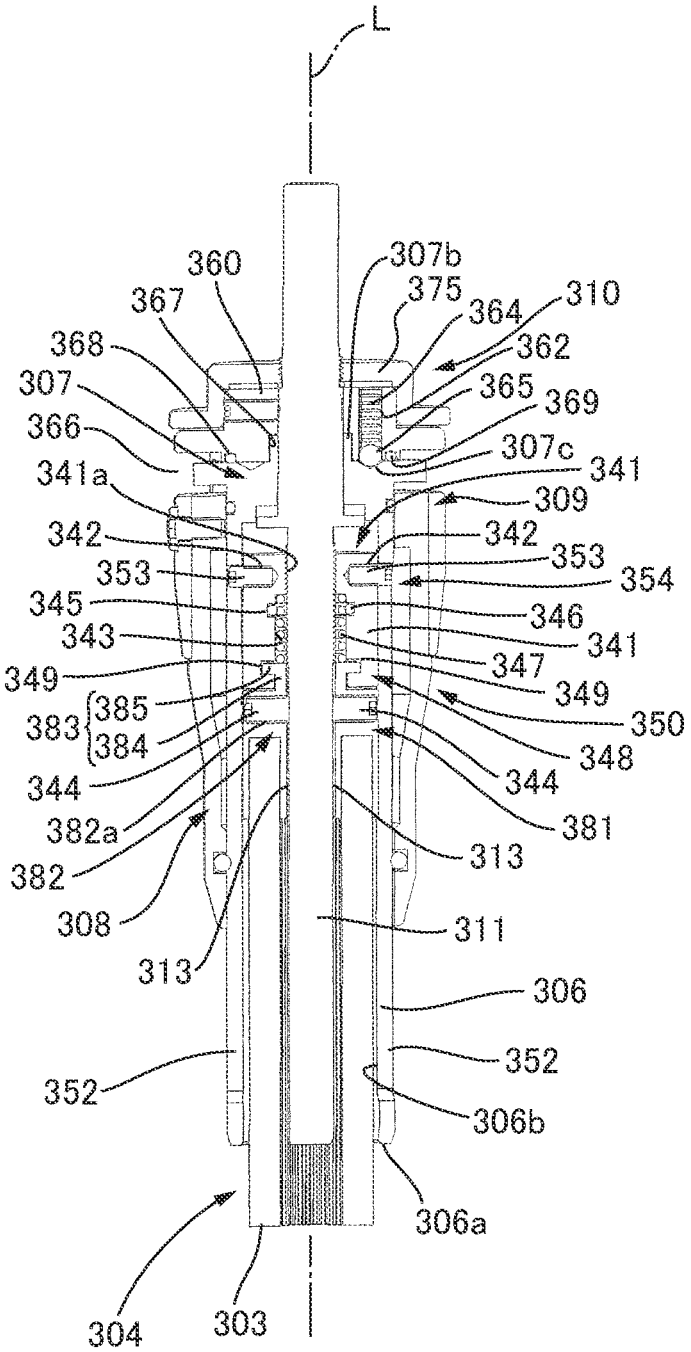
FIG. 21 is a second longitudinal sectional view of the polishing tool unit illustrated in FIG. 18.

FIG. 19 is an exploded perspective view of the polishing tool unit 300 illustrated in FIG. 18. FIG. 20 is a first longitudinal sectional view of the polishing tool unit 300 illustrated in FIG. 18, the view being cut through a position not passing through guide holes 352. FIG. 21 is a second longitudinal sectional view of the polishing tool unit 300 illustrated in FIG. 18, the view being cut through a position passing through the guide holes 352. As illustrated in FIG. 19, the tool holder 302 includes: a screw rod (a shaft) 305 formed integrally with the shank 301; and a sleeve 306, a gear (an operating member) 307, a sleeve balancer 308, a ratchet cover 309, and an unlocking nut 310, which are disposed coaxially with the screw rod 305 on the outer circumferential side of the screw rod 305.

The rear end portion of the screw rod 305 serves as the shank 301. The front side of the screw rod 305 serves as a bolt portion 311 having a male thread 311*a* formed therein. A large-diameter portion 312 and a flange portion 314 having an outer diameter larger than that of the large-diameter portion 312 are provided, from the rear toward the front, between the shank 301 and the bolt portion 311 in the screw rod 305. The large-diameter portion 312 has an outer diameter slightly larger than those of the shank 301 and the bolt portion 311. The threaded part 312*a* is formed in the rear end part of the outer circumferential surface of the large-diameter portion 312. The bolt portion 311 includes a pair of groove-shaped flat surfaces 313 extending in the axis L direction in a region in which the male thread 311*a* is formed. The groove-shaped flat surfaces 313 are provided in 180-degree rotational symmetry about the axis L.

As illustrated in FIG. 20, the gear 307 is positioned on the outer circumferential side of the large-diameter portion 312 of the screw rod 305. The gear 307 includes: a spindle hole 307*a*; and an annular protruding part 307*b* protruding backward from an opening edge portion of the spindle hole 307*a* by a constant height. As illustrated in FIG. 19 and FIG. 21, the gear 307 further includes a plurality of recess parts 307*c* in the annular rear end surface from which the annular protruding part 307*b* protrudes. The recess parts 307*c* are formed at equiangular intervals on the outer circumferential side of the annular protruding part 307*b*. By the insertion of the large-diameter portion 312 of the screw rod 305 into the spindle hole 307*a* and the inner circumferential side of the annular protruding part 307*b*, the gear 307 is supported in a state of being rotatable relative to the screw rod 305 about the axis L.

The sleeve 306 is positioned forward of the gear 307. As illustrated in FIG. 20, the gear 307 and the sleeve 306 are connected via a tubular sleeve connecting part 334. In the present embodiment, the gear 307, the sleeve connecting part 334, and the sleeve 306 are integrally formed with each other. An annular groove 335 recessed toward the inner circumferential side is formed on the outer circumferential surface of the sleeve connecting part 334. An O-ring 336 is inserted into the annular groove 335.

A center hole 306*b* of the sleeve 306 has a constant inner diameter. Inside the sleeve 306, the bolt portion 311 of the screw rod 305 extends in the front and rear direction. The front end of the bolt portion 311, that is, the front end of the screw rod 305 is positioned backward of a front end opening 306*a* of the sleeve 306.

A nut 341 is screwed onto the bolt portion 311. In the annular inner circumferential surface of the nut 341, a female thread 341*a* screwed onto the bolt portion 311 is formed. The nut 341 has a circular annular outer circumferential surface. The outer diameter of the nut 341 corresponds to the inner diameter of the sleeve 306, and the nut 341 is fitted to the inner circumferential side of the sleeve 306 in a state that the nut 341 is movable in the axis L direction. As illustrated in FIG. 21, the nut 341 is provided with two nut-side threaded holes 342 extending in the radial direction. The two nut-side threaded holes 342 are formed in 180-degree rotational symmetry about the axis L.

The front end surface of the nut 341 is provided with a circular recess part 343 recessed backward coaxially with the nut 341. At some midpoint of the circular recess part 343 in the axis L direction, an annular groove 345 recessed toward the outer circumferential side is provided, and an O-ring 346 is disposed in this annular groove 345. Furthermore, a coil spring 347 is inserted into the circular recess part 343.

Figure 22A:
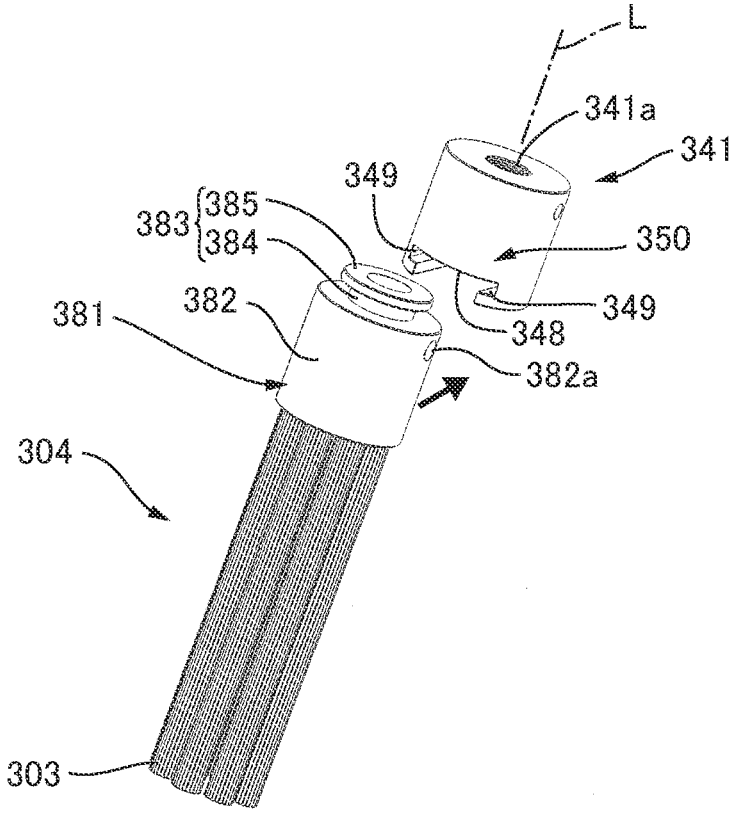
FIG. 22 is an illustration of an operation of connecting a nut and a brush-shaped grinding stone of the polishing tool unit illustrated in FIG. 18.
Figure 22B:
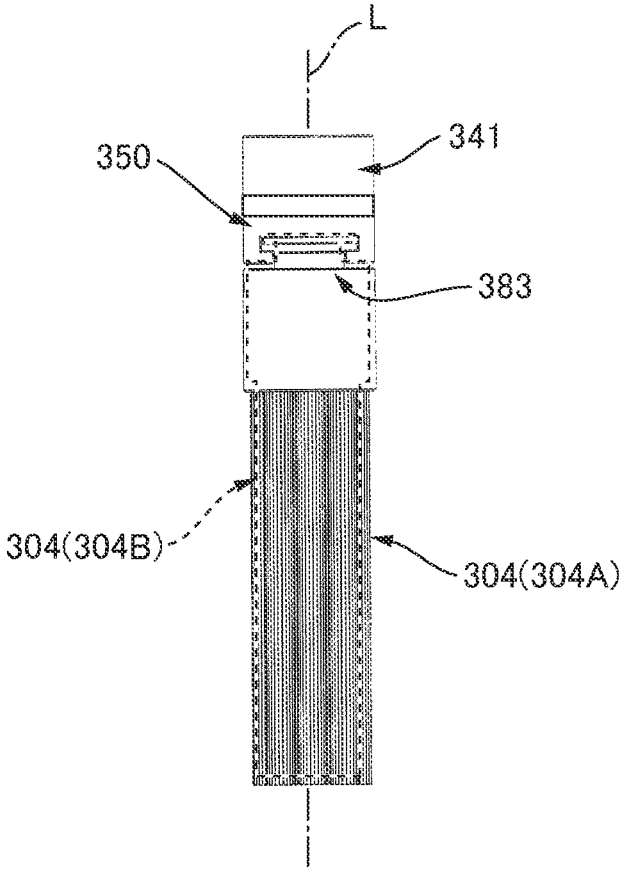

Furthermore, as illustrated in FIG. 22, a groove part 348 is formed in the front end surface of the nut 341, the groove part 348 linearly extending in a direction perpendicular to the axis L from one outer circumferential edge portion toward the other outer circumferential edge portion, the portions being on opposite sides of the axis L. In the rear end portions of a pair of side walls facing each other in a direction perpendicular to the axis L in the groove part 348, lateral groove parts 349 recessed in a direction of moving away from each other are formed along the groove portion 348 (Refer to FIG. 21). The groove part 348 and the lateral groove parts 349 constitute a nut-side connecting part (a connecting part) 350 for connecting the brush-shaped grinding stone 304 to the nut 341. The brush-shaped grinding stone 304 is connected to the front end side of the nut 341 by making use of the nut-side connecting part 350.

Two groove-shaped guide holes 352 are formed in the peripheral wall of the sleeve 306. The two guide holes 352 each extend in the axis L direction and are formed in 180-degree rotational symmetry about the axis L. Here, a rotation regulating screw 353 is screwed into the nut-side threaded hole 342 of the nut 341 via each of the guide holes 352 of the sleeve 306. Furthermore, an end portion on the outer circumferential side of the rotation regulating screw 353 is positioned inside the guide hole 352 of the sleeve 306. Accordingly, if the nut 341 is about to rotate about the axis L, each of the rotation regulating screws 353 comes into contact with the inner circumferential wall of a corresponding one of the guide holes 352 from the circumferential direction, thereby preventing the rotation. That is, the two rotation regulating screws 353 and the two guide holes 352 constitute a nut rotation regulating mechanism 354 configured to regulate rotation of the nut 341 relative to the sleeve 306 about the axis L. The nut rotation regulating mechanism 354 allows movement of the nut 341 in the axis L direction.

As illustrated in FIG. 20, the sleeve balancer 308 is tubular, and includes protruding portions 356 and 357 protruding toward the inner circumferential side in an upper end portion and a lower end portion of the sleeve balancer 308, respectively. The inner diameters of the protruding portions 356 and 357 correspond to the outer diameters of the sleeve connecting part 334 and the sleeve 306. An annular groove 358 recessed toward the outer circumferential side is formed in the inner circumferential surface portion of the protruding portion 357 in the lower end portion. An O-ring 359 is inserted in the annular groove 358.

The sleeve balancer 308 is positioned so as to cover the rear-side of the sleeve 306 and the sleeve connecting part 334 from the outer circumferential side, and the inner circumferential surface of the protruding portion 356 in the upper end portion comes into contact with the sleeve connecting part 334 via the O-ring 336. Furthermore, the protruding portion 357 in the lower end portion comes into contact with the outer circumferential surface portion of the sleeve 306 via the O-ring 359.

As illustrated in FIG. 18 and FIG. 20, the ratchet cover 309 includes, from the rear toward the front: a small-diameter disk part 360; a large-diameter disk part 361 having a diameter larger than that of the small-diameter disk part 360; and an annular wall part 363 protruding forward from the outer circumferential edge portion of the large-diameter disk part 361. A spindle hole 309*a* that the screw rod 305 penetrates is formed at the centers of the small-diameter disk part 360 and the large-diameter disk part 361. Furthermore, as illustrated in FIG. 21, a cover through hole 362 is formed in parallel to the spindle hole 309*a* in the small-diameter disk part 360 and the large-diameter disk part 361. In the covering through hole 362, a coil spring 364 and a metal ball 365 are disposed in order from the rear toward the front. Two opening parts 366 extending in the circumferential direction is formed at a position which is in the upper end portion of the annular wall part 363 and is adjacent to the large-diameter disk part 361. The two opening parts 366 are formed in 180-degree rotational symmetry about the axis L. Furthermore, in the front end surface of the large-diameter disk part 361, a circular recess part 367 having a diameter larger than that of the spindle hole 309*a* is formed coaxially with the spindle hole 309*a*. An annular groove 368 is formed on the outer circumferential side of the circular recess part 367 in the front end surface of the large-diameter disk part 361. An O-ring 369 is inserted into the annular groove 368.

The ratchet cover 309 is fixed to the sleeve balancer 308 from the rear so as to cover the gear 307 and the rear-side of the sleeve balancer 308. A state that the ratchet cover 309 is fixed to the sleeve balancer 308 brings about a state that the annular protruding part 307*b* of the gear 307 is inserted into the circular recess part 367 in the front end surface of the large-diameter disk part 361, and the rear end surface of the gear 307 is in contact with the front end surface of the large-diameter disk part 361 via the O-ring 369. Furthermore, as illustrated in FIG. 20, a state is brought about that the gear 307 is disposed between the sleeve balancer 308 and the front end surface of the large-diameter disk part 361 in the axis L direction, and as illustrated in FIG. 21, a state is brought about that the gear 307 is partially exposed outside from the opening part 366 of the annular wall part 363.

As illustrated in FIG. 20, the unlocking nut 310 includes, from the rear toward the front: an annular plate part 375 extending in a direction perpendicular to the axis L; an annular wall part 376 protruding forward from the outer circumferential edge of the annular plate part 375 by a constant height; and an annular flange part 377 spreading from the front end edge of the annular wall part 376 toward the outer circumferential side. The inner circumferential surface of a spindle hole 375*a* of the annular plate part 375 is provided with a threaded part 375*b* screwed onto the threaded part 312*a* of the large-diameter portion 312 of the screw rod 305.

The unlocking nut 310 is fixed to the screw rod 305 by making the screw rod 305 penetrate the spindle hole 375*a* of the annular plate part 375 and screwing the threaded part 375*b* of the spindle hole 375*a* onto the threaded part 312*a* of the screw rod 305. A state that the unlocking nut 310 is fixed to the screw rod 305 brings about a state that the unlocking nut 310 covers the annular rear end surfaces of the small-diameter disk part 360 and the large-diameter disk part 361 of the ratchet cover 309, and the annular plate part 375 is in contact with the small-diameter disk part 360, as illustrated in FIG. 21. Here, when the annular plate part 375 comes into contact with the small-diameter disk part 360, the annular plate part 375 comes into contact with the rear end part of the coil spring 364 inserted into the cover through hole 362 of the ratchet cover 309, whereby the coil spring 364 is compressed. Accordingly, the ball 365 is pressed against the gear 307 by the biasing force (restoring force) of the coil spring 364, and fits into the recess part 307*c* (refer to FIG. 19) formed in the gear 307. With this configuration, the gear 307 and the sleeve 306 are in a state of not accidentally rotating about the axis L.

(Brush-Shaped Grinding Stone)

FIG. 22(*a*) is an illustration of a connecting operation of connecting the brush-shaped grinding stone 304 to the nut 341, and FIG. 22(*b*) is a side view of the brush-shaped grinding stone 304 connected to the nut 341, the view being from a direction perpendicular to the axis L. As illustrated in FIG. 22, the brush-shaped grinding stone 304 includes: the linear grinding members 303; and an annular grinding member holder 381 that holds the rear end portions of the linear grinding members 303 in a bundle. The grinding member holder 381 is coaxially connected to the nut 341, whereby the brush-shaped grinding stone 304 is held by the tool holder 302. As illustrated in FIG. 20, the brush-shaped grinding stone 304 is held by the tool holder 302 in a state that the grinding member holder 381 is positioned inside the sleeve 306, the front end portions of the linear grinding members 303 protrude from the front end opening 306*a* of the sleeve 306, and the brush-shaped grinding stone 304 is movable coaxially with the nut 341 in the axis L direction.

As illustrated in FIG. 20, the grinding member holder 381 includes: a holder body 382 that holds the linear grinding members 303; and a holder-side connecting part 383 for connecting the holder body 382 to the nut 341. The holder body 382 is cylindrical, and has the same outer diameter as the outer diameter of the nut 341. The holder-side connecting part 383 includes: a connecting tubular part 384 protruding backward coaxially from the annular rear end surface of the holder body 382; and an annular flange 385 spreading from the rear end edge of the connecting tubular part 384 toward the outer circumferential side.

The linear grinding members 303 are obtained by impregnating aggregate yarn of inorganic filaments, such as aluminum filaments, with a binder resin, and curing the resultant. Here, in the front face of the grinding member holder 381, a plurality of linear grinding member holding holes 386 is formed to be spaced from each other in the circumference of the spindle hole 381*a* (a center hole). The plurality of the linear grinding member holding holes 386 are circularly arranged so as to surround the spindle hole 381*a* of the holder body 382. Bundles of a plurality of the linear grinding members 303 each are formed, and the rear end of each of the bundles is inserted into a corresponding one of the linear grinding member holding holes 386, and fixed to the grinding member holder 381 with an adhesive.

In the holder body 382, two threaded holes 382*a* extending in the radial direction are provided backward of the linear grinding member holding holes 386. The two threaded holes 382*a* are formed in 180-degree rotational symmetry about the axis L. Furthermore, each of threaded holes 382*a* is formed at the same angle position as that of a corresponding one of the nut-side threaded holes 342 provided in the nut. Each of the threaded holes 382*a* penetrates the holder body 382 in the radial direction. As illustrated in FIG. 21, a screw 344 for regulating rotation of the grinding member holder is screwed into each of the threaded holes 382*a*.

At the time of making the brush-shaped grinding stone 304 held by the tool holder 302, the nut 341 is positioned in the front end of the tool holder 302, and the nut-side connecting part 350 is exposed outside from the front end opening 306*a* of the sleeve 306. Then, as illustrated in FIG. 22(*a*), the brush-shaped grinding stone 304 is connected to the nut 341 from a direction perpendicular to the axis L. That is, the annular flange 385 of the holder-side connecting part 383 is inserted from a direction perpendicular to the axis L into the pair of the lateral groove parts 349 of the nut-side connecting part 350, while the connecting tubular part 384 of the holder-side connecting part 383 is inserted into the groove part 348 of the nut-side connecting part 350.

Here, the height (a dimension in the axis L direction) of the connecting tubular part 384 is equivalent to the depth (a dimension in the axis L direction) of the groove part 348 of the nut-side connecting part 350, meanwhile the width (a dimension in the axis L direction) of the annular flange 385 is smaller than the groove width (a dimension in the axis L direction) of the lateral groove part 349 of the nut-side connecting part 350. Hence, the brush-shaped grinding stone 304 is movable in the axis L direction by a distance equivalent to the difference between the width of the annular flange 385 and the groove width of the lateral groove part 349. That is, as illustrated in FIG. 22(*b*), the brush-shaped grinding stone 304 is connected to the nut 341 in a state that the brush-shaped grinding stone 304 is movable in the axis L direction between a first position 304A at which the annular flange 385 comes into contact with the side face of the front side of the lateral groove part 349 and a second position 304B at which the annular flange 385 comes into contact with the side face of the rear side of the lateral groove part 349. Furthermore, when the brush-shaped grinding stone 304 is connected to the nut 341, the front end part of the coil spring 347 inserted into the circular recess part 343 of the nut 341 comes into contact with the annular flange 385 of the brush-shaped grinding stone 304, whereby the brush-shaped grinding stone 304 is biased to the first position 304A, as illustrated in FIG. 21. Accordingly, while biased to the first position 304A, the brush-shaped grinding stone 304 is connected to the nut 341.

Furthermore, as illustrated in FIG. 22(*a*), the connecting tubular part 384 and the annular flange 385 included in the holder-side connecting part 383 are circular when viewed from the axis L direction, and the holder-side connecting part 383 is covered inside the nut-side connecting part 350. Accordingly, in a state of being movable relative to the nut 341 about the axis L, the brush-shaped grinding stone 304 is connected to the nut 341.

Next, the screw rod 305 and the sleeve 306 are moved relative to each other, and the grinding member holder of the brush-shaped grinding stone 304 is positioned inside the sleeve 306 together with the nut 341. This configuration brings the screw rod 305 into a state of being inserted into the spindle hole 381*a* of the grinding member holder 381. Here, the outer diameter of the screw rod 305 corresponds to the inner diameter of the spindle hole 381*a* of the grinding member holder 381, and the screw rod 305 is fitted to the spindle hole 381*a* in a state that the grinding member holder 381 is movable in the axis L direction.

Thereafter, the screw 344 for regulating rotation of the grinding member holder is screwed into each of the threaded holes 382*a* of the grinding member holder 381 via a corresponding one of the guide holes 352 of the sleeve 306. Then, as illustrated in FIG. 21, the tip surface of each of the screws 344 for regulating rotation of the grinding member holder is made to face a corresponding one of the groove-shaped flat surfaces 313 provided in the bolt portion 311 of the screw rod 305, with a slight clearance left between the screw 344 and the groove-shaped flat surface 313. This configuration brings the brush-shaped grinding stone 304 into a state of being prevented from rotating relative to the screw rod 305 about the axis L. That is, the brush-shaped grinding stone 304 is made to rotate integrally with the screw rod 305. Accordingly, when the shank 301 (the rear end portion of the screw rod 305) is connected to a head of a machining center to rotate the polishing tool unit 300, the brush-shaped grinding stone 304 rotates integrally with the shank 301, whereby polishing can be performed with high accuracy.

Furthermore, a state that the tip surface of each of the screws 344 for regulating rotation of the grinding member holder faces a corresponding one of the groove-shaped flat surfaces 313 of the screw rod 305 with a clearance left therebetween brings the brush-shaped grinding stone 304 into a state of being allowed to move in the axis L direction along the screw rod 305 by making the screw rod 305 serve as a guide.

Note that an end portion on the outer circumferential side of each of the screws 344 for regulating rotation of the grinding member holder is positioned inside each of the threaded holes 382*a* of the grinding member holder 381, and does not protrude toward the outer circumferential side of the grinding member holder 381. Furthermore, in the present embodiment, each of the screws 344 for regulating rotation of the grinding member holder is fixed to the threaded hole 382*a* with an adhesive, and the movement in the radial direction of each of the screws 344 for regulating rotation of the grinding member holder is regulated.

(Adjustment Operation of the Protruding Amount of Grinding Members)

Figure 23:
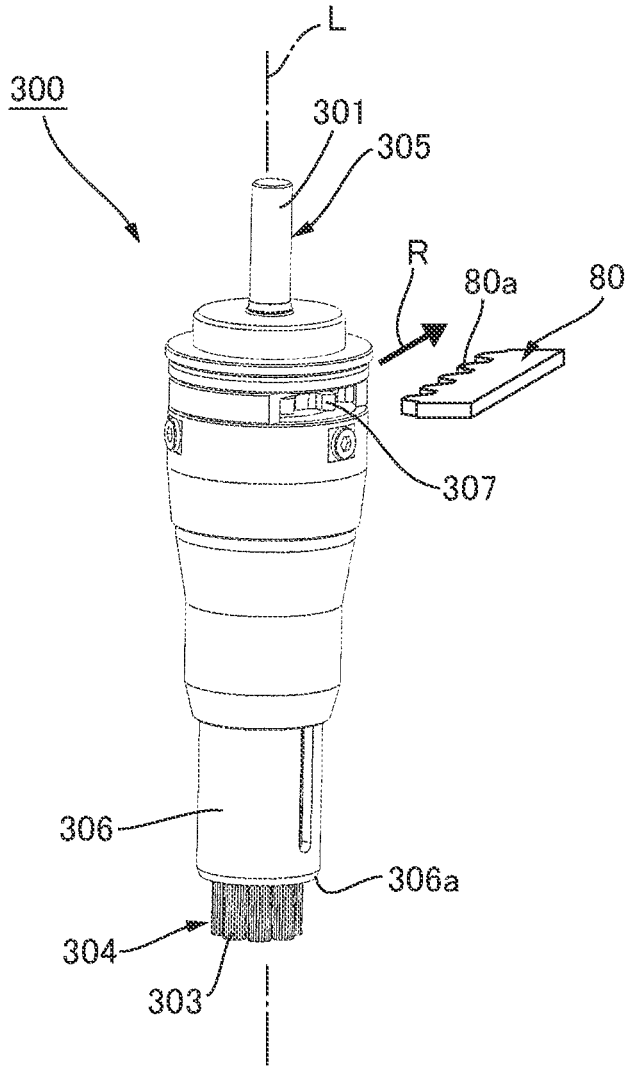
FIG. 23 is an illustration of an adjustment operation of adjusting the protruding amount of grinding members in the polishing tool unit illustrated in FIG. 18.

FIG. 23 is an illustration of an adjustment operation of adjusting the protruding amount of the grinding members in the polishing tool unit 300. In the polishing tool unit 300, the rear end portion of the screw rod 305 (the shank 301) is connected to a head of a machining center via, for example, a tool holder (not illustrated). Polishing, such as deburring or surface finishing, for a workpiece is performed by rotational-driving the polishing tool unit 300 connected to the head about the axis L. The position of the polishing tool unit 300 connected to the head is controlled by a control program configured to perform drive-control of the machining center.

Here, when the wear amount of the linear grinding members 303 reaches a predetermined wear amount, the machining center is driven by the control program to move the polishing tool unit 300 to a position for adjusting the protruding amount of the grinding members, in which the rack gear 80 is disposed. The rack gear 80 includes a gear tooth part 80*a* capable of being engaged with the gear 307 connected to the sleeve 306.

Next, the extension direction R of the gear tooth part 80*a* of the rack gear 80 and the axis L of the polishing tool unit 300 are made to intersect at right angles, and a gear tooth part of the gear 307 is engaged with the gear tooth part 80*a* of the rack gear 80. Thereafter, the polishing tool unit 300 is moved in the extension direction R of the gear tooth part 80*a*. With this, the gear 307 is rotated only by a predetermined rotation amount. Note that, instead of moving the polishing tool unit 300 in the extension direction R, the rack gear 80 may be moved in the extension direction R to rotate the gear 307 only by a predetermined rotation amount. Furthermore, the gear 307 may be rotated only by a predetermined rotation amount by moving both the polishing tool unit 300 and the rack gear 80 and thereby causing a relative movement between the polishing tool unit 1 and the rack gear 80 in the extension direction R.

When the gear 307 rotates, the gear 307 rotates integrally with the sleeve 306. Here, rotation of the nut 341 relative to the sleeve 306 about the axis L is regulated by the nut rotation regulating mechanism 354. Meanwhile, the screw rod 305 is held by the machining center, whereby the rotation of the screw rod 305 is regulated. Accordingly, the nut 341 moves in the axis L direction with rotation of the sleeve 306, whereby the brush-shaped grinding stone 304 is moved in the axis L direction. Thus, the linear grinding members 303 can protrude from the front end opening 306*a* of the sleeve 306 only by a movement amount corresponding to the rotation amount of the gear 307.

Here, rotation of the brush-shaped grinding stone 304 about the axis L is regulated by the tip surface of the screw 344 for regulating rotation of the grinding member holder and the groove-shaped flat surface 313 of the screw rod 305 facing each other. Accordingly, while rotating relative to the nut 341, the brush-shaped grinding stone 304 is moved along the screw rod 305 in the axis L direction.

Note that, when the direction of the relative movement between the polishing tool unit 300 and the rack gear 80 is made into the opposite direction, the linear grinding members 303 can be returned inside the front end opening 306*a* of the sleeve 306 only by a movement amount corresponding to the rotation amount of the gear 307.

Also in the present embodiment, the same advantageous effects as in the polishing tool unit 1 of Embodiment 1 can be achieved.

Furthermore, in the present embodiment, the brush-shaped grinding stone 304 is movable between the first position 304A and the second position 304B on the nut 341, and supported at the first position 304A in the front by the coil spring 364. Accordingly, when the force of pushing the brush-shaped grinding stone 304 into the sleeve 306 from a process-target workpiece side works during processing operation, the brush-shaped grinding stone 304 is moved backward in the axis L direction, whereby breakage of the brush-shaped grinding stone 304 and wear of the grinding members can be reduced.

Note that, in the present embodiment, the formation of a rod through hole penetrating the screw rod 305 in the axis L direction allows machining oil and air to be supplied via the rod through hole, whereby a processed part can be cooled, for example.

Embodiment 5

Figure 24:
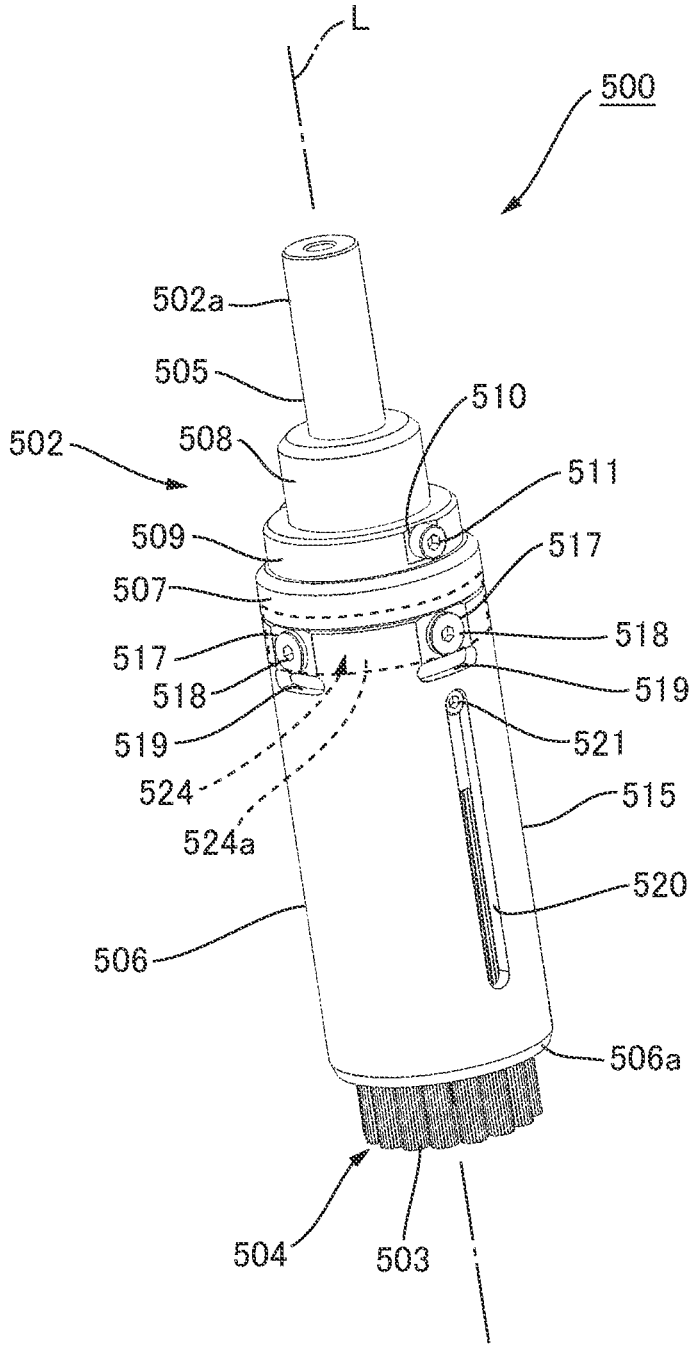
FIG. 24 is a perspective view of a polishing tool unit of Embodiment 5 to which the present invention is applied.

FIG. 24 is a perspective view of a polishing tool unit 500 of Embodiment 5 to which the present invention is applied. As illustrated in FIG. 24, the polishing tool unit 500 of the present embodiment includes: a tool holder 502 including a shank 502*a* serving as a part attached to a machine tool; and a brush-shaped grinding stone (a polishing tool) 504 including linear grinding members 503 protruding from the front end of the tool holder 502, the front end being on the opposite side of the tool holder 502 from the shank 502*a*.

(Tool Holder)

The tool holder 502 includes a shank head 505 and a sleeve 506 coaxially in the axis L direction in order from the shank 502*a* side. The shank head 505 includes the shank 502*a*, a disk part 507, and a first connecting disk part 508 and a second connecting disk part 509 that connect between the disk part 507 and the shank 502*a*. The first connecting disk part 508 is provided between the second connecting disk part 509 and the shank 502*a*. The outer diameter of the first connecting disk part 508 is larger than the outer diameter of the shank 502*a*, and smaller than the outer diameter of the second connecting disk part 509. The length of the first connecting disk part 508 in the axis L direction is larger than the length of the second connecting disk part 509. The outer diameter of the second connecting disk part 509 is smaller than the outer diameter of the disk part 507.

The second connecting disk part 509 is provided with two threaded holes 510 extending in the radial direction. The two threaded holes 510 are formed in 180-degree rotational symmetry about the axis L. A cam pin 511 including a threaded part is screwed into each of the threaded holes 510.

The sleeve 506 includes a tube part 515 extending in the axis L direction. The diameter of the tube part 515 is constant. The rear end portion of the tube part 515 is provided with four sleeve-side through holes 517. The four sleeve-side through holes 517 are formed in 90-degree rotational symmetry about the axis L.

Here, an annular member 524 is coaxially fixed to the front end portion of the shank head 505. The annular member 524 includes a protruding portion 524*a* protruding forward from the disk part 507 by a constant width. The rear end portion of the sleeve 506 is fitted into the outer circumferential side of the protruding portion 524*a*. The sleeve 506 is fixed to the annular member 524 by a fixing screw 518 penetrating each of the sleeve-side through holes 517.

A long hole 519 extending in the circumferential direction is provided forward of each of the sleeve-side through holes 517. The tube part 515 is provided with two guide holes 520 having a groove shape and extending in the axis L direction. The two guide holes 520 are formed in 180-degree rotational symmetry about the axis L. Any of the guide holes 520 is formed forward of the long hole 519. Accordingly, each of the two long holes 519 and a corresponding one of the guide holes 520 overlap each other when viewed from the axis L direction. A rotation regulating screw 521 is positioned inside the guide hole 520.

Figure 25:
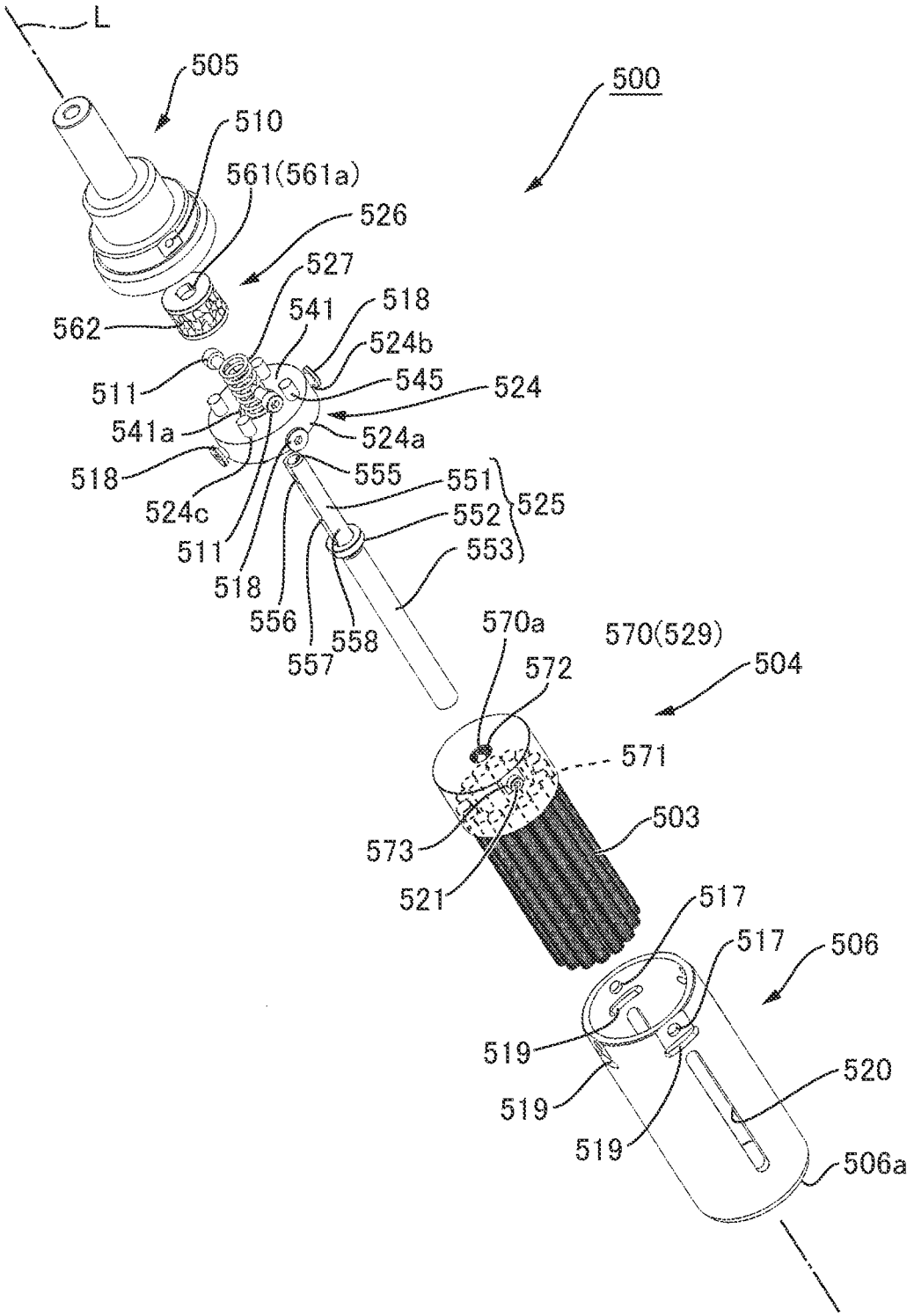
FIG. 25 is an exploded perspective view from the rear of the polishing tool unit illustrated in FIG. 24.
Figure 26:
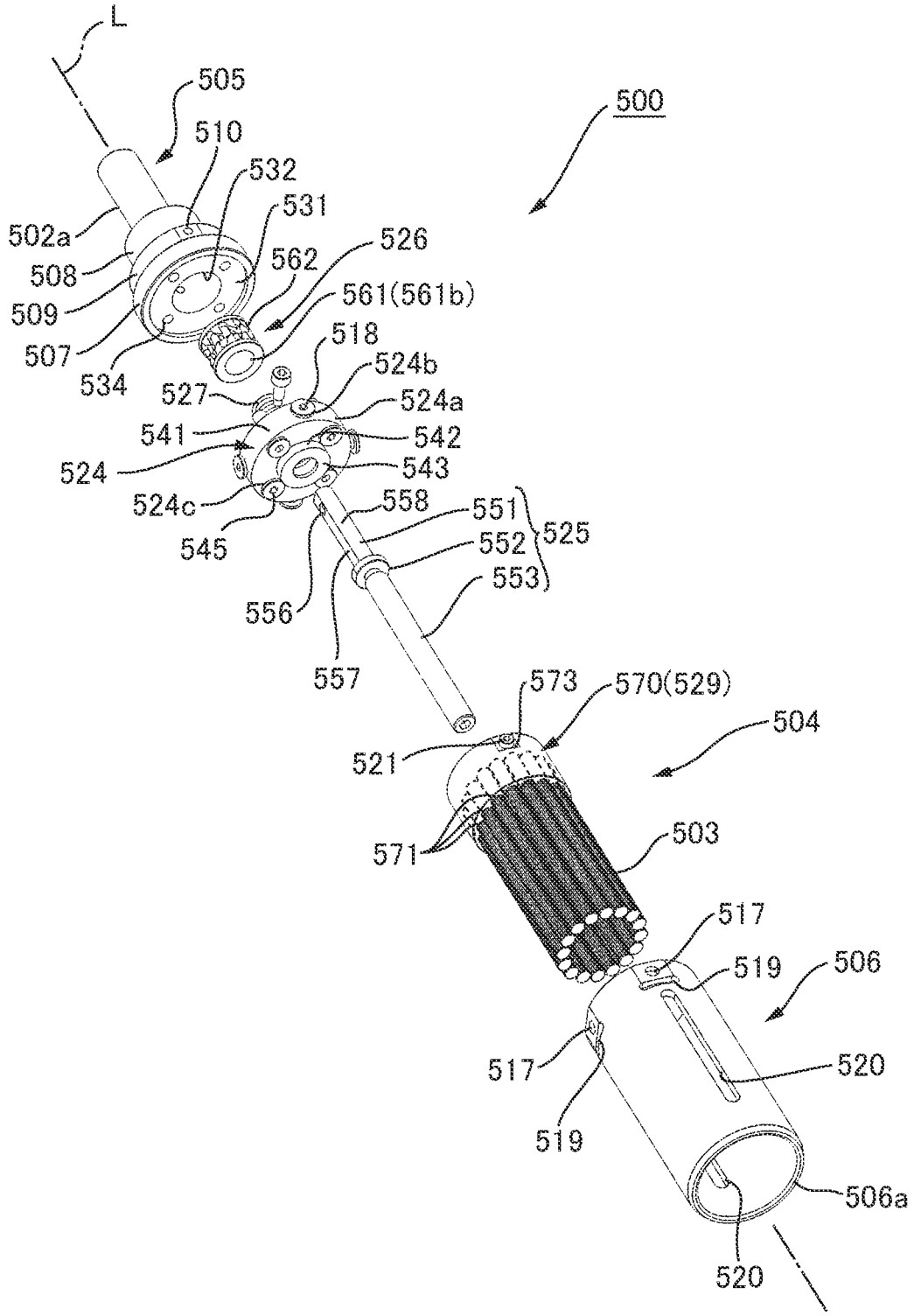
FIG. 26 is an exploded perspective view from the front of the polishing tool unit illustrated in FIG. 24.
Figure 27:
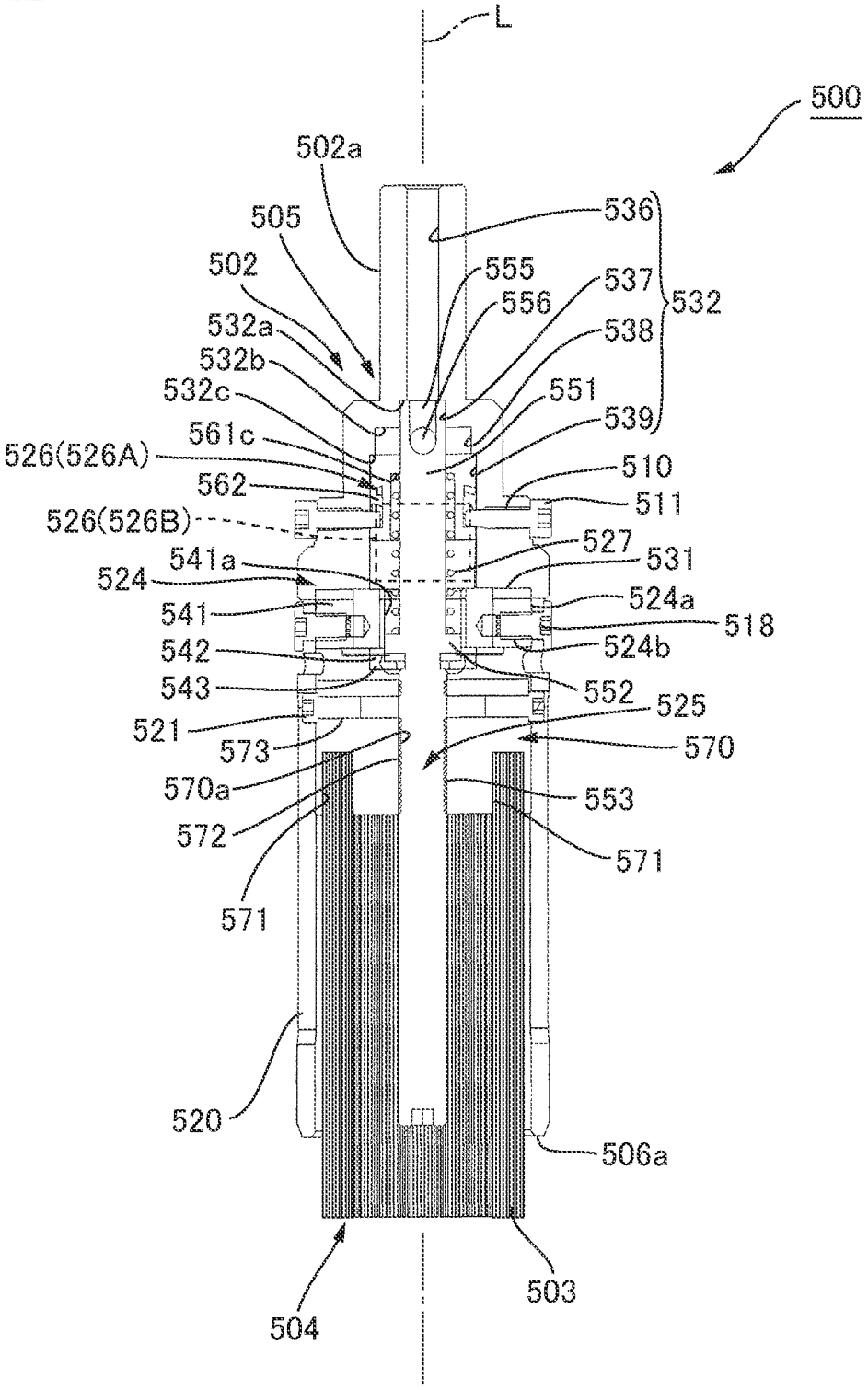
FIG. 27 is a longitudinal sectional view of the polishing tool unit illustrated in FIG. 24.

FIG. 25 is an exploded perspective view from the rear of the polishing tool unit 500 illustrated in FIG. 24. FIG. 26 is an exploded perspective view from the front of the polishing tool unit 500 illustrated in FIG. 24. FIG. 27 is a longitudinal sectional view of the polishing tool unit 500 illustrated in FIG. 24, the view being cut through a position passing through the guide holes 520. As illustrated in FIG. 25 to FIG. 27, the tool holder 502 includes the annular member 524, a shaft 525, a lead cam 526, and a coil spring (a biasing member) 527, inside the shank head 505 and the sleeve 506. The tool holder 502 further includes a nut 529 screwed onto a bolt portion 553 provided in the shaft 525. In the present embodiment, the nut 529 is provided integrally with the brush-shaped grinding stone 504.

As illustrated in FIG. 26, a recess part 531 is provided in the front face of the shank head 505. The rear side of the annular member 524 is inserted and fitted into the recess part 531. The front end opening of the head center hole 532 penetrating the shank 502*a*, the first connecting disk part 508, the second connecting disk part 509, and the disk part 507 in the axis L direction is exposed at the center of the recess part 531. Four threaded holes 534 for fixing the annular member are formed on the outer circumferential side of the head center hole 532 in the bottom of the recess part 531.

As illustrated in FIG. 27, the head center hole 532 includes, in order from the rear toward the front: a first center hole portion 536; a second center hole portion 537 having an inner diameter larger than that of the first center hole portion 536; a third center hole portion 538 having an inner diameter larger than that of the second center hole portion 537; and a fourth center hole portion 539 having an inner diameter larger than that of the third center hole portion 538. Accordingly, a first forward-facing annular surface 532*a* formed between the first center hole portion 536 and the second center hole portion 537; a second forward-facing annular surface 532*b* formed between the second center hole portion 537 and the third center hole portion 538; and a third forward-facing annular surface 532*c* formed between the third center hole portion 538 and the fourth center hole portion 539 are formed in the inner circumferential surface of the head center hole 532.

The first center hole portion 536 penetrates the shank 502*a*. The first center hole portion 536 is a coolant inlet hole into which a pressurized coolant is supplied from a machine tool connected to the shank 502*a*. Here, the threaded hole 510 formed in the second connecting disk part 509 penetrates the fourth center hole portion 539. Accordingly, the tip portion of the cam pin 511 screwed into the threaded hole 510 protrudes into the fourth center hole portion 539.

As illustrated in FIG. 26, the annular member 524 includes: an annular member body part 541; a tube part 542 protruding forward coaxially with the annular member body part 541 from the center portion of the front face of the annular member body part 541; and an annular plate part 543 protruding from the front end of the tube part 542 to the inner circumferential side. As illustrated in FIG. 27, a center hole 541*a* of the annular member body part 541 has an inner diameter slightly smaller than the inner diameter of the third center hole portion 538. The inner circumferential surface of the center hole 541*a* and the inner circumferential surface of the tube part 542 are continued without steps. As illustrated in FIG. 26, the annular member body part 541 is provided with four through holes 524*c* penetrating in the axis L direction.

The rear end portion of the annular member 524 is fitted into the recess part 531 of the shank head 505. Then, the annular member 524 is fixed to the shank head 505 by four screws 545 for fixing the annular member each of which is inserted into a corresponding one of the through holes 524*c* from the front and screwed into the threaded hole 534 for fixing the annular member in the shank head 505. When the annular member 524 is fixed to the shank head 505, the annular member 524 includes a protruding portion 524*a* protruding forward from the shank head 505. Furthermore, when the annular member 524 is fixed to the shank head 505, the space (the fourth center hole portion 539) between the third forward-facing annular surface 532*c* and the rear end surface of the annular member 524 is marked off as a the cam housing in which the lead cam 526 is disposed.

In the annular outer circumferential surface of the protruding portion 524*a*, four threaded holes 524*b* for fixing the sleeve are formed in 90-degree rotational symmetry about the axis L. The sleeve 506 is fixed to the annular member 524 by the fixing screw 518 that penetrates each of the sleeve-side through holes 517 and is screwed into the threaded hole 524*b* for fixing the sleeve.

As illustrated in FIG. 25, the shaft 525 is disposed coaxially with the shank 502*a* on the inner circumferential sides of the shank head 505, the annular member 524, and the sleeve 506. The shaft 525 includes, in order from the rear toward the front, a cam supporting portion 551, a flange portion 552, and a bolt portion 553. As illustrated in FIG. 27, the lead cam 526 is supported by the cam supporting portion 551, and disposed coaxially with the shank 502*a*.

The cam supporting portion 551 includes a shaft-side coolant inlet hole 555 extending from the rear end surface of the cam supporting portion 551 in the axis L direction only by a predetermined length. The cam supporting portion 551 further includes a coolant outlet hole 556 extending in a direction perpendicular to the axis L and communicating with the front end portion of the shaft-side coolant inlet hole 555. As illustrated in FIG. 25, the cam supporting portion 551 further includes: a pair of parallel surfaces 557 extending in parallel on both sides of the axis L; and a pair of arc-shaped surfaces 558 connecting between the pair of the parallel surfaces 557.

The flange portion 552 has a diameter larger than those of the cam supporting portion 551 and the bolt portion 553. Furthermore, as illustrated in FIG. 27, the outer diameter of the flange portion 552 is smaller than the inner diameters of the center hole 541*a* and the tube part 542 of the annular member 524, and larger than the inner diameter of the annular plate part 543. The outer diameter of the bolt portion 553 is smaller than the inner diameter of the annular plate part 543. The bolt portion 553 includes a male thread in the outer circumferential surface.

The lead cam 526 has a cylinder shape as a whole, and the outer diameter thereof is smaller than the inner diameter of the cam housing (the fourth center hole portion 539). The lead cam 526 includes a shaft insertion hole 561 at the center, the hole 561 penetrating in the axis L direction. The shaft insertion hole 561 includes, from the rear toward the front, a small-diameter hole portion 561*a*, and a large-diameter hole portion 561*b* having an inner diameter larger than that of the small-diameter hole portion 561*a*.

As illustrated in FIG. 25, the shape of the shaft insertion hole 561 when viewed from the rear in the axis L direction (the shape of the small-diameter hole portion 561*a*) corresponds to the shape of the cam supporting portion 551 of the shaft 525 when viewed from the axis L direction. Accordingly, when the cam supporting portion 551 is inserted into the shaft insertion hole 561 and the lead cam 526 is supported by the shaft 525, the lead cam 526 is brought into a state of making the cam supporting portion 551 movable in the axis L direction and being incapable of moving relative to the shaft 525. The shape of the shaft insertion hole 561 when viewed from the front in the axis L direction (the shape of the large-diameter hole portion 561*b*) is circular. Here, the coil spring 527 is disposed on the outer circumferential side of the cam supporting portion 551. The front end of the coil spring 527 comes into contact with the flange portion 552. The rear side of the coil spring 527 is inserted into the large-diameter hole portion 561*b* of the lead cam 526. The rear end of the coil spring 527 is in contact with a forward-facing annular surface 561*c* (refer to FIG. 27) formed between the small-diameter hole portion 561*a* and the large-diameter hole portion 561*b*.

Figure 28:
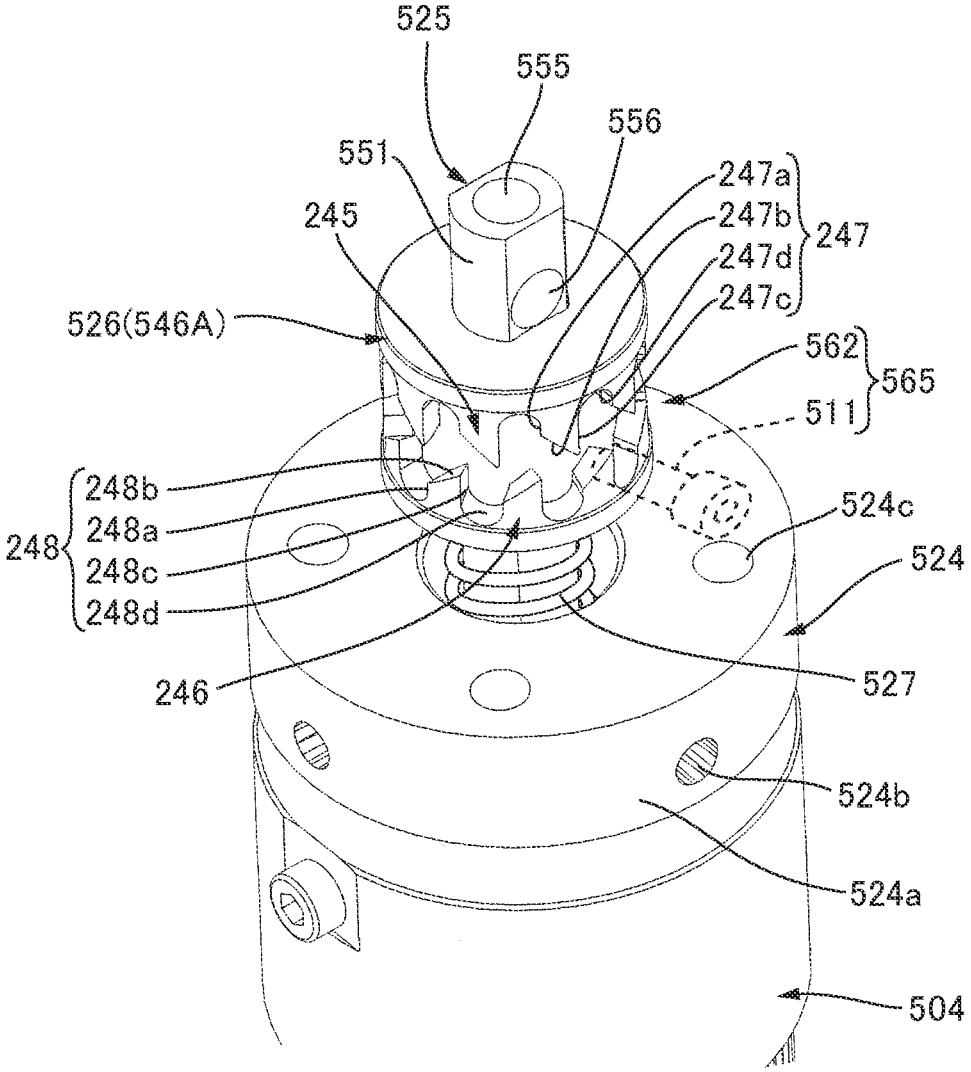
FIG. 28 is a partial perspective view of a lead cam and surroundings thereof of the polishing tool unit illustrated in FIG. 24.

Furthermore, the lead cam 526 includes a cam 562 in the outer circumferential surface. FIG. 28 is an enlarged partial view of the lead cam 526 and surroundings thereof. As illustrated in FIG. 28, the cam 562 includes rear-side cam surfaces 247 formed in a plurality of the rear-side protruding parts 245, and front-side cam surfaces 248 formed in a plurality of the front-side protruding parts 246. The rear-side cam surface 247 includes a rear-side first cam surface portion 247*a*, a rear-side inclined cam surface portion 247*b*, a rear-side second cam surface portion 247*c*, and a rear-side arc-shaped surface 247*d*. The front-side cam surface 248 includes a front-side first cam surface portion 248*a*, a front-side inclined cam surface portion 248*b*, a front-side second cam surface portion 248*c*, and a front-side arc-shaped surface 248*d*. The tip part of the cam pin 511 screwed into the shank head 505 from the radial direction slides in the cam 562. Note that the cam 562 shares a common form with the cam 241 of the polishing tool unit 200 of Embodiment 3, and hence, common reference signs are given to common portions, and descriptions thereof are omitted.

When the annular member 524 is fixed to the shank head 505, the shaft 525 is inserted into the annular member 524 from the rear to create a state that the bolt portion 553 protrudes forward from the annular member 524. In this state, the flange portion 552 is positioned inside the annular member body part 541 and the tube part 542 of the annular member 524. Furthermore, when the annular member 524 is fixed to the shank head 505, the cam supporting portion 551 is inserted into the shaft insertion hole 561, and the lead cam 526 is supported by the shaft 525. Thereafter, the shaft 525 and the lead cam 526 are inserted into the head center hole 532, and the annular member 524 is fixed to the shank head 505.

In a state that the annular member 524 is fixed to the shank head 505, the rear end portion of the shaft 525 is inserted into the second center hole portion 537 of the head center hole 532, as illustrated in FIG. 27. With this configuration, the first center hole portion 536 (the coolant inlet hole) communicates with the shaft-side coolant inlet hole 555 and the coolant outlet hole 556. The coolant outlet hole 556 is positioned on the inner circumferential side of the third center hole portion 538, and the bolt portion 553 is positioned on the inner circumferential side of the sleeve 506. The front end of the bolt portion 553 is positioned backward of the front end opening 506*a* of the sleeve 506. The shaft 525 is rotatable relative to the shank head 505 (the shank 502*a*), the annular member 524, and the sleeve 506 about the axis L.

In a state that the annular member 524 is fixed to the shank head 505, the lead cam 526 is disposed in the cam housing (the fourth center hole portion 539). Then, the lead cam 526 is biased by the coil spring 527 to a rear-side position (a second position) 526A that comes into contact with the third forward-facing annular surface 532*c*. Note that, after the lead cam 526 is positioned in the cam housing, the cam pin 511 is screwed into the lead cam 526, whereby the tip portion of the cam pin 511 is inserted into the cam 562 of the lead cam 526.

Here, the lead cam 526 is movable, along the cam supporting portion 551, between the rear-side position (the second position) 526A and a front-side position (a first position) 526B spaced forward from the rear-side position 526A in the axis L direction. The rear-side position 526A is a position at which the lead cam 526 comes into contact with the third forward-facing annular surface 532*c*, and a position at which the cam pin 511 comes into contact with the front-side protruding part 246. The front-side position 526B is a position at which the lead cam 526 comes into contact with the annular member 524, and a position at which the cam pin 511 comes into contact with the rear-side protruding part 245. Note that the lead cam 526 is usually biased to the rear-side position 526A by the coil spring 527. Accordingly, the cam pin 511 is usually in contact with the front-side arc-shaped surface 248*d* between the front-side protruding parts 246.

When a linear reciprocating motion of the lead cam 526 from the rear-side position 526A via the front-side position 526B back to the rear-side position 526A is made, the cam pin 511 slides in the front-side cam surface 248 and the rear-side cam surface 247 of the cam 562, whereby this reciprocating motion is converted into a rotational motion of the lead cam 526 at a certain angle about the axis L in a single direction. That is, the cam 562 and the cam pin 511 constitute a motion converting mechanism 565 configured to convert the linear reciprocating motion of the lead cam 526 into the rotational motion thereof. Here, when the lead cam 526 rotates, the shaft 525 rotates integrally with the lead cam 526.

(Brush-Shaped Grinding Stone)

As illustrated in FIG. 25, the brush-shaped grinding stone 504 includes the linear grinding members 503, and a grinding member holder 570 that holds the rear-side portions of the linear grinding members 503. The grinding member holder 570 doubles as the nut 529 of the tool holder 502.

The grinding member holder 570 is tubular (annular), and includes a spindle hole 570*a* which the shaft 525 penetrates. In the front face of the grinding member holder 570, a plurality of linear grinding member holding holes 571 are formed in the circumference of the spindle hole 570*a* as illustrated in FIG. 26. The plurality of the linear grinding member holding holes 571 is annularly arranged at equiangular intervals so as to surround the spindle hole 570*a*. The linear grinding members 503 are obtained by impregnating aggregate yarn of inorganic filaments, such as aluminum filaments, with a binder resin, and curing the resultant. Bundles of a plurality of the linear grinding members 503 each are formed, and the rear end of each of the bundles is inserted into a corresponding one of the linear grinding member holding holes 571, and fixed to the grinding member holder 570 with an adhesive.

As illustrated in FIG. 27, a female thread 572 that allows the grinding member holder 570 to be screwed onto the bolt portion 553 of the shaft 525 is formed in the inner circumferential surface of the spindle hole 570*a*. Furthermore, the grinding member holder 570 is provided with two threaded holes 573 perpendicular to the axis L and penetrating in the radial direction. The two threaded holes 573 are formed in 180-degree rotational symmetry about the axis L.

At the time of making such brush-shaped grinding stone 504 held by the tool holder 502, the grinding member holder 570 is screwed onto the bolt portion 553 of the shaft 525 and disposed inside the sleeve 506. Then, the rotation regulating screw 521 is screwed into the two threaded holes 573 via the guide hole 520.

In a state that the rotation regulating screw 521 is screwed into each of the threaded holes 573 from the outside of a corresponding one of the guide holes 520, the head part of the rotation regulating screw 521 (an end portion on the outer circumferential side of the rotation regulating screw 521) is positioned inside the guide hole 520. Accordingly, if the grinding member holder 570 (the nut 529) is about to rotate about the axis L, the head part of each of the rotation regulating screws 521 comes into contact with the inner circumferential wall of a corresponding one of the guide holes 520 from the circumferential direction, thereby preventing the rotation. That is, the two guide holes 520 and the two rotation regulating screws 521 screwed into the grinding member holder 570 constitute a nut rotation regulating mechanism 575 configured to regulate the rotation of the grinding member holder 570 (the nut 529) about the axis L. The nut rotation regulating mechanism 575 allows the movement of the grinding member holder 570 (the nut 529) in the axis L direction.

(Adjustment Operation of the Protruding Amount of Grinding Members)

Figure 29A:
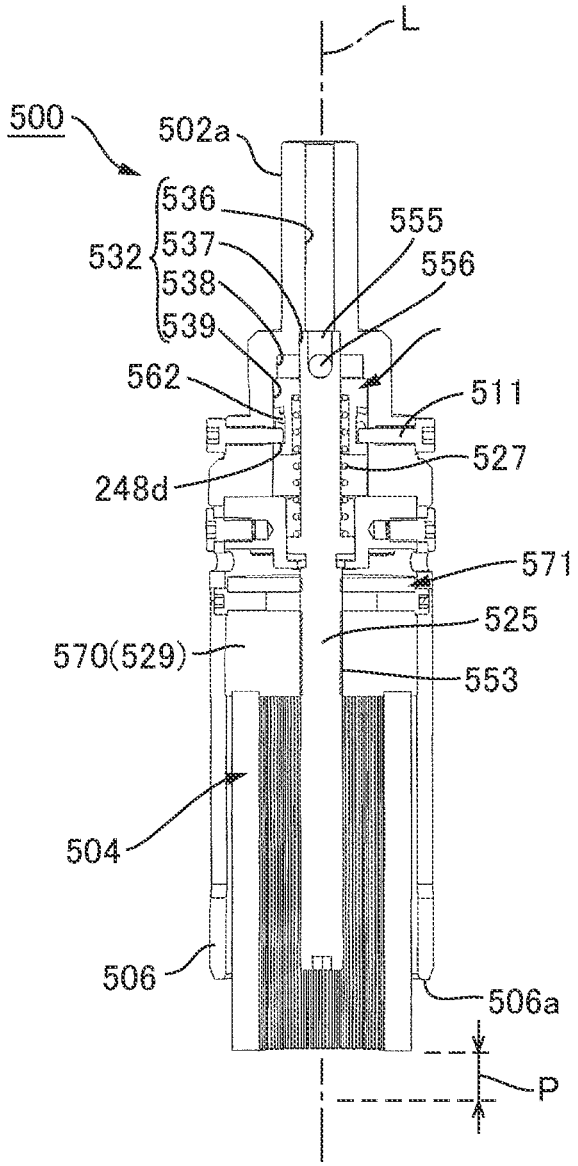
FIG. 29 is an illustration of an adjustment operation of adjusting the protruding amount of grinding members in the polishing tool unit illustrated in FIG. 24.
Figure 29B:
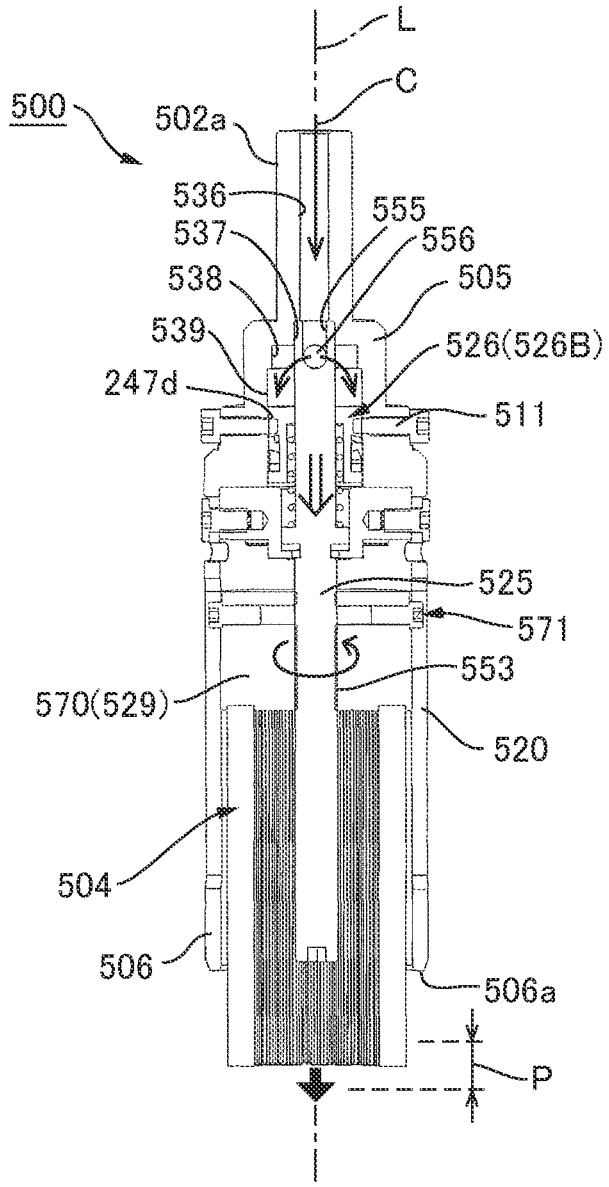
Figure 29C:
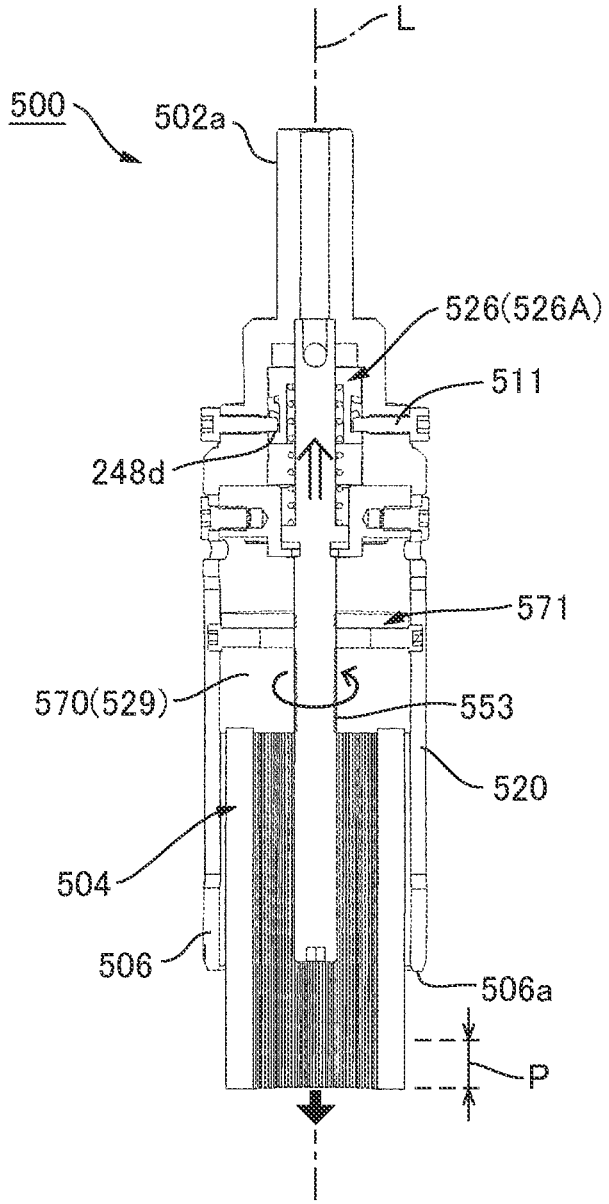

FIG. 29 is an illustration of an adjustment operation of adjusting the protruding amount of grinding members in the polishing tool unit 500 illustrated in FIG. 24. In the polishing tool unit 500, the shank 502*a* is connected to a head of a machining center via, for example, a tool holder (not illustrated). The machining center has a coolant feeder for feeding a pressurized coolant to a tool or the like that is connected with the head. In a state that the polishing tool unit 500 is connected to the machining center, the lead cam 526 is biased to the rear-side position 526A by the coil spring 527, as illustrated in FIG. 29(*a*).

When the wear amount of the linear grinding members 503 reaches a predetermined wear amount due to processing operation, the machining center is driven by a control program to supply a pressurized coolant C from the head to the polishing tool unit 500.

The coolant C supplied from the machining center is introduced into the head center hole 532 of the shank head 505. More specifically, the coolant C is introduced from the first center hole portion 536 (a coolant inlet hole) of the head center hole 532 via the shaft-side coolant inlet hole 555 and the coolant outlet hole 556 into the third center hole portion 538 and the fourth center hole portion 539. As illustrated in FIG. 29(*b*), when the coolant C is introduced into the fourth center hole portion 539, the fluid pressure of the coolant C causes the lead cam 526 to move from the rear-side position 526A (the second position) to the front-side position 526B (the first position) against the biasing force of the coil spring 527.

At the time when the lead cam 526 moves to the front-side position 526B, as is the case with the adjustment operation of the grinding member protruding amount in Embodiment 3 illustrated in FIGS. 17(*c*) to 17(*e*), the cam pin 511 moves from the front-side arc-shaped surface 248*d* of the cam 562 to the rear-side protruding part 245 side, and comes into sliding-contact with the rear-side inclined cam surface portion 247*b* of the rear-side protruding part 245. Thereafter, the cam pin 511 moves from the rear-side inclined cam surface portion 247*b* via the rear-side first cam surface portion 247*a* to the rear-side arc-shaped surface 247*d*. Here, the cam pin 511 is fixed to the shank head 505, and the lead cam 526 is rotatable about the axis L. Accordingly, when the cam pin 511 comes into sliding-contact with the rear-side inclined cam surface portion 247*b*, the lead cam 526 rotates only by a certain angle in a single direction. Thus, the shaft 525 rotates together with the lead cam 526 only by a certain angle in a single direction. Furthermore, rotation of the grinding member holder 570 (the nut 529) about the axis L is regulated by the nut rotation regulating mechanism 575. Accordingly, the grinding member holder 570 (the nut 529) moves in the axis L direction with the rotation of the shaft 525. As a result, the brush-shaped grinding stone 504 moves forward in the axis L direction.

Thereafter, when the supply of the coolant C is stopped, the introduced coolant C flows downward through a gap between parts, such as between the lead cam 526 and the cam housing (the fourth center hole portion 539), and is conveyed to the brush-shaped grinding stone 504. Furthermore, the coolant C is discharged from the guide hole 520 to the outside of the sleeve 506. Here, when the fluid pressure of the coolant C decreases, the lead cam 526 returns from the front-side position 526B (the first position) to the rear-side position 526A (the second position) by the biasing force of the coil spring 527 as illustrated in FIG. 29(*c*).

At the time when the lead cam 526 returns to the rear-side position 526A, as is the case with the adjustment operation of the grinding member protruding amount in Embodiment 3 illustrated in FIGS. 17(*a*) to 17(*c*), the cam pin 511 moves from the rear-side arc-shaped surface 247*d* to the front-side protruding part 246 side, and comes into sliding-contact with the front-side inclined cam surface portion 248*b* of the front-side protruding part 246. Thereafter, the cam pin 511 moves from the front-side inclined cam surface portion 248*b* via the front-side first cam surface portion 248*a* to the front-side arc-shaped surface 248*d*. Here, the cam pin 511 is fixed to the shank head 505, and the lead cam 526 is rotatable about the axis L. Accordingly, when the cam pin 511 comes into sliding-contact with the front-side inclined cam surface portion 248*b*, the lead cam 526 rotates only by a certain angle in a single direction. Thus, the shaft 525 rotates together with the lead cam 526 only by a certain angle in a single direction. Furthermore, rotation of the grinding member holder 570 (the nut 529) about the axis L is regulated by the nut rotation regulating mechanism 575. Accordingly, the grinding member holder 570 (the nut 529) moves in the axis L direction with the rotation of the shaft 525. As a result, the brush-shaped grinding stone 504 moves forward in the axis L direction.

With these operations, the grinding member holder 570 (the nut 529) moves forward only by a movement amount corresponding to the rotation amount of the shaft 525 while the lead cam 526 returns from the rear-side position 526A via the front-side position 526B to the rear-side position 526A. Accordingly, the supply of the coolant C from the machining center to the polishing tool unit 500 allows the linear grinding members 503 to protrude from the front end opening 506*a* of the sleeve 506 only by a predetermined grinding member protruding amount P.

According to the present embodiment, it is not necessary to use a rack gear or a protruding amount adjusting member for the purpose of performing an operation of adjusting the protruding amount of grinding members. Furthermore, it is not necessary to move the polishing tool unit 500 to a position for adjusting the grinding member protruding amount at which the rack gear or the protruding amount adjusting member is disposed, for the purpose of performing an operation of adjusting the protruding amount of grinding members. Accordingly, in the machining center, after a tool is changed to the polishing tool unit 500 by an automatic tool changing apparatus, an operation of adjusting the protruding amount of grinding members can be performed while the polishing tool unit 500 is moved to a process starting position. Thus, the use of the polishing tool unit 500 of the present embodiment makes it possible to improve throughput of processing operation.

Note that an insertion screw may be used for forming the female thread 572 in the inner circumferential surface of the spindle hole 570*a* of the grinding member holder 570. Furthermore, in the case where the grinding member holder 570 is made of aluminum, and the shaft 525 (the bolt portion 553) is made of, for example, carbon steel, anodizing of the inner circumferential surface of the spindle hole 570*a* makes it possible to enhance the durability of the female thread 572.

Other Embodiments

The polishing tool units 1, 100, and 200 of the respective Embodiments 1 to 3 may be configured such that the nuts 36, 142, and 242 of the respective tool holders 2, 102, and 202 are formed integrally with the grinding member holders 61, 150, and 255 of the respective brush-shaped grinding stones 4, 104, and 204, respectively, and the grinding member holders 61, 150, and 255 double as the nuts 36, 142, and 242, respectively. That is, in the polishing tool units 1, 100, and 200, the brush-shaped grinding stone 504 described in Embodiment 5 may be employed. Such employment allows the number of parts in the polishing tool units 1, 100, and 200 to be reduced. Furthermore, in the polishing tool unit 500 of Embodiment 5, as is the cases with Embodiments 1 to 3, the brush-shaped grinding stones 4, 104, and 204 are connected to the respective nuts 36, 142, and 242, and the resultant connected parts may be used in place of the brush-shaped grinding stone 504.

Figure 30A:
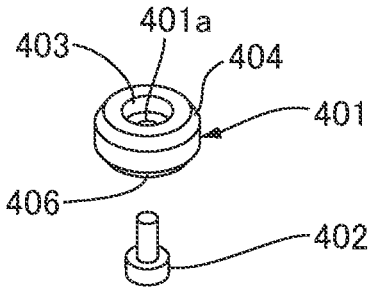
FIG. 30 is an illustration of a top member to be attached to a tool holder.
Figure 30B:
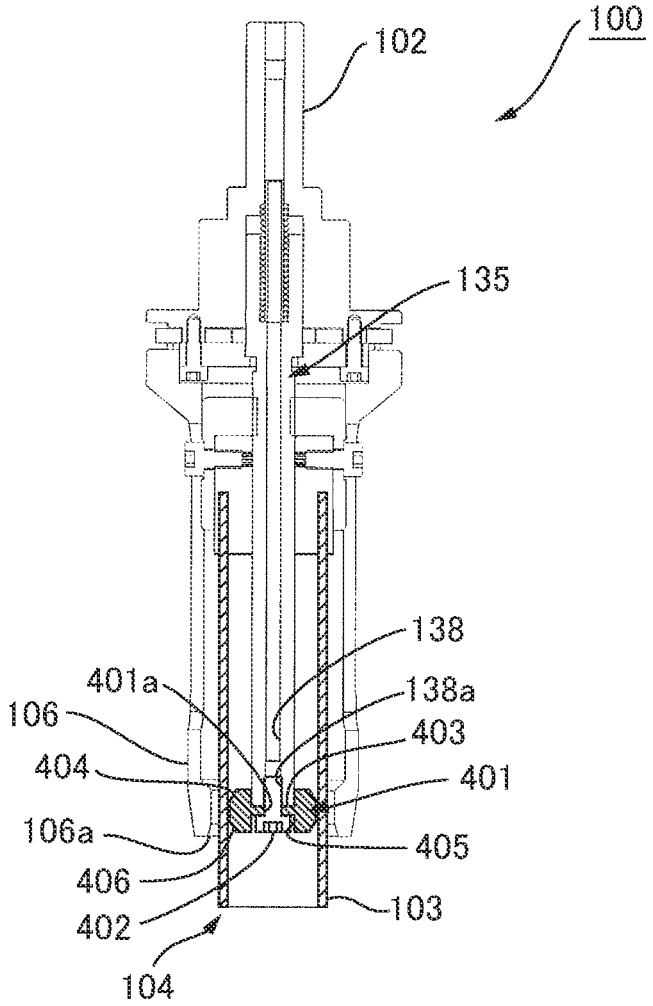

In Embodiments 1 to 4, a top member for regulating displacement of the linear grinding members may be attached to the tip portion of a shaft, such as the gear screw or the cam screw. FIG. 30(*a*) is a perspective view of a top member and a headed screw for fixing the top member to a shaft, and FIG. 30(*b*) is a sectional view of the polishing tool unit 100 of Embodiment 2 to which a top member is attached.

As illustrated in FIG. 30(*a*), a top member 401 has a disk shape, and includes a center hole 401*a* at the center. The top member 401 further includes a rear-side recess part 403 coaxial with the center hole 401*a*, in the rear end surface. The rear-side recess part 403 has a shape that allows the front end portion of a shaft, such as the gear screw or the cam screw, to be inserted thereinto. A rear-side tapered surface 404 that is inclined forward to the outer circumferential side is formed in the outer circumferential edge portion of the rear end surface of the top member 401. The top member 401 further includes a front-side recess part 405 coaxial with the center hole 401*a*, in the front end surface. The front-side recess part 405 has a shape that allows the head part of the headed screw 402 to be inserted thereinto. A front-side tapered surface 406 that is inclined backward to the outer circumferential side is formed in the outer circumferential edge portion of the front end surface of the top member 401. The top member 401 of the present embodiment has symmetry with respect to a virtual plane perpendicular to the axial line L.

As illustrated in FIG. 30(*b*), in the case where a comparatively large gap is formed between the linear grinding members 103 and the gear screw (a shaft) 135 when the brush-shaped grinding stone 104 is held by the tool holder 102, the top member 401 is attached to the front end portion of the gear screw 135 and disposed inside a plurality of the linear grinding members 103.

At the time of attaching the top member 401 to the gear screw 135, the top member 401 is inserted into the inner circumferential side of the linear grinding members 103 surrounding the gear screw 135. Then, the front end portion of the gear screw 135 is inserted into the rear-side recess part 403 of the top member 401. Thereafter, the threaded part of the headed screw 402 is made to penetrate the center hole 401*a* of the top member 401 from the front, and is screwed into the threaded part 138*a* formed in the inner circumferential surface of the front end portion of the screw center hole 138 of the gear screw 135. With this, the top member 401 is fixed to the front end portion of the gear screw 135, and the head part of the headed screw 402 is positioned inside the front-side recess part 405. Here, the top member 401 includes the rear-side tapered surface 404. Accordingly, even in the case where the linear grinding members 103 contain a broken one, the top member 401 can be inserted inside the linear grinding members 103 without being caught on the broken linear grinding member 103.

In a state that the top member 401 is attached to the gear screw 135, if the linear grinding members 103 are about to escape to the inner circumferential side during processing by rotation of the polishing tool unit 100, the linear grinding members 103 abut on the top member 401, so that the escape (displacement) can be prevented. By contrast, if the linear grinding members 103 are about to escape to the outer circumferential side, the linear grinding members 103 abut on the inner surface of the circumferential wall of the sleeve 106, so that the escape can be prevented. Accordingly, the difference in ease of escape between the linear grinding members 103 positioned on the inner circumferential side and the linear grinding members 103 positioned on the outer circumferential side is eliminated. As a result, no difference in rigidity is made between the linear grinding members 103 positioned on the inner circumferential side and the linear grinding members 103 positioned on the outer circumferential side, and consequently, a situation can be avoided in which the linear grinding members 103 positioned on the inner circumferential side is less worn than the linear grinding members 103 positioned on the outer circumferential side, and thus, the linear grinding members 103 are uniformly worn.

Note that, with the preparation of a plurality of members as the top members 401 that have front-side tapered surfaces 406 having different inclination and have front-side tapered surfaces 406 having different rear-end positions in the axis L direction, a position for controlling the motion of the linear grinding members 103 to the inner circumferential side can be adjusted by changing a top member 401 to another one.

Figure 31A:
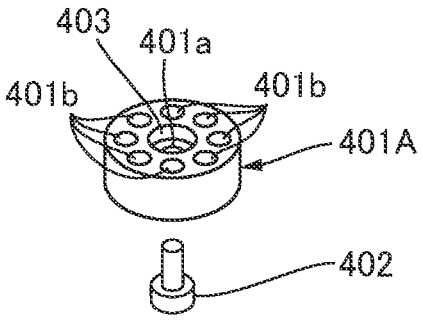
FIG. 31 is an illustration of another top member to be attached to a tool holder.
Figure 31B:
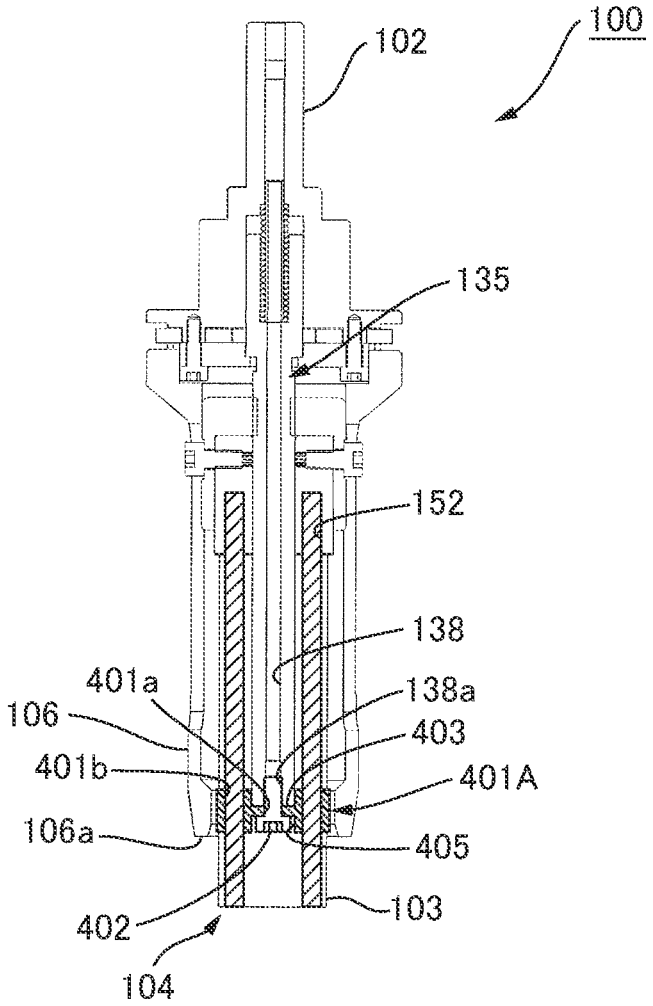

FIG. 31(*a*) is a perspective view of another example of a top member, and FIG. 31(*b*) illustrates a state that the top member of the present embodiment is attached to the polishing tool unit 100 of Embodiment 2. As illustrated in FIG. 31(*a*), a top member 401A of the present embodiment has a disk shape, and includes the center hole 401*a* at the center. The top member 401A further includes a plurality of through holes 401*b* formed at equiangular intervals around the center hole 401*a*. The number of the through holes 401*b* is the same as the number of the linear grinding member holding holes 152 of the grinding member holder 150, and the inner diameter of the through hole 401*b* corresponds to the inner diameter of the linear grinding member holding hole 152. The top member 401A further includes the rear-side recess part 403 coaxial with the center hole 401*a*, in the rear end surface. The rear-side recess part 403 has a shape that allows the front end portion of a shaft, such as the gear screw and the cam screw, to be inserted thereinto. The top member 401A further includes the front-side recess part 405 coaxial with the center hole 401*a*, in the front end surface. The front-side recess part 405 has a shape that allows the head part of the headed screw 402 to be inserted thereinto.

At the time of attaching the top member 401A to the gear screw 135, each of the bundles of the linear grinding members 103 inserted into a corresponding one of the linear grinding member holding holes 152 of the grinding member holder 150 is made to penetrate a corresponding one of the through holes 401*b*, as illustrated in FIG. 31(*b*). Then, the front end portion of the gear screw 135 is inserted into the rear-side recess part 403 of the top member 401A. Thereafter, the threaded part of the headed screw 402 is made to penetrate the center hole 401*a* of the top member 401A from the front, and is screwed into the threaded part 138*a* formed in the inner circumferential surface of the front end portion of the screw center hole 138 of the gear screw 135. With this configuration, the top member 401A is fixed to the front end portion of the gear screw 135, and the head part of the headed screw 402 is positioned inside the front-side recess part 405.

In a state that the top member 401A is attached to the gear screw 135, if the linear grinding members 103 are about to escape to the inner circumferential side during processing by rotation of the polishing tool unit 100, the linear grinding members 103 abut on the opening edge portion and the circumferential wall surface portion on the inner circumference side of the through hole 401*b* in the top member 401A, so that the escape (displacement) can be prevented. By contrast, if the linear grinding members 103 are about to escape to the outer circumferential side, the linear grinding members 103 abut on the opening edge portion and the circumferential wall surface portion on the outer circumference side of the through hole 401*b* in the top member 401A, so that the escape (displacement) can be prevented. Accordingly, the difference in ease of escape between the linear grinding members 103 positioned on the inner circumferential side and the linear grinding members 103 positioned on the outer circumferential side is eliminated. As a result, no difference in rigidity is made between the linear grinding members 103 positioned on the inner circumferential side and the linear grinding members 103 positioned on the outer circumferential side, and consequently, a situation can be avoided in which the linear grinding members 103 positioned on the inner circumferential side is less worn than the linear grinding members 103 positioned on the outer circumferential side, and thus, the linear grinding members 103 are uniformly worn.

Next, in each of Embodiments 1 to 5, a linear grinding member made of nylon, abrasive-grain-containing nylon, abrasive-grain-containing rubber, stainless steel, or brass may be employed. Furthermore, the polishing tool unit may be configured such that a polishing tool including an annular grinding stone or the like held by the grinding member holder is held by a tool holder.

(Rack Gear Installation Jig)

Figure 32A:
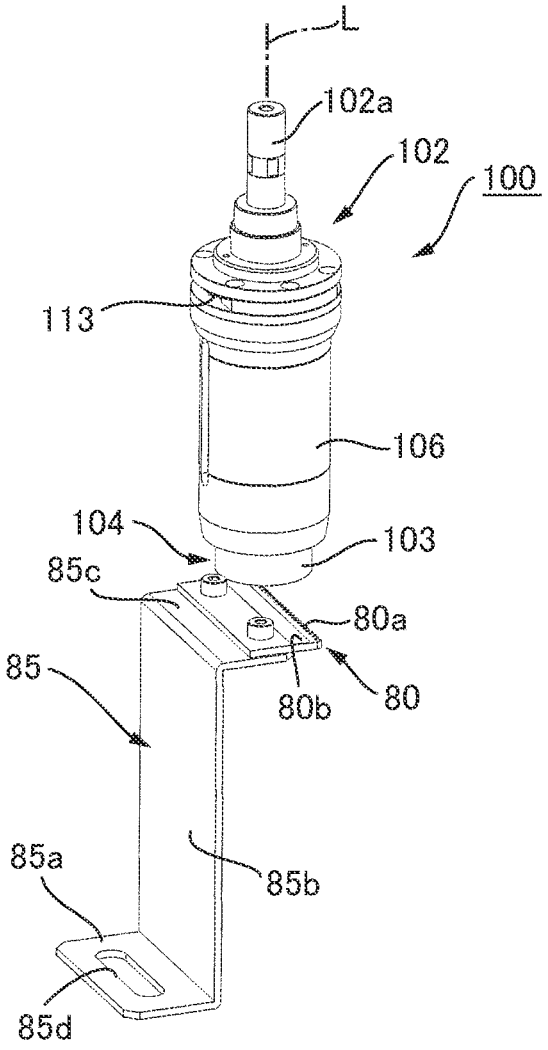
FIG. 32 is an illustration of a rack gear installation jig and a modification of a rack gear.
Figure 32B:
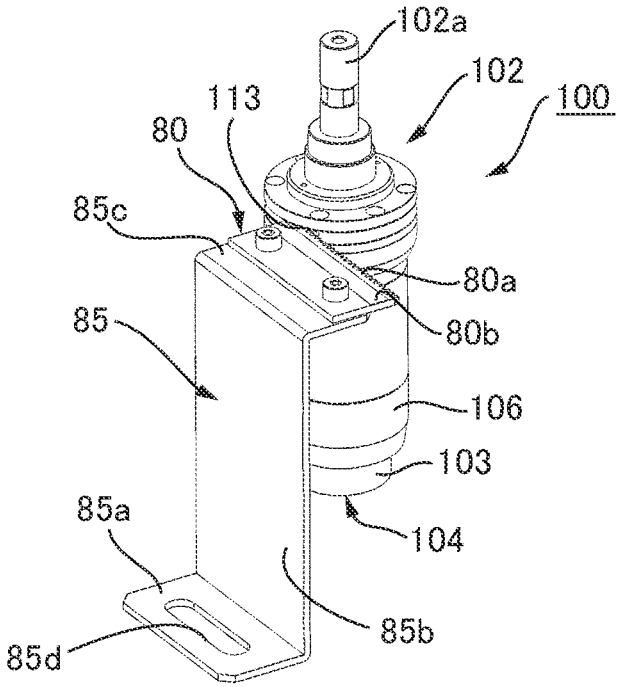

Here, a rack gear installation jig is described. FIG. 32 is an illustration of a rack gear installation jig and a modification of the rack gear 80. FIG. 32 illustrates an operation of adjusting the protruding amount of the grinding members in the polishing tool unit 100 of Embodiment 2. The rack gear installation jig is a jig by which the rack gear 80 for adjusting the grinding member protruding amount in the polishing tool units 1, 100, and 300 of the respective Embodiments 1, 2, and 4 is installed into a position for adjustment of the grinding member protruding amount.

A rack gear installation jig 85 is formed by bending a metal plate having a fixed thickness. As illustrated in FIG. 32, the rack gear installation jig 85 includes: a fixed plate part 85*a* fixed to a position for adjusting the grinding member protruding amount; a longitudinal plate part 85*b* extending upward with a constant width from the outer circumferential edge portion of the fixed plate part 85*a*; and an attachment plate part 85*c* horizontally extending from the upper end edge of the longitudinal plate part 85*b*. The fixed plate part 85*a* is provided with a long hole 85*d* that is penetrated by a screw for fixing the rack gear installation jig 85. The rack gear 80 is attached to the top surface of the attachment plate part 85*c*. The rack gear 80 is fixed to the attachment plate part 85*c* by a screw in a state that the gear tooth part 80*a* of the rack gear 80 protrudes outside from an end edge on the opposite side to the longitudinal plate part 85*b* of the attachment plate part 85*c*.

Here, the position for adjusting the grinding member protruding amount at which the rack gear 80 is disposed is present in a movable region of the head of the machining center connected to the polishing tool unit 100. Accordingly, cuttings and grinding member powder generated by workpiece processing using the polishing tool unit 100 connected to the head sometimes adhere to the rack gear 80. Furthermore, when an operation of adjusting the grinding member protruding amount is performed in a state that cuttings and grinding member powder adhere to the rack gear 80, the cuttings and the grinding member powder are stuck to the second gear 113 and the rack gear 80, thereby possibly bringing the second gear 113 and the rack gear 80 into a state of operation failure, such as a locked state. Here, if an operation of adjusting the grinding member protruding amount is continued when the second gear 113 and the rack gear 80 are in a state of operation failure, the polishing tool unit 100 and the rack gear 80 are damaged.

To solve such problem, the rack gear installation jig 85 is formed of a metal plate and has a low rigidity. Accordingly, in the case where the operation of adjusting the grinding member protruding amount is continued when the second gear 113 and the rack gear 80 are in a state of operation failure, the rack gear installation jig 85 bends, and the engagement of the second gear 113 with the rack gear 80 is canceled. That is, the rack gear installation jig 85 has a characteristic of escaping when an excessive force is applied between each of the polishing tool units 1, 100, and 300 and the rack gear 80, and therefore, in an operation of adjusting the grinding member protruding amount, each of the polishing tool units 1, 100, and 300 and the rack gear 80 are not damaged.

The rack gear installation jig 85 thus has the characteristic of escaping from an excessive force, and therefore, for example, when the gear tooth part 80*a* of the rack gear 80 is engaged with each of the gears (the gear screw operating gear 13, the second gear 113, the gear 307) of the respective polishing tool units 1, 100, and 300 in order to perform an operation of adjusting the grinding member protruding amount, even if the rack gear 80 interferes with the sleeves 6 and 106 of the respective polishing tool units 1 and 100 or the sleeve balancer 308 of the polishing tool unit 300, the rack gear 80 can be prevented or suppressed from damaging each of the polishing tool units 1, 100, and 300. Furthermore, since the rack gear installation jig 85 bends, even if the rack gear 80 interferes with the sleeves 6 and 106 of the respective polishing tool units 1 and 100 or the sleeve balancer 308 of the polishing tool unit 300 and escapes (is displaced) in a direction away from each of the polishing tool units 1, 100, and 300, once such interference is canceled, the rack gear 80 returns to the original state. Therefore, after the interference is canceled, the gear tooth part 80*a* of the rack gear 80 can be engaged with each of the gears (the gear screw operating gear 13, the second gear 113, the gear 307) of the respective polishing tool units 1, 100, and 300.

(Modification of Rack Gear)

Next, referring to FIG. 32 again, the modification of the rack gear 80 is described. The rack gear 80 has a rectangular plate shape as a whole, and includes the gear tooth part 80*a* along one side in the longitudinal direction of the rack gear 80. The rack gear 80 is disposed on the attachment plate part 85*c* of the rack gear installation jig 85, and fixed thereto. The gear tooth part 80*a* is positioned outside the attachment plate part 85*c*. The rack gear 80 of the present embodiment includes, on the top surface, an electrodeposition grinding stone 80*b* extending with a constant width along the gear tooth part 80*a*.

when an operation of adjusting the grinding member protruding amount is performed using the rack gear 80 including the electrodeposition grinding stone 80*b*, first, the tips of the linear grinding members 103 are brought into very-slight-contact with the electrodeposition grinding stone 80*b* in a state that the rack gear 80 and the axis L of the polishing tool unit 100 intersect at right angles, as illustrated in FIG. 32(*a*). Then, the polishing tool unit 100 is rotated, and moved along the gear tooth part 80*a*.

With this, the linear grinding members 103 are trued up by the electrodeposition grinding stone 80*b*, and the tips of the linear grinding members 103 are aligned. Furthermore, the top face of the rack gear 80 is cleaned by rotation of the linear grinding members 103, and therefore, if cuttings and grinding member powder adhere to the rack gear 80, the cuttings and the grinding member powder are removed. Here, at the time of cleaning the top face of the rack gear 80 by the linear grinding members 103, in parallel with the cleaning, the tips of the linear grinding members 103 are aligned at the top surface of the electrodeposition grinding stone 80*b* positioned higher than the top surface of the rack gear 80. Accordingly, it can be prevented or suppressed that the rotating linear grinding members 103 come into contact with the gear tooth part 80*a* of the rack gear 80, thereby polishing the edge.

Then, as illustrated in FIG. 32(*b*), a gear tooth part of the second gear 113 is engaged with the gear tooth part 80*a* of the rack gear 80. Thereafter, the polishing tool unit 100 is moved in the extension direction of the gear tooth part 80*a*, whereby the second gear 113 is rotated to adjust the grinding member protruding amount.

Here, if an operation of adjusting the grinding member protruding amount is performed in a state that cuttings and grinding member powder adhere to the rack gear 80, the cuttings and the grinding member powder are stuck to the second gear 113 and the rack gear 80, thereby possibly bringing the second gear 113 and the rack gear 80 into a state of operation failure, such as a locked state. By contrast, in the present embodiment, after cuttings and grinding member powder are removed from the rack gear 80 by the linear grinding members 103, the gear tooth part of the second gear 113 is engaged with the gear tooth part 80*a* of the rack gear 80. Therefore, it can be prevented or suppressed that the second gear 113 and the rack gear 80 are brought into a state of operation failure due to the cuttings or the grinding member powder, whereby the grinding member protruding amount cannot be adjusted.

The invention claimed is:

1. A tool holder comprising:

a shank;

a sleeve positioned forward of the shank in an axial direction of the shank;

a shaft positioned forward of the shank and extending coaxially with the shank;

a bolt portion provided in the shaft inside the sleeve;

a nut screwed onto the bolt portion; and a nut moving mechanism configured to move the nut along the bolt portion in the axial direction, wherein a polishing tool including a grinding member is movably held together with the nut in a state that at least part of the grinding member protrudes from a front end opening of the sleeve.

2. The tool holder according to claim 1, wherein the shaft is rotatable relative to the shank and the sleeve about an axis of the shank, the shank and the sleeve are relatively unrotatably connected to each other, and the nut moving mechanism includes a nut rotation regulating mechanism configured to regulate the rotation of the nut relative to the sleeve.

3. The tool holder according to claim 2, wherein the shaft is movable between a first position and a second position spaced backward from the first position in the axial direction, and the nut moving mechanism includes: a biasing member that provides biasing force to bias the shaft toward the first position when the shaft moves from the first position toward the second position; and a motion converting mechanism configured to convert a linear reciprocating motion of the shaft from the first position via the second position back to the first position into a rotational motion of the shaft to rotate about the axis at a certain angle in a single direction.

4. The tool holder according to claim 2, wherein the shank includes a coolant inlet hole that penetrates the shank, the nut moving mechanism includes: a moving member relatively unrotatably supported by the shaft in a state of being movable between a first position and a second position spaced backward from the first position in the axial direction; a biasing member that biases the moving member to the second position; and a motion converting mechanism configured to convert a linear reciprocating motion of the moving member from the second position via the first position back to the second position into a rotational motion of the moving member to rotate about the axis of the shank at a certain angle in a single direction, and when a coolant is fed into the coolant inlet hole, fluid pressure of the coolant allows the moving member to move from the second position to the first position against the biasing force of the biasing member.

5. The tool holder according to claim 2, wherein the nut moving mechanism includes an operating mechanism configured to rotate the shaft relative to the shank.

6. The tool holder according to claim 1, wherein the shank is formed integrally with the shaft, the sleeve is rotatable relative to the shank and the shaft about an axis of the shank, and the nut moving mechanism includes a nut rotation regulating mechanism configured to regulate the rotation of the nut relative to the sleeve.

7. The tool holder according to claim 6, wherein the nut moving mechanism includes an operating member configured to rotate the sleeve relative to the shank.

8. The tool holder according to claim 1, wherein the nut includes a connecting part that attachably and detachably connects to the polishing tool.

9. The tool holder according to claim 1, wherein the nut is provided integrally with the polishing tool.

10. A polishing tool unit comprising:

the tool holder according to claim 1 wherein the polishing tool is held by the tool holder.

11. A method of adjusting a protruding amount of a grinding member with a tool holder including a shank, a sleeve positioned forward of the shank in an axial direction of the shank, a shaft positioned forward of the shank and extending coaxially with the shank, a bolt portion provided in the shaft inside the sleeve, and a nut screwed onto the bolt portion; the method comprising:

holding a polishing tool including the grinding member by the tool holder, with the polishing tool movable integrally with the nut; and moving the nut along the bolt portion in the axial direction to adjust the grinding member protruding amount of the grinding member from the sleeve.

* * * * *